US005324162A

United States Patent [19]

Kishi

[11] Patent Number: 5,324,162

[45] Date of Patent: Jun. 28, 1994

[54] ACCESSORY DETACHABLE MECHANISM OF CONSTRUCTION MACHINE

[75] Inventor: Mitsuhiro Kishi, Ashikaga, Japan

[73] Assignee: Japanic Corporation, Tochigi, Japan

[21] Appl. No.: 958,656

[22] Filed: Oct. 8, 1992

Related U.S. Application Data

[63] Continuation of Ser. No. 735,385, Jul. 24, 1991, abandoned.

[30] Foreign Application Priority Data

| | | | |
|---|---|---|---|
| Jul. 25, 1990 | [JP] | Japan | 2-196763 |
| Sep. 13, 1990 | [JP] | Japan | 2-243203 |
| Sep. 13, 1990 | [JP] | Japan | 2-243204 |
| Sep. 20, 1990 | [JP] | Japan | 2-250697 |
| Nov. 9, 1990 | [JP] | Japan | 2-305558 |
| Apr. 9, 1991 | [JP] | Japan | 3-103437 |
| Jul. 4, 1991 | [JP] | Japan | 3-190547 |

[51] Int. Cl.[5] ..... E02F 3/32

[52] U.S. Cl. ..... 414/723; 37/468; 403/321

[58] Field of Search ..... 414/723; 403/321, 322; 172/271, 274; 37/468

[56] References Cited

U.S. PATENT DOCUMENTS

| | | | |
|---|---|---|---|
| 3,964,622 | 6/1976 | Blair et al. | 414/723 |
| 4,643,631 | 2/1987 | Maurer et al. . | |
| 4,663,866 | 5/1987 | Karlsson et al. . | |
| 4,813,163 | 3/1989 | Livingston et al. . | |
| 4,881,867 | 11/1989 | Essex et al. | 414/723 |
| 4,944,628 | 7/1990 | Huldén | 414/723 X |
| 5,024,010 | 6/1991 | Huldén . | |
| 5,110,254 | 5/1992 | Aubrey . | |

*Primary Examiner*—Donald W. Underwood

*Attorney, Agent, or Firm*—Flynn, Thiel, Boutell & Tanis

[57] ABSTRACT

A construction machine having a mobile chassis, a boom mounted on the mobile chassis and capable of swinging vertically, and an arm pivotally connected to the boom. An accessory detachable mechanism connects to a tip end of the arm. An accessory is releasably held by the detachable mechanism. The mechanism includes a pivotal four-bar linkage defined in part by the arm. First and second attaching arrangements are associated with the mechanism and releasably engage respective first and second attachment parts provided on the accessory. The first attachment arrangement includes hooks which engage the first attaching part as defined by a connecting pin on the accessory. A pressure cylinder is associated with the mechanism to effect relative engaging or releasing motion between the first and second attaching arrangements.

3 Claims, 50 Drawing Sheets

ACCESSORY DETACHABLE MECHANISM OF CONSTRUCTION MACHINE

This is a continuation of Ser. No. 07/735,385, filed Jul. 24, 1991, now abandoned.

BACKGROUND OF THE INVENTION

1. Field of the Invention

The present inventions relates to a detachable mechanism for detachably attaching an accessory to a boom of a construction machine.

2. Description of the Prior Art

In a construction machine for digging a drain or hole in the ground such as a so-called excavator, back hoe or the like, an accessory attached to a boom of the construction machine may be replaced by another accessory for achieving a work object.

The excavator has been typically employed for earth work or construction work and includes a bucket connected to the tip end of the boom. When the boom and bucket are swung, earth or sand are dug out for forming holes or drains.

However, the excavator is used not only for digging holes or drains by means of the bucket, but may be diverted to other work objects utilizing the mechanism thereof. That is, instead of the bucket, another accessory may be connected to the boom so that specific earth work or construction work can be done. For example, the bucket may be selected to have the size adapted for digging and trenching width, thereby enabling the excavator to work depending on hardness of earth and sand and width of holes or drains. Alternately, a breaker may be connected to the tip end of the boom or a grip may be employed for carrying out destruction work or loading or unloading work. A combination of various kinds of these accessories enables the excavator to adapt for various work, thereby improving the applicability at the construction work site.

When the bucket is replaced by another accessory, the bucket is removed and another accessory for another work object is manually connected to the boom. In this work, a pin connecting the boom and the bucket is removed so that the bucket is detached from the boom. Thereafter another accessory is connected to the boom, and the pin is inserted so as to penetrate both the accessory and the boom whereby the accessory and boom are connected with each other. The detaching and attaching work involved is carried out by man power. However, it takes much time and several operators for putting the pin in and out and replacing the accessory, which renders the work inefficient. If it were possible to arbitrarily detachably attach the accessory to the boom adapted for the specific work object, man power and work time involved in the replacement of the accessory would be reduced.

If one operator alone can attach the accessory to and detach the accessory from the boom, the other operators required for replacing the accessory can be eliminated. Similarly, if one operator of the excavator alone can detach and attach the accessory, and eliminate the operation involved in putting the pin in and pulling the pin out from the accessory, the work is made with safety to thereby reduce the time for replacing the accessory, and involves high work efficiency.

SUMMARY OF THE INVENTION

It is an object of the present invention to provide a detachable mechanism capable of solving the problems of the prior art and capable of simply attaching an accessory to or detaching an accessory from the boom of a construction machine.

To achieve the above object, a detachable mechanism of a construction machine according to a first aspect of the present invention comprises a mobile chassis, a boom mounted on the mobile chassis and capable of swinging vertically, an arm pivotally connected to the boom, a detachable mechanism connected to a tip end of the arm provided with a hydraulic cylinder having a cylinder rod, and an accessory to be held by the detachable mechanism, characterized in that the detachable mechanism comprises rising links pivotally connected to the tip end of the cylinder rod at upper ends thereof and to a portion adjacent to the tip end of the arm at the lower ends thereof, connecting links pivotally connected to the tip end of the cylinder rod at one ends thereof, a telescopic body composed of two symmetrical telescopic mechanisms each having upper covers and lower covers for forming outer frames thereof, the lower covers being slidably inserted into the upper covers and the upper covers being connected to other ends of the connecting links by a pin with the lower covers being connected to the tip end of the arm, a pair of upper hooks attached to the upper covers, a pair of lower hooks attached to the lower covers, and hydraulic cylinders respectively accommodated inside the upper and lower covers, the hydraulic cylinders having first large diameter portions which are brought into contact with inner walls of the upper covers and second large diameter portions which are brought into contact with inner walls of the lower covers.

A detachable mechanism according to a second aspect of the present invention comprises a substantially U-shaped pawl holder pivotally connected to the tip end of the cylinder rod and having hooks at the tip end thereof, rising links pivotally connected to the tip end of the cylinder rod at upper ends thereof and to a portion adjacent to the tip end of the arm at the lower ends thereof, a supporting link having an upper end connected to a front of the pawl holder and a lower end connected to the tip end of the arm, a hydraulic cylinder provided inside the arm and having a cylinder rod, an operation plate connected to the tip end of the cylinder rod and having oblique sides and guide grooves defined at upper and lower surfaces thereof, block shaped guide bodies vertically fixed to the tip end of the arm and having projections at the central portions thereof which are capable of engaging with the guide groove, and cylindrical holding pins provided inside the arm and having an insertion groove and telescopically movable in and out of side openings defined at right and left sides of the tip end of the arm by the motion of the operation plate.

A detachable mechanism according to a third aspect of the present invention comprises a substantially U-shaped pawl holder pivotally connected to the tip end of the cylinder rod and having hooks at the tip end thereof, rising links pivotally connected to the tip end of the cylinder rod at upper ends thereof and to a portion adjacent to the tip end of the arm at the lower ends thereof, a supporting link having an upper end connected to a front of the pawl holder and a lower end connected to the tip end of the arm, a hydraulic cylinder provided inside the arm and having a cylinder rod, an operation plate connected to the tip end of the cylinder rod and having oblique sides and guide grooves defined at upper and lower surfaces thereof, the operation plate further having guide slits defined in parallel with oblique sides thereof, block shaped guide bodies vertically fixed to the tip end of the arm and having projections at the central portions thereof which are capable of engaging with the guide groove, and cylindrical holding pins provided inside the arm and having an insertion groove and telescopically movable in and out of side openings defined at right and left sides of the tip end of the arm by the motion of the operation plate, the cylindrical holding pins further having pin holes through which pins passed through the guide slits of the operation plate pass.

A detachable mechanism according to a fourth aspect of the present invention comprises rising links pivotally connected to the tip end of the cylinder rod at upper ends thereof and to a portion adjacent to the tip end of the arm at the lower ends thereof, connecting links pivotally connected to the tip end of the cylinder rod at one ends thereof, a telescopic body composed of two symmetrical telescopic mechanisms each having upper covers and lower covers for forming outer frames thereof, the lower covers being slidably inserted into the upper covers and the upper covers being connected to other ends of the connecting links by a pin with the lower covers being connected to the tip end of the arm, an apron for covering the upper covers and having a U-shaped recess at the upper central portion thereof, a pair of upper hooks attached to the apron, a connection plate for covering the lower covers, a pair of lower hooks attached to the connection plate, an interlock body composed of a central portion disposed behind the apron with a given interval, a top portion having a presser hook and hydraulic cylinders respectively accommodated inside the upper and lower covers, the hydraulic cylinders having first large diameter portions which are brought into contact with inner walls of the upper covers and second large diameter portions which are brought into contact with inner walls of the lower covers.

A detachable mechanism according to a fifth aspect of the present invention comprises a substantially U-shaped pawl holder pivotally connected to the tip end of the cylinder rod and having hooks at the tip end thereof, rising links pivotally connected to the tip end of the cylinder rod at upper ends thereof and to a portion adjacent to the tip end of the arm at the lower ends thereof, a supporting link having an upper end connected to a front of the pawl holder and a lower end connected to the tip end of the arm, a slit shaped holding groove opened in the tip end of the arm, a support shaft positioned inside the arm and positioned innermost of the holding groove and having a holding body swingably supported thereto, the holding body having a holding portion at the tip end thereof for contacting the holding pin of the accessory and a spring at the central portion thereof and a release lever at the base thereof, a cylinder having a cylinder rod positioned inside the arm, an extension plate connected to the tip end of the cylinder rod and having a rod at the lower end thereof in parallel with the cylinder rod, the rod being directed to the side surface of the release lever of the holding body.

A detachable mechanism according to a sixth aspect of the present invention comprises rising links pivotally connected to the tip end of the cylinder rod at upper ends thereof and to a portion adjacent to the tip end of the arm at the lower ends thereof, connecting links pivotally connected to the tip end of the cylinder rod at one ends thereof, holding links connected to the connecting links at the one ends thereof by a pin and swingably connected to the tip end of the arm at the other end thereof by a bearing, the holding links having holding pawls protruding from the front upper portions thereof and holding grooves of U-shape, a hydraulic cylinder provided inside the arm and having a cylinder rod, an operation plate connected to the tip end of the cylinder rod and having oblique sides and guide grooves defined at upper and lower surfaces thereof, block shaped guide bodies vertically fixed to the tip end of the arm and having projections at the central portions thereof which are capable of engaging with the guide groove, and cylindrical holding pins provided inside the arm and having an insertion groove and telescopically movable in and out of side openings defined at right and left sides of the tip end of the arm by the motion of the operation plate.

A detachable mechanism according to a seventh aspect of the present invention comprises rising links pivotally connected to the tip end of the cylinder rod at upper ends thereof and to a portion adjacent to the tip end of the arm at the lower ends thereof, connecting links pivotally connected to the tip end of the cylinder rod at one ends thereof, an assembly having one end pivotally connected to the other ends of the connecting links and the other end pivotally connected to the tip end of the arm, the assembly further having a window opened at the upper front portion thereof, a pair of upper fixed pawls fixed to an upper portion of the assembly and disposed over the window, a pair of lower fixed pawls fixed to a lower portion of the assembly, an upper movable pawl interposed between the upper fixed pawls and the lower fixed pawls, a lower movable pawl provided under the lower fixed pawls, an interlock body slidably provided inside the assembly and having an upper end connected to the lower portion of the upper movable pawl passed through the window and a lower end connected to the lower movable pawl at a right angle therewith, a support plate fixed between the lower fixed pawls; and a hydraulic cylinder having a base fixed to the support plate and a cylinder rod connected to the upper movable pawl.

The above and other objects, features and advantages of the present invention will become more apparent from the following description taken in conjunction with the accompanying drawings.

DESCRIPTION OF THE PREFERRED EMBODIMENT

First Embodiment (FIGS. 1 to 5)

Figure 1:
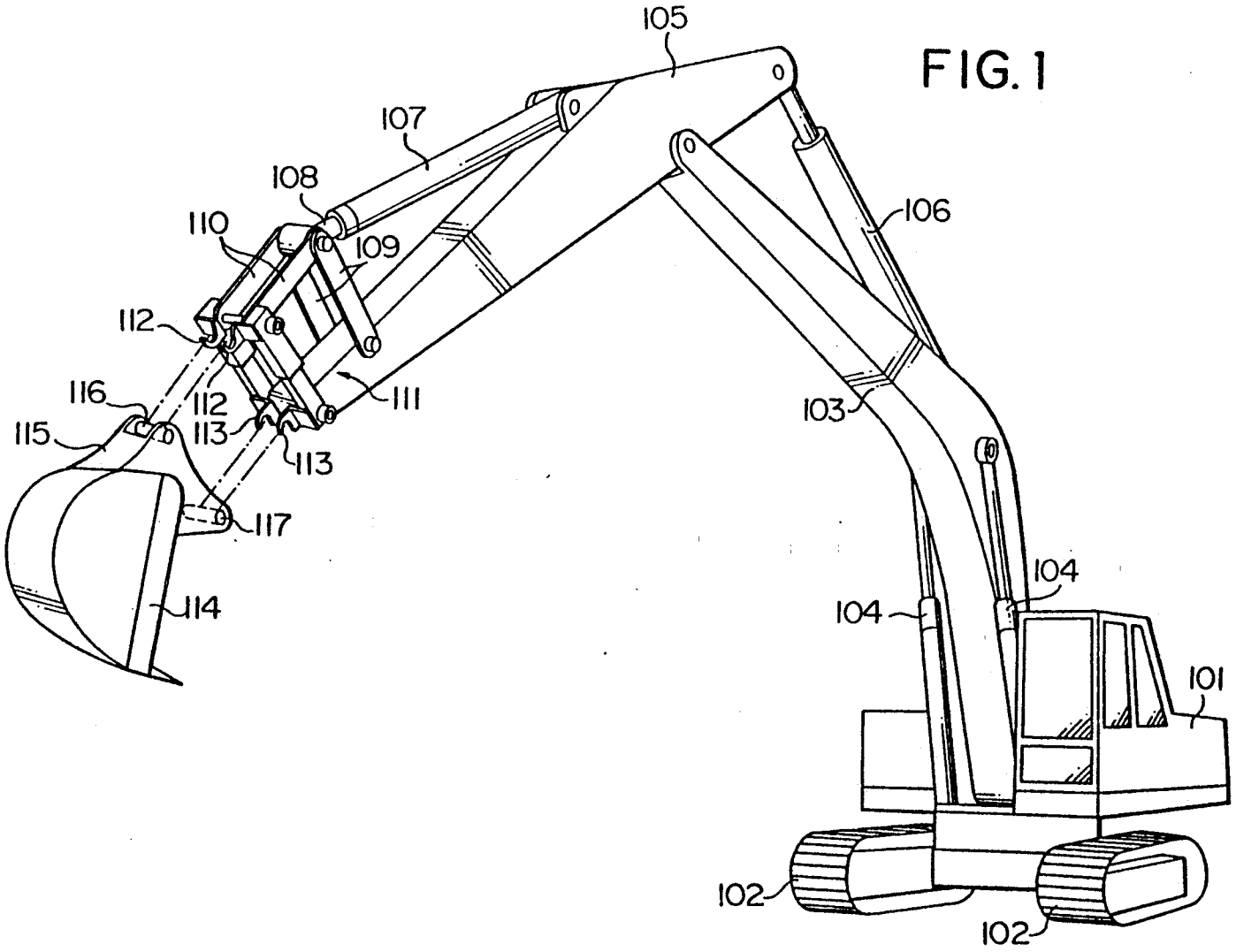
FIG. 1 is a perspective view of an excavator employing an accessory detachable mechanism according to a first embodiment of the present invention.

An accessory detachable mechanism of a construction machine according to the first embodiment of the present invention will be described with reference to FIGS. 1 to 5.

The construction machine comprises a mobile chassis 101 having an engine and the like mounted thereon and an endless track 102 at right and left sides of the lower portion thereof and capable of freely moving front and rear, left and right. The mobile chassis 101 has an arm 103 having a substantially C-shaped configuration and attached to the front portion thereof so as to be vertically swingable. There are provided a pair of first hydraulic cylinders 104 between the arm 103 at right and left sides of the central portion thereof at the front portion of the mobile chassis 101 whereby the arm 103 can be vertically swung by the operation of the first hydraulic cylinders 104.

An elongate boom 105 is connected to an upper end of the arm 103 so as to be vertically movable. A second hydraulic cylinder 106 is interposed between a central portion of the arm 103 at the rear surface thereof and a rear end of the boom 105, whereby the boom 105 can be vertically swung relative to the arm 103 by the operation of the second hydraulic cylinder 106. A bucket cylinder 107 has a rear end pivotally connected to a rear central portion of the boom 105 and a tip end provided with a cylinder rod 108.

The accessory attaching mechanism includes a pair of rising links 109 are pivotally connected to the right and left sides of the cylinder rod 108. Lower ends of the rising links 109 are pivotally connected to a portion adjacent to a tip of the boom 105 at both sides thereof. A pair of connecting links 110 are pivotally connected to the tip end of the cylinder rod 108 at right and left sides thereof. A telescopic body 111 telescopically movable by oil under pressure is pivotally attached between tip ends of the connecting links 110 and the tip end of the boom 105. A substantially square shaped link mechanism is formed by the pairs of rising links 109, connecting links 110 and telescopic body 111. The telescopic body 111 has upper hooks 112 fixed thereto at right and left sides of the upper portion thereof and lower hooks 113 fixed thereto at right and left sides of the lower portion thereof.

A bucket 114 as illustrated FIG. 1 has a known structure and has an attached body 115 connected thereto at a part of the periphery thereof. Parallel first and second holding pins 116 and 117 are fixed to the side surfaces of the attached body 115 at a predetermined spacing. The holding pins 116 and 117 may be structured the same as those inserted into pin holes defined in the bucket 114 of the known structure.

Figure 2:
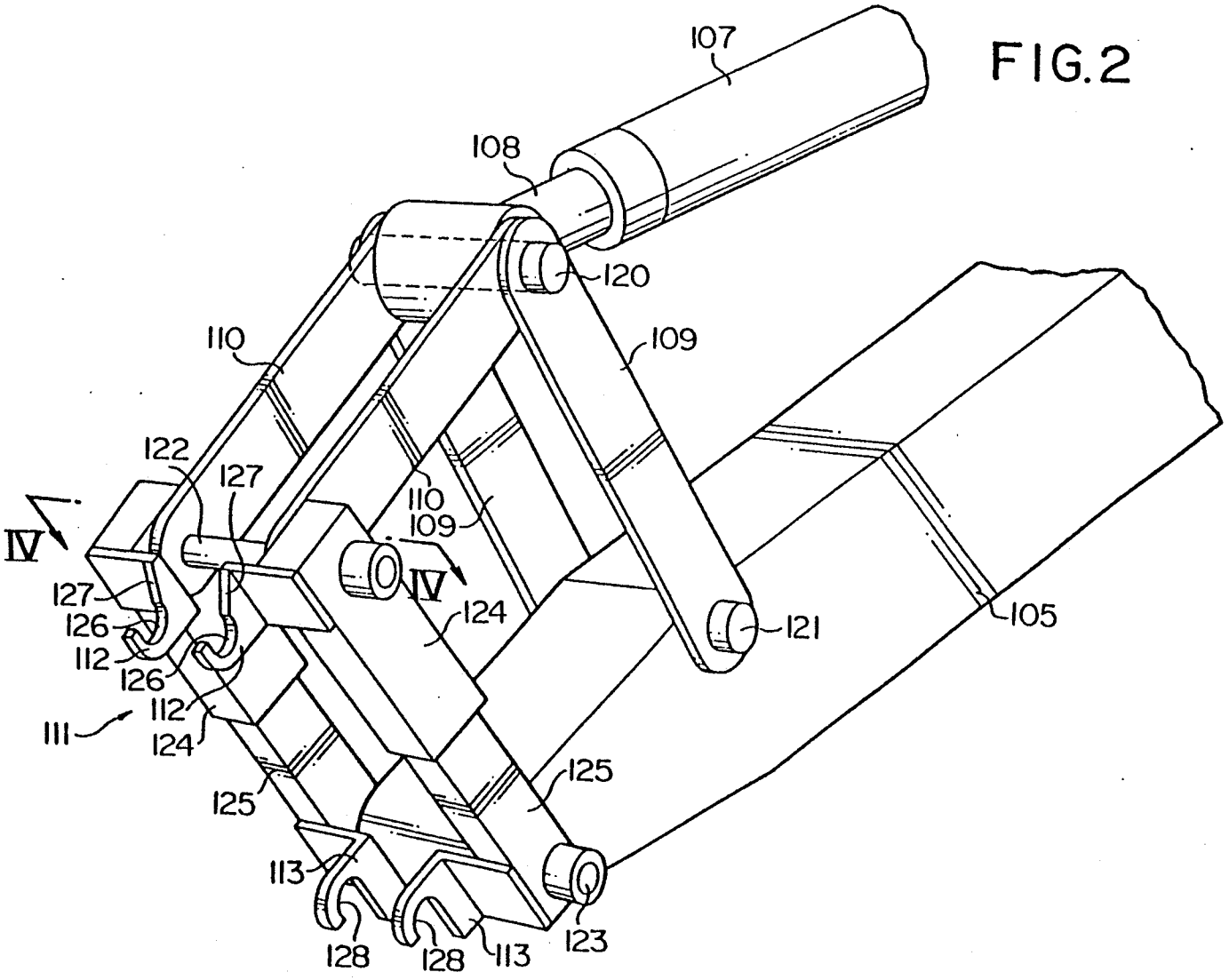
FIG. 2 is an enlarged view of the accessory detachable mechanism in FIG. 1.

The telescopic body 111 will be described more in detail with reference to FIG. 2.

The rising links 109 and the connecting links 110 are connected to the tip end of the cylinder rod 108 at the right and left sides thereof so as to be pivotable. The lower ends of the rising links 109 are respectively connected to the portion adjacent to the tip end of the boom 105 at the both sides thereof by pivot pins 121.

The telescopic body 111 comprises two symmetrical telescopic mechanisms each having upper covers 124 and lower covers 125 for forming outer frames thereof. The lower covers 125 are slidably inserted into the upper covers 124 while the upper covers 124 are connected to the tip ends of the connecting links 110 by a pivot pin 122 so as to turn relative to the connecting links 110. The lower covers 125 are connected to the tip end of the boom 105 at the right and left sides thereof by a pivot pin 123 so as to turn relative to the boom 105.

The upper covers 124 have the pair of hooks 112 formed by bending them substantially in L-shape attached to the front upper portion thereof so as to be symmetrical with respect to each other. The upper hooks 112 have hook surfaces 126 of semi-circular arc shapes at the protruding upper surfaces thereof, which hook surfaces 126 open in the upward direction. Guide surfaces 127 are defined aslant at the side of the pin 122 and extend from the hook surfaces 126. The lower covers 125 have lower hooks 113 which are L-shaped and attached thereto at the front lower portion thereof so as to be symmetrical with respect to each other. The lower hooks 113 have hook surfaces 128 of semi-circular arc shapes at the lower side thereof.

Figure 3:
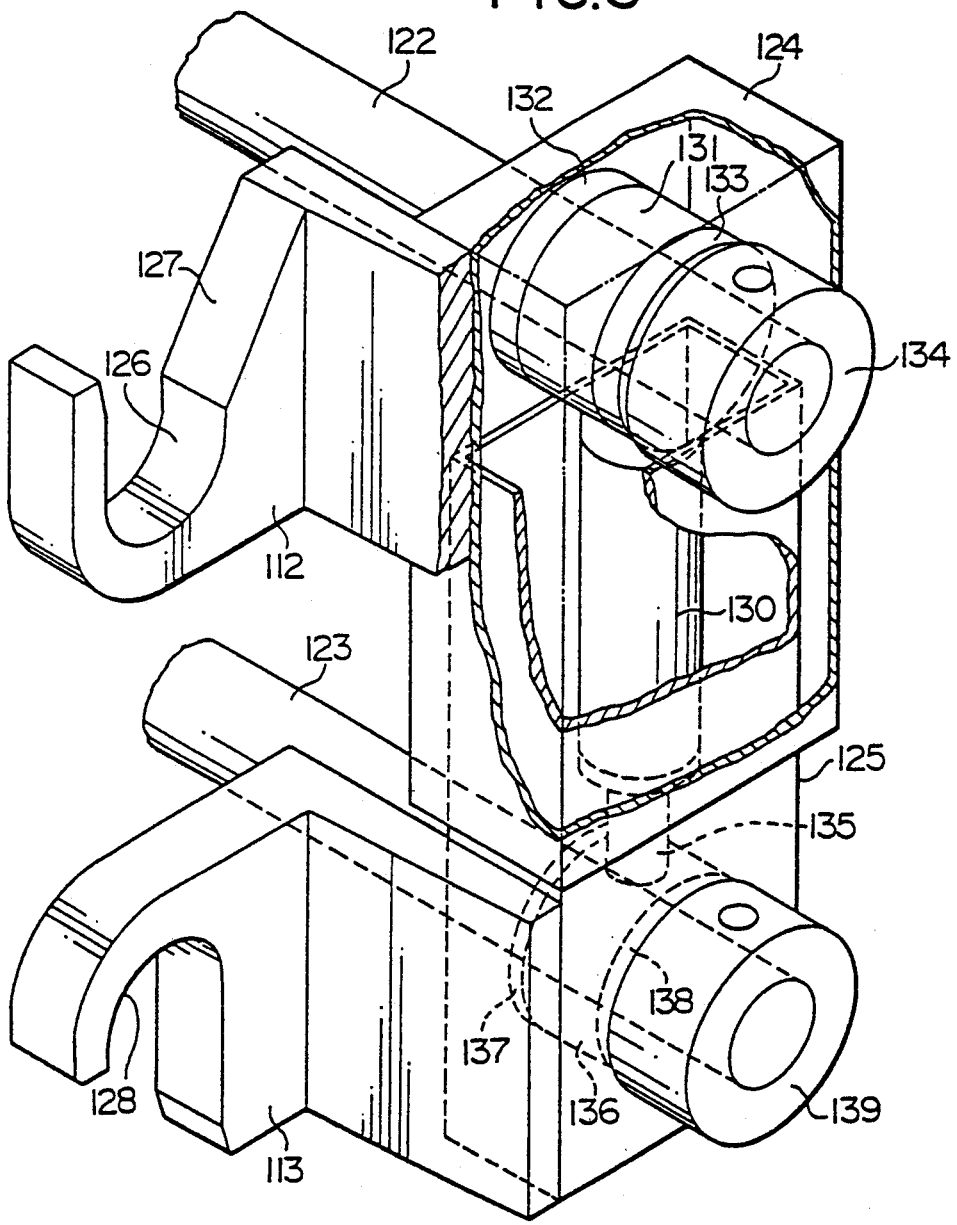
FIG. 3 is an enlarged partly cut away perspective view of a stretchable mechanism, a main constituent of the accessory detachable mechanism of FIG. 2.
Figure 4:
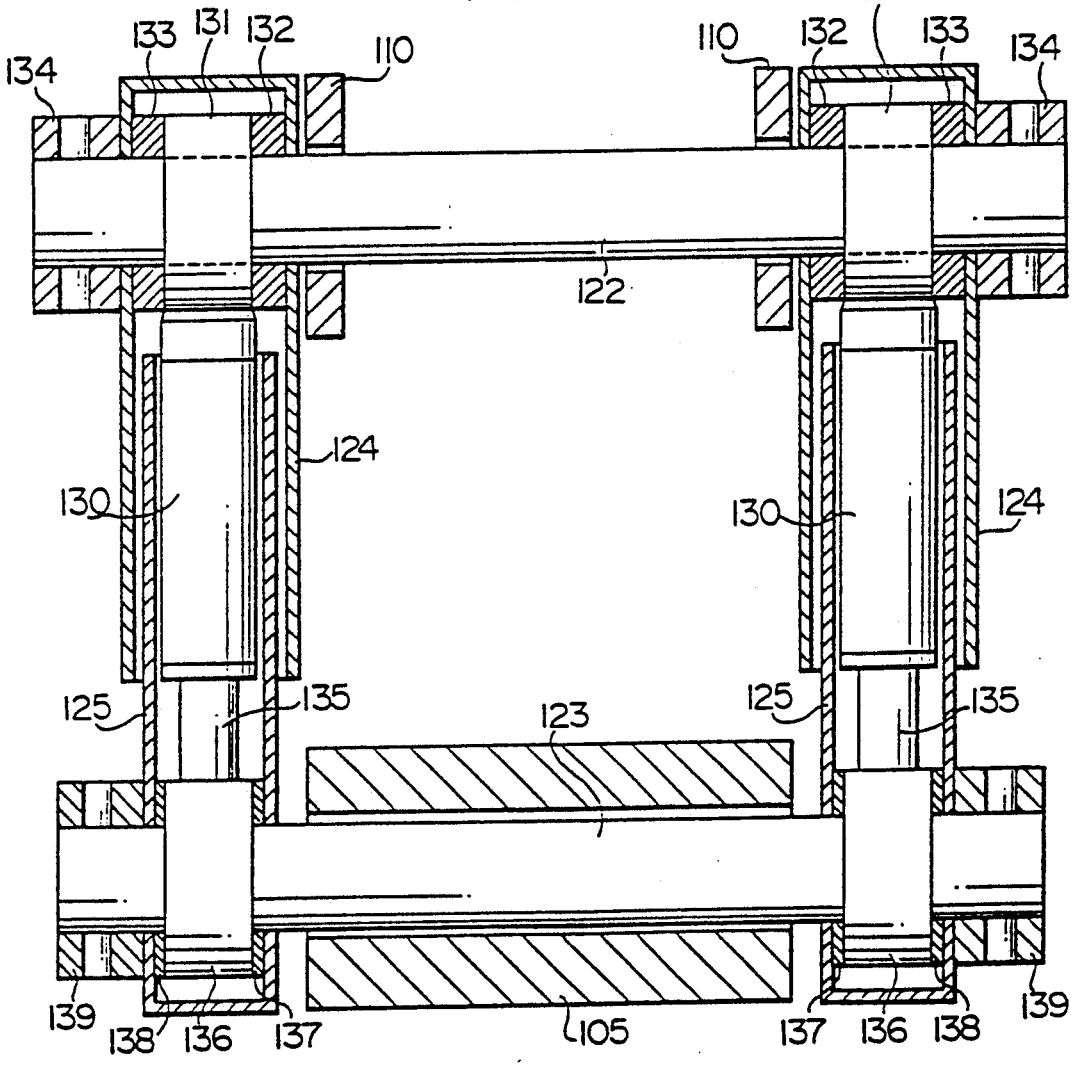
FIG. 4 is a cross sectional view taken along arrows IV—IV of FIG. 2.

The internal structures of telescopic body 111 will be described in detail with reference to FIGS. 3 and 4.

Both the upper covers 124 and the lower covers 125 are respectively hollow at the insides thereof in which hydraulic cylinders 130 are accommodated for telescopically moving the lower covers 125 relative to the upper covers 124. The hydraulic cylinders 130 have first connected portions 131 defined at rear ends thereof and each having a large diameter. The connected portions 131 are positioned at the upper portion of the upper covers 124 and brought into contact with inner walls of the upper covers 124 by way of collars 132 and 133. The pin 122 penetrates the connected portions 131 and the collars 132 and 133. Stop rings 134 are inserted onto both ends of the pin 122 and fixed thereto by keys.

Tip ends of cylinder rods 135 are telescopically moved by the hydraulic cylinders 130 and have respectively second large diameter portions 136. The right and left sides of the large diameter portions 136 are brought into contact with inner walls of the lower covers 124 by way of collars 137 and 138. A pin 123 penetrates into the lower covers 125, the collars 137 and 138 and the large diameter portions 136. Holding rings 139 are inserted onto both ends of the pin 123 and fixed thereto by keys.

The telescopic body 111 is connected, instead of the bucket 114, between the tip end of the boom of the known excavator and the tip end of the connecting links 110.

An operation of the accessory detachable mechanism according to the first embodiment will be described with reference to FIGS. 5(A), 5(B) and 5(C).

Figure 5A:
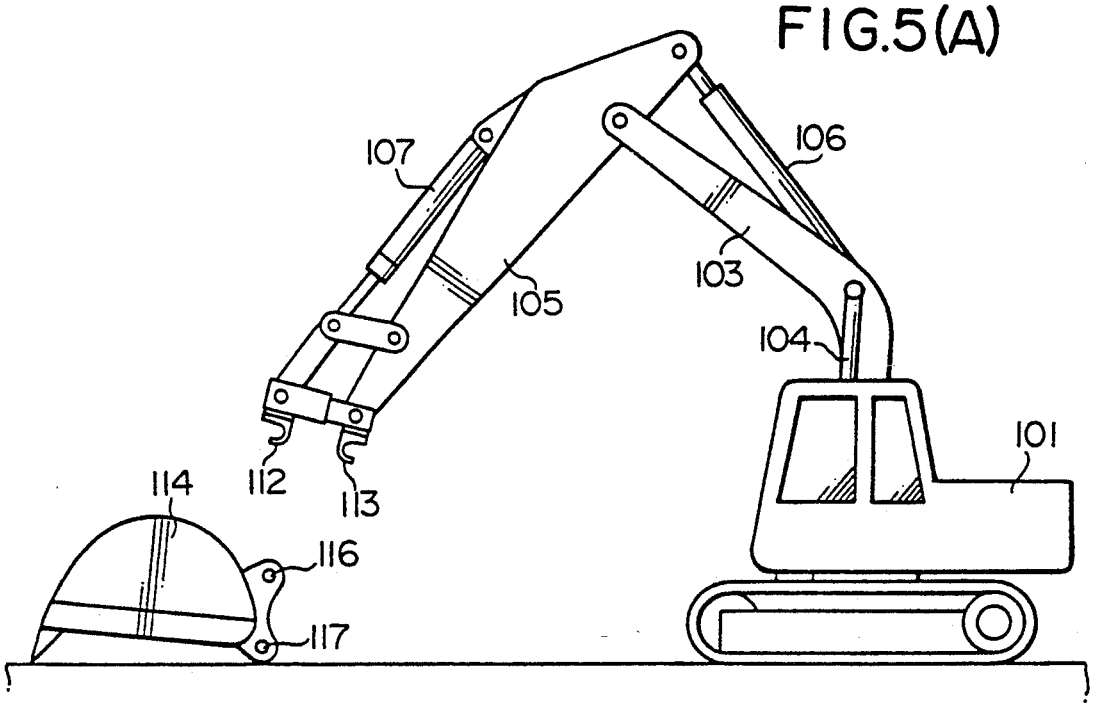
FIGS. 5(A) to 5(C) are views showing operations of the accessory detachable mechanism according to the first embodiment.

FIG. 5(A) shows a state where the boom 105 has no accessory at the tip end thereof. From this state, the bucket 114 as the accessory is ready to be attached to the tip end of the boom. The bucket cylinder 107 is stretched at its maximum length while the hydraulic cylinders 130 in the telescopic body 111 are contracted to a maximum, whereby the interval or spacing between upper hooks 112 and lower hooks 113 is at a minimum. At this stage, the arm 103 and the boom 105 are vertically swung by the operation of the hydraulic cylinders 104 and 106 to thereby move the upper hooks 112 toward the holding pin 116 of the bucket 114. Inasmuch as the bucket cylinder 107 is stretched at a maximum, the upper pin 116 is positioned for engagement with hooks 112 of the accessory detachable mechanism while the lower hooks 113 are positioned so that they do not contact the holding pin 117.

Figure 5B:
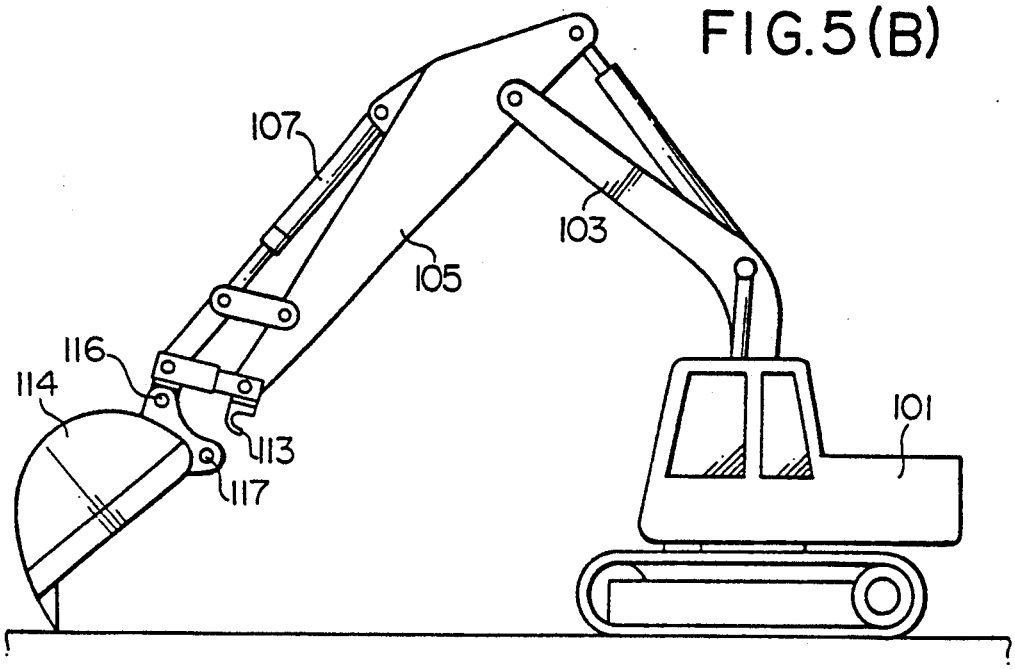

FIG. 5(B) shows a state where the boom 105 is slightly inclined at a given angle by operating the hydraulic cylinders 104 and 106 after the holding pin 116 is allowed to contact the inner periphery of the hook surfaces 126 of the upper hooks 112.

The pin 116 is hooked by the upper hooks 112 while the bucket 114 is suspended as it is. Then, the bucket cylinder 107 is contracted when the bucket 114 is suspended by the upper hooks 112. At this stage, the rising links 109 are turned clockwise about the pin 121, thereby pulling the connecting links 110 rightward. As a result, the telescopic body 111 is also pulled rightward as a whole and turned clockwise about the pin 123 so that the bucket 114 is pulled toward the tip end of the boom 105. Consequently, the lower holding pin 117 is allowed to move relatively toward the lower hooks 113.

Successively, the lower hooks 113 move into the space defined between the holding pins 116 and 117.

When the lower hooks 113 are positioned in the space between the holding pins 116 and 117, the hydraulic cylinders 130 are stretched. The cylinder rods 135 are pushed by the operation of the hydraulic cylinder 130, thereby enlarging the interval between the pins 122 and 123. Consequently, the interval between the upper hooks 112 fixed to the upper covers 124 and the lower hooks 113 fixed to the lower covers 125 is enlarged so that the lower hooks 113 are moved relative to the upper surface of the holding pin 117. When the hook surfaces 128 of the lower hooks 113 contact the holding pin 117, the two holding pins 116 and 117 are expanded and clamped by the pair of upper hooks 112 and the pair of lower hooks 113 whereby the bucket 114 is connected to the tip end of the boom 105 as illustrated in FIG. 5(C).

When oil under pressure in the hydraulic cylinder 130 is kept constant, the hook surfaces 126 of the upper hooks 112 and the hook surfaces 128 of the lower hooks 113 are always biased against and contact the holding pins 116 and 117 so that the bucket 114 is not dropped out from the tip end of the boom 105.

Figure 5C:
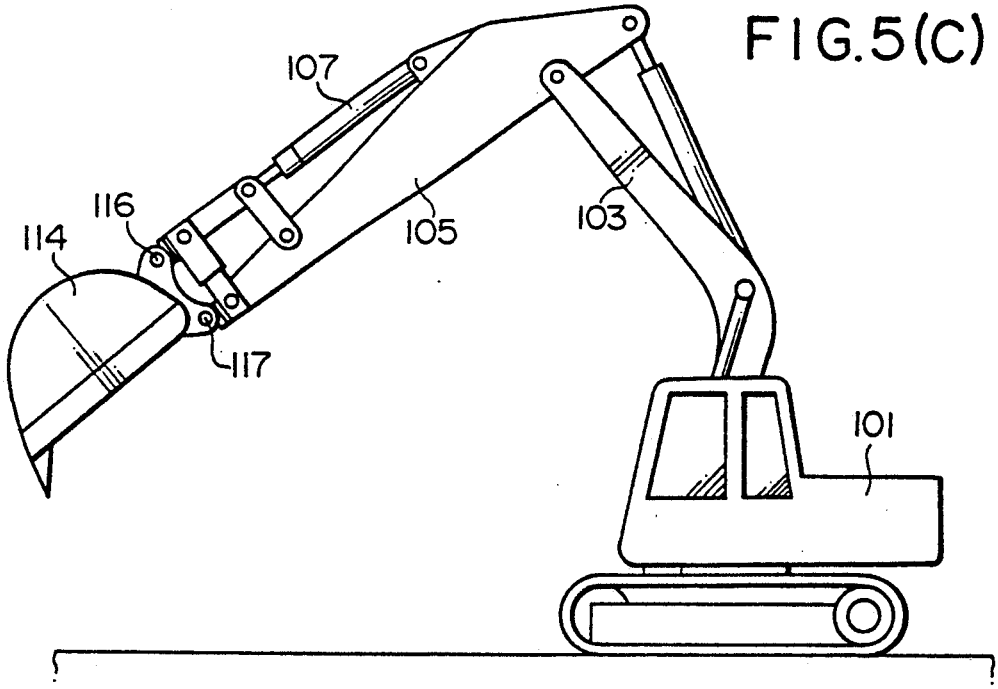
Figure 6:
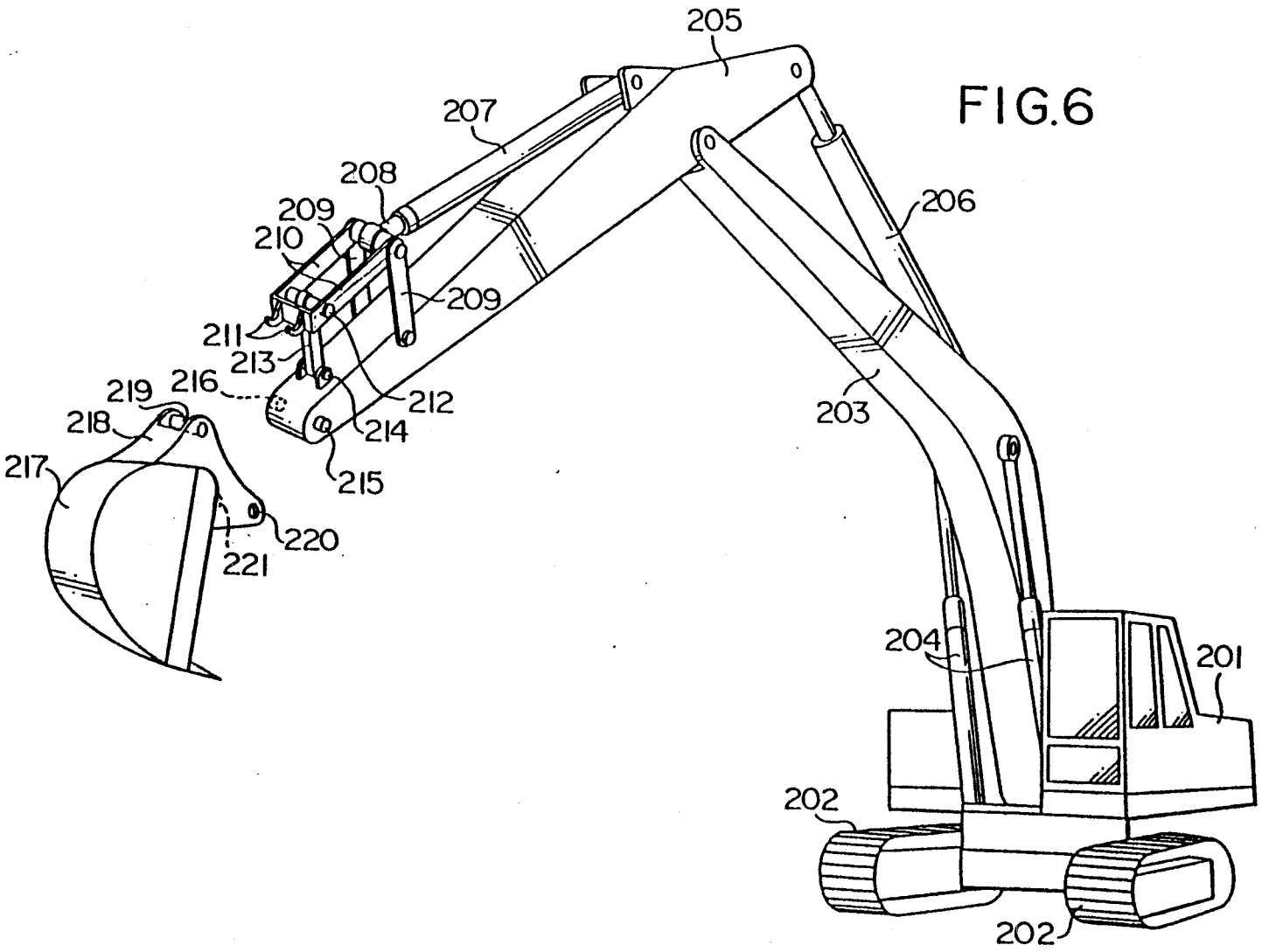
FIG. 6 is a perspective view of an excavator employing the accessory detachable mechanism according to a second embodiment of the present invention.

When the bucket 114 is removed from the tip end of the boom 105, contrary to the previous attaching operation, the operations in the process as illustrated in FIG. 5(C), 5(B) and 5(A) are sequentially carried out.

One operator alone can select one of various accessories and attach the selected accessory to the tip end of the boom 105 provided that the various accessories have the holding pins fixed thereto and the holding pins have the same interval as the holding pins 116 and 117 of the bucket 114.

It is possible to selectively attach various accessories, such as the bucket, to the arm for use in earth work or construction work since the detachable mechanism is provided at the tip end of the arm of the conventional excavator and the accessories to be replaced and used in the construction work have parallel holding pins fixed thereto.

It is possible to selectively attach the accessories to the boom by one operator alone without the help of other operators.

Second Embodiment (FIGS. 6 to 13)

An accessory detachable mechanism according to a second embodiment of the present invention will be described with reference to FIGS. 6 to 13. Components which are the same as those of the first embodiment will be identified by the same reference numerals except increased by 100.

The arrangement of the construction machine according to the second embodiment is the same as that of the first embodiment except for the detachable mechanism. Accordingly, the explanation of the construction machine is omitted.

The detachable mechanism includes a pair of rising links 209 pivotally attached to both sides of the tip end of a cylinder rod 208 of bucket cylinder 207. The rising links 209 are pivotally connected at lower ends thereof to both sides of a portion adjacent to the tip end of an arm 205.

A substantially U-shaped pawl holder 210 is pivotally connected to the tip end of the cylinder rod 208 and has a pair of hooks 211 at the tip end thereof. The hooks 211 have the configuration of pawls which are directed upward. A supporting link 213 has an upper end connected by pivot pin 212 between parallel left and right pieces of the pawl holder 210 at the front portion thereof and has a lower end connected to an upper surface of the tip end of the arm 205 by way of pivot pins 214. The rising links 209, pawl holder 210, the supporting link 213 and the arm 205 form a substantially parallelogram linkage. Holding pins 215 and 216 are provided at the right and left sides of tip end of the arm 205 and are telescopically movable at both sides of the tip end of the arm 205.

Figure 7:
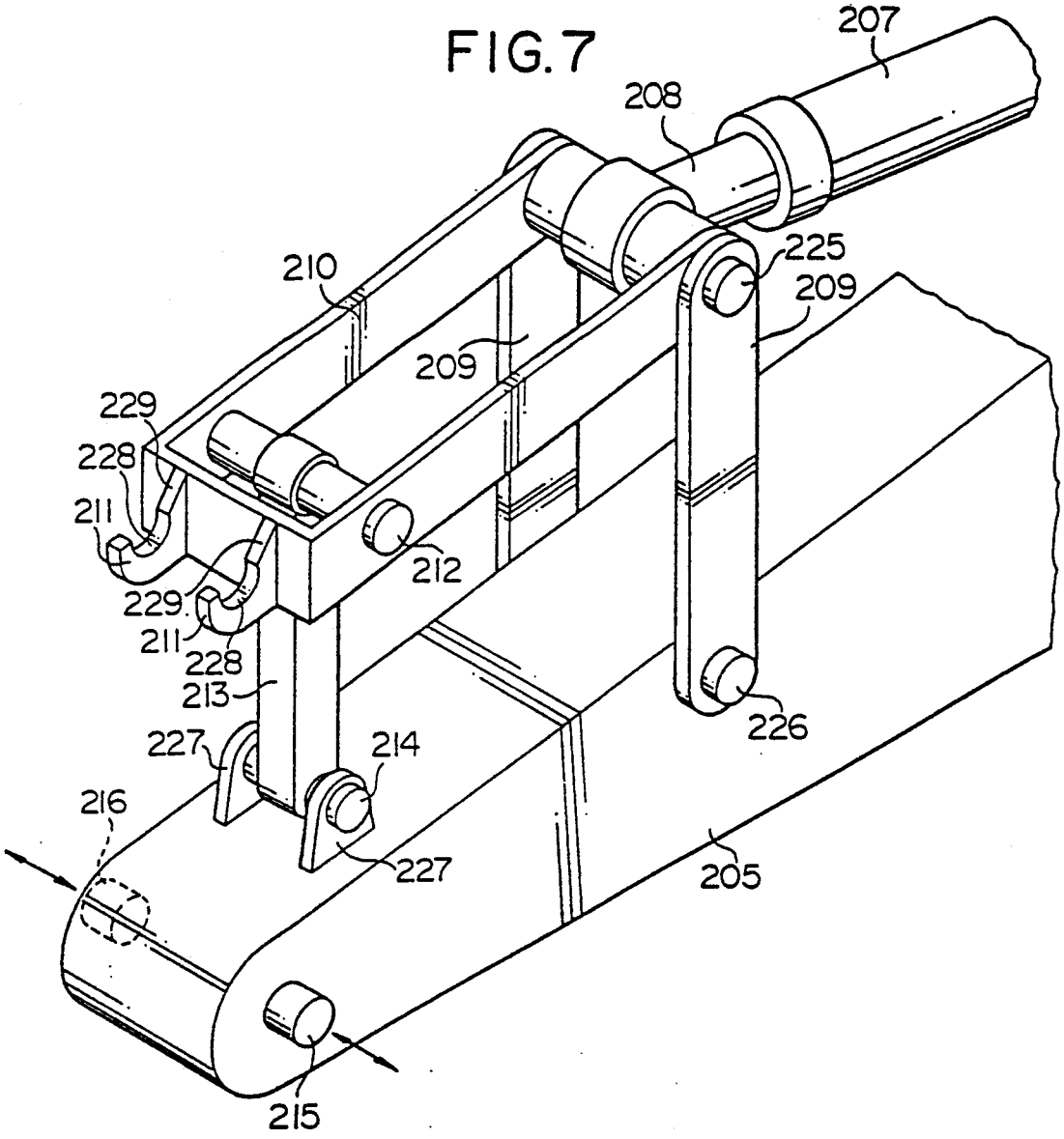
FIG. 7 is an enlarged view of the accessory detachable mechanism in FIG. 6.

The accessory detachable mechanism will be described more in detail with reference to FIG. 7.

A pin 225 penetrates the tip end of the cylinder rod 208 and has both sides into which both ends of the pawl holder 210 are inserted. Upper ends of the rising links 209 are connected to right and left outer sides of the pawl holder 210. The rising links 209 are connected to both sides of the arm 205 at lower ends thereof by pins 226 so as to be turnable.

The pawl holder 210 is integrally formed by bending a steel plate and comprises a front closed piece and two pieces extending from the front closed piece. A pin 212 is disposed and pivotally supported by the two pieces of the pawl holder 210 at the portion adjacent to the front closed piece. The upper end of the supporting link 213 is connected to the center of the pin 212. A pair of supporting pieces 227 protrude from the upper surface adjacent to the tip end of the arm 205. The lower end of the supporting link 213 is inserted between the pair of supporting pieces 227 and connected thereto by the pivot pin 214.

The pair of hooks 211 are fixed to the front of the pawl holder 210 by welding or the like and formed by cutting out a steel plate. Hook surfaces 228 are recessed in semi-circular shape and directed upward at the central portions of the hooks 211. The hooks 211 have aslant guide surfaces 229 extending from the hook surfaces 228 and terminating in the front closed piece of the pawl holder 210.

Figure 8:
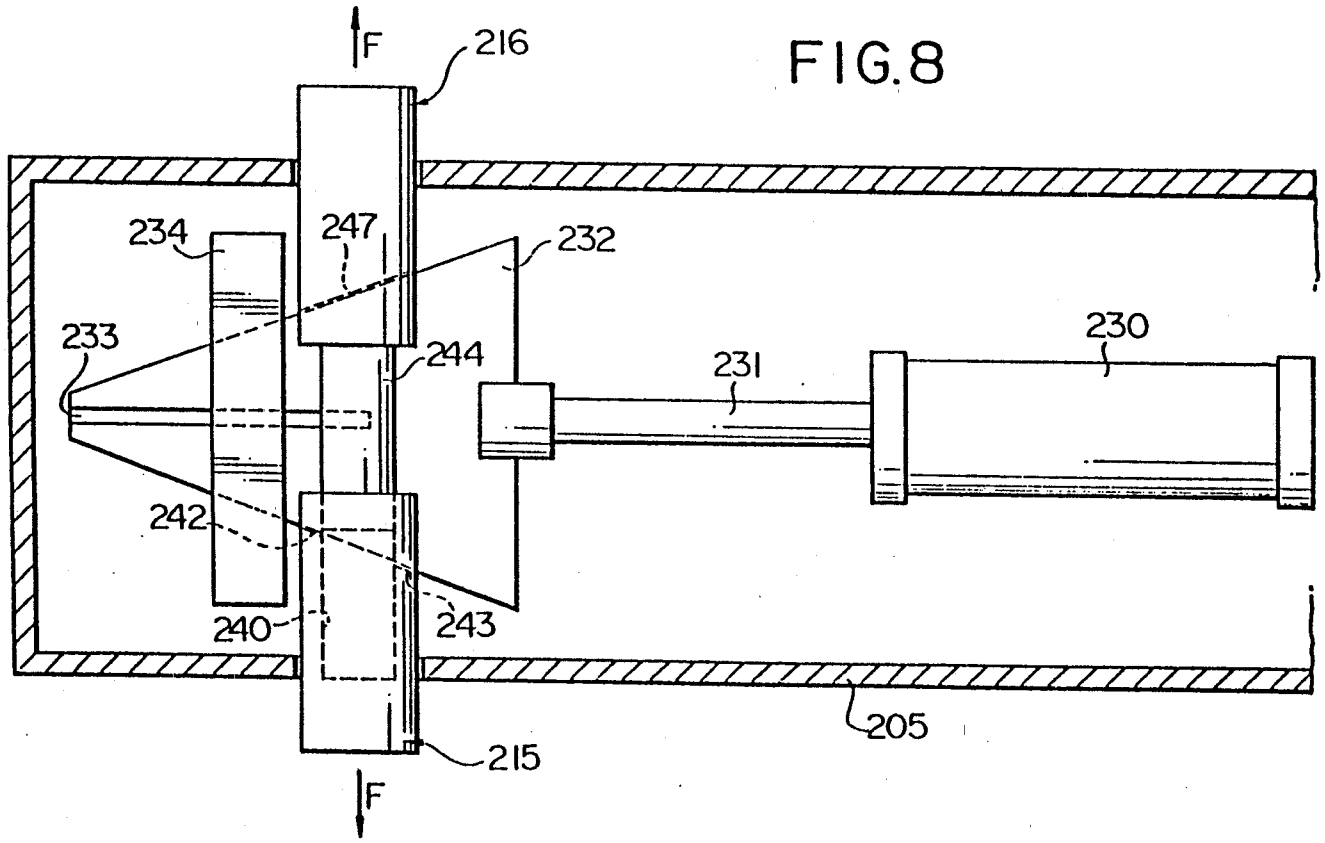
FIG. 8 is a cross sectional view of an arm having a mechanism to telescopically move pins, constituents of the detachable mechanism of the second embodiment.

A mechanism for controlling sliding of the pins 215 and 216 will be described with reference to FIGS. 8 and 9. The arm 205 has a hydraulic cylinder 230 accommodated therein in parallel with a longitudinal direction thereof. A cylinder rod 231 of the hydraulic cylinder 230 is directed toward the front of the arm 205. A tip end of the cylinder rod 231 is connected to a triangular operation plate 232 at a central bottom thereof. Two oblique sides of the operation plate 232 are determined to have a given angle relative to side surfaces of the arm 205. Guide grooves 233 are defined at upper and lower surfaces of the operation plate 232 extending from the tip end of the operation plate 232 toward the cylinder rod 231. Block-shaped guide bodies 234 and 235 are vertically fixed to the tip end of the arm 205 in parallel with each other. An interval between a lower surface of the guide body 234 and upper surface of the guide body 235 is set to be slightly greater than the thickness of the operation plate 232. Both guide bodies 234 and 235 have guide projections 236 and 237 protruding from the central portions thereof. The guide projections 236 and 237 engage in the guide grooves 233. The operation plate 232 is operated by the cylinder rod 231 when the guide projections 236 and 237 engage in the guide grooves 233 and the upper and lower surfaces of the operation plate 232 contact the inner surfaces of the guide bodies 234 and 235. The operation plate 232 is operated by the force of the cylinder rod 231 and operates solely in the longitudinal direction of the cylinder rod 231.

Shapes of the holding pins 215 and 216 are described hereafter. The holding pins 215 and 216 are cylindrical and have outer diameters less than inner diameter of pin holes 220 and 221. The holding pin 215 has a slide hole 240 defined inside thereof and coaxially therewith. An insertion grooves 241 having a rectangular shape in cross section is defined at an opening side of the slide hole 240 so as to cross at a right angle relative to an axial line of the slide hole 240. Aslant operation surfaces 242 and 243 are defined at an inner bottom surface of the insertion grooves 241. Inclined angles of the operation surfaces 242 and 243 conform to angles of inclination of the oblique sides relative to the bottom side.

The holding pin 216 has an outer diameter which is slightly less than inner diameter of the pin hole 221 and integrally formed. The holding pin 216 has insertion portions 244 and 245 having small outer diameter at the inner side of the arm 205 and is capable of insertion into the slide hole 240 of pin 215. A central portion of the insertion portions 244 and 245 define an insertion groove 246 formed by cutting thereof so as to cross at right angle with an axial line of the holding pin 216. The insertion groove 246 has an aslant operation surface 247 as a bottom surface thereof. Angles of inclination of the operation surface 247 conform to the angles of inclination of the oblique sides of the operation plate 232.

The holding pins 215 and 216 and the operation plate 232 are assembled in the following order.

Figure 9:
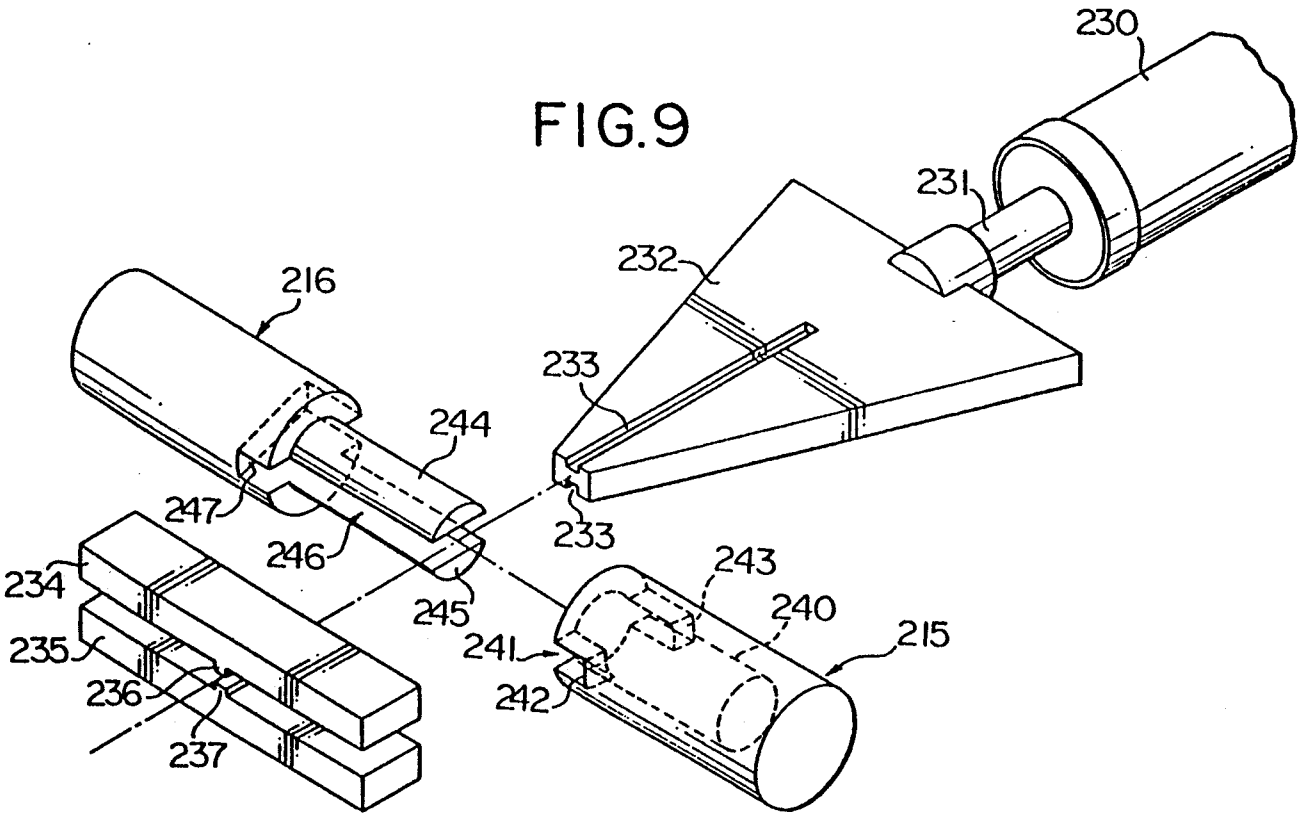
FIG. 9 is an exploded perspective view of the components in FIG. 8.

The cylinder rod 231 is first drawn toward the inside of the hydraulic cylinder 230 while the operation plate 232 is stopped at a position rearwardly away from the guide bodies 234 and 235 which is illustrated in FIG. 9. The holding pins 215 and 216 are respectively inserted into side openings of the arm 205 while the insertion portion 244 and 245 of the holding pin 216 are respectively inserted into the slide hole 240 of the holding pin 215. At this time, the insertion grooves 241 and 246 are positioned to be respectively flush with each other. When the insertion portions 244 and 245 are inserted into an innermost portion, both ends of the holding pins 215 and 216 do not protrude from the side openings of the arm 205 and the side surface of the arm 205 is flush with each head of the holding pins 215 and 216.

After the completion of disposition of the holding pins 215 and 216 inside the arm 205, the hydraulic cylinder 230 is operated to push the cylinder rod 231 so that the operation plate 232 passes the insertion grooves 241 and 246 and is inserted into a gap defined between the guide bodies 234 and 235. At this time, the guide projections 236 and 237 engage in the guide grooves 233 to restrain the operation plate 232 from swinging laterally when the operation plate 232 slides. When the cylinder rod 231 is further pushed out from the cylinder, the inclined surfaces of the operation plate 232 contact the operation surfaces 242, 243 and 247 so as to push the holding pins 215 and 216 outside thereof since the angles of inclination of the both sides of the operation plate 232 conform to the direction where the cylinder rod 231 is pushed out. Accordingly, both the holding pins 215 and 216 protrude from the side surfaces of the arm 205 and move in and away from the side openings of the arm 205.

The operation of the detachable mechanism according to the second embodiment of the present invention will be described with reference to FIGS. 10 (A) to 10 (C).

When the bucket 217 is connected to the arm 205, the cylinder rod 231 is drawn toward the hydraulic cylinder 230 while the heads of the holding pins 215 and 216 are pushed into the inside of the arm 205 from the side openings of the arm 205. Inasmuch as the holding pins 215 and 216 are respectively connected with each other by inserting the insertion portions 244 and 245 into the slide hole 240, both the holding pins 215 and 216 are pushed into the inner side while guided. For replacing the accessory with another accessory (the bucket in this case), it is necessary to carry out the operation mentioned just above for connecting the bucket 217 to the arm 205. FIG. 10 (A) shows a state where no accessory (the bucket in this case) for construction work is attached to the tip end of the arm 205. The operation to connect the bucket 217 to the arm 205 starts from the state as illustrated in FIG. 10 (A). Before the construction work starts, an entire length of the bucket cylinder 207 is maximized and the hooks 211 are directed forward as much as possible. At this state, the hydraulic cylinder 204 and 206 are operated to swing the boom 203 and the arm 205 vertically for permitting the hooks 211 to approach the holding pin 219 of the bucket 217. The holding pin 219 is guided to the hook surfaces 228 while contacting the guide surfaces 229 of the hooks 211 and caught by the hooks 211 with ease.

When the periphery of the holding pin 219 contacts the hook surfaces 228 of the hooks 211, the hydraulic cylinders 204 and 206 are operated to slightly incline the arm 205 which is illustrated in FIG. 10 (B).

Figure 10A:
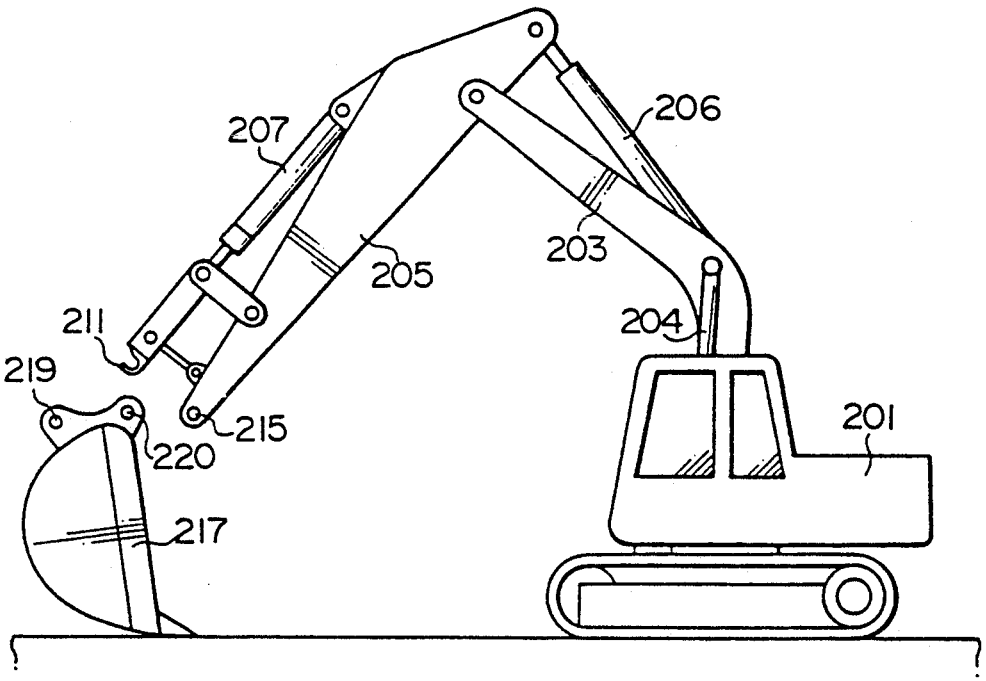
FIGS. 10(A) to 10(C) are views showing operations of the accessory detachable mechanism according to the second embodiment.
Figure 10B:
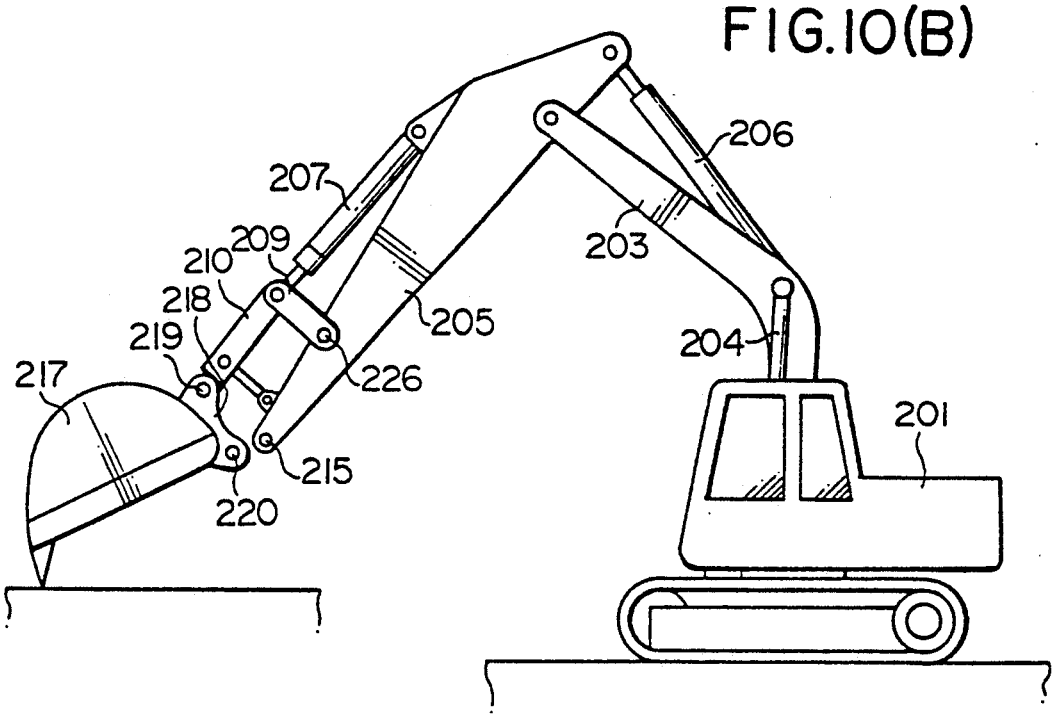
Figure 10C:
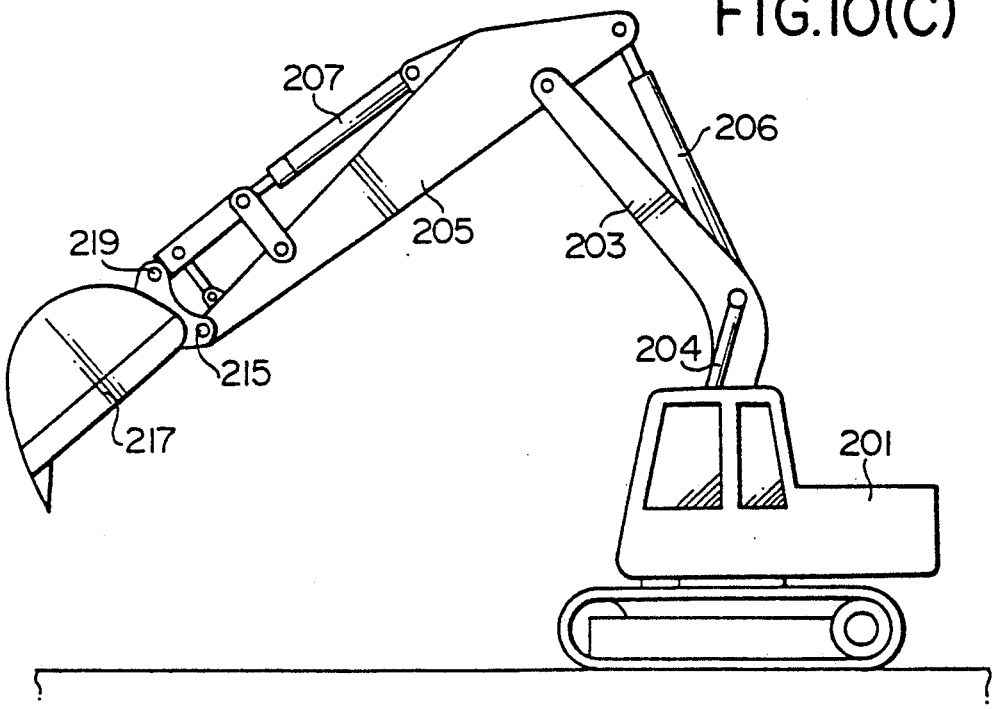

As illustrated in FIG. 10(B), the holding pin 219 is caught by the hooks 211 and the bucket 217 is hooked as it is. The bucket cylinder 207 is contracted at the state where the bucket 217 is hooked by the hooks 211. The rising links 209 are turned clockwise in FIG. 10(B) about the pin 226 so that the pawl holder 210 is pulled rightward. Accordingly, the hooks 211 and the bucket 217 are also pulled rightward so that the attached portion 218 of the bucket 217 is forced to approach toward the tip end of the arm 205. As a result, the tip end of the arm 205 is inserted into the attached portion 218 so that it is forced to move to the position where the central axes of the holding pins 215 and 216 align with the axes of the pin holes 220 and 221. The hydraulic cylinder 230 is operated to push the cylinder rod 231 at the state where the central axes of the holding pins 215 and 216 align with the axes of the pin holes 220 and 221. Consequently, the operation plate 232 is pushed out by the cylinder rod 231 and is moved toward the guide body 234. Inasmuch as the oblique sides of the operation plate 232 are inclined respectively and contact the operation surfaces 242, 243 and 247, the force applied thereto is resolved to push the operation surfaces 242, 243 and 247 outward. Accordingly, the holding pins 215 and 216 slide so as to protrude outward from the openings of the arm 205 as illustrated in the arrows F in FIG. 8. As a result, the holding pin 215 is inserted into the pin hole 220 while the holding pin 216 is inserted into the pin hole 221, whereby the bucket 217 is connected to the arm 205 so as to be turned as illustrated in FIG. 10(C). The construction machine can operate in the same way as the ordinary excavator. When the bucket 217 is removed from the tip end of the arm 205, the bucket 217 is placed on the ground and the hydraulic cylinder 230 is reversely operated so that the cylinder rod 231 is drawn into the hydraulic cylinder 230 whereby the operation plate 232 is detached from the operation surfaces 242, 243 and 247. Thereafter the holding pins 215 and 216 are manually pushed inside the arm 205 so that the holding pins 215 and 216 are removed from the pin holes 220 and 221. The succeeding operations are carried out in the sequence illustrated in FIGS. 10(C), 10(B) and 10(A).

The operator sitting on the driver's seat can operate to push out each of the holding pins 215 and 216. Accordingly, when various accessories are held by the arm 205, the operator sitting on the driver's seat can selectively attach such accessories to the arm 205.

Figure 11:
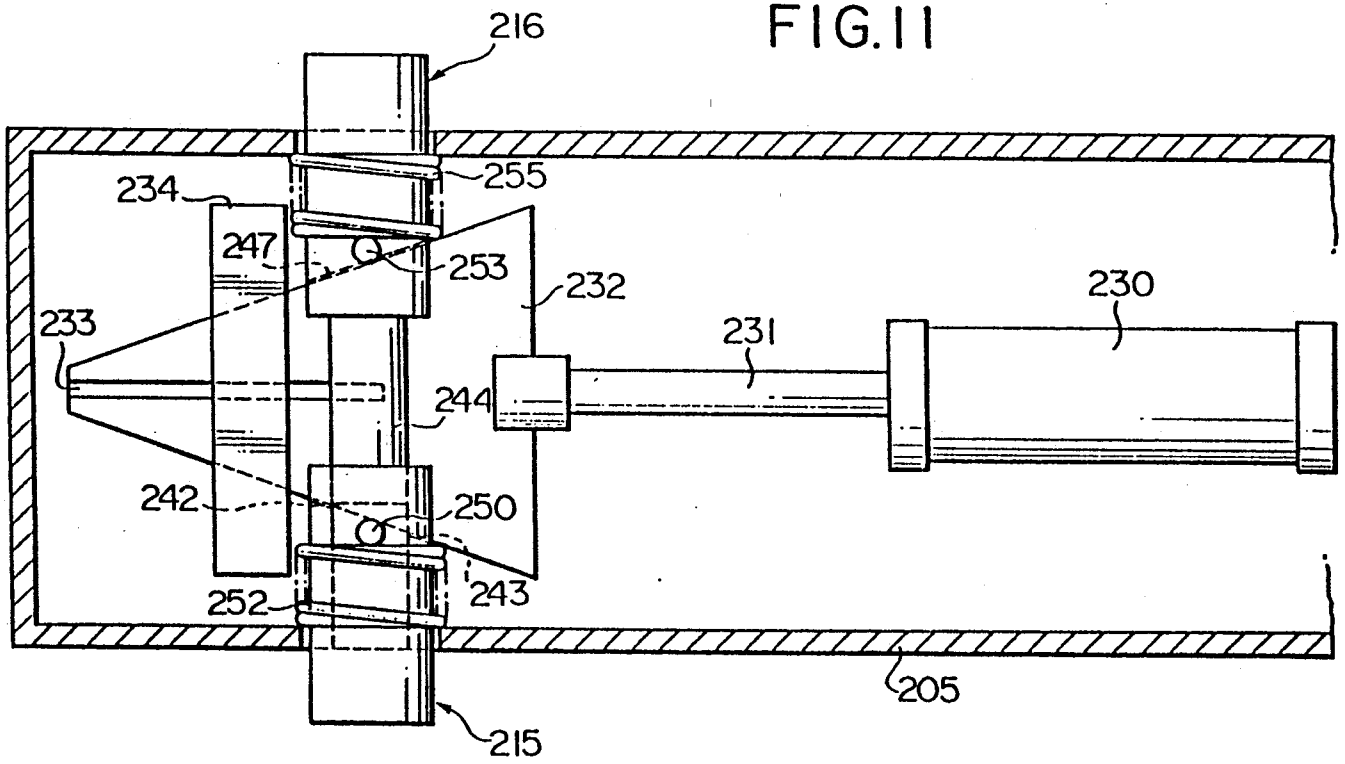
FIG. 11 is a cross sectional view of an arm having a mechanism to telescopically move pins, constituents of the detachable mechanism according to a modification of the second embodiment.
Figure 12:
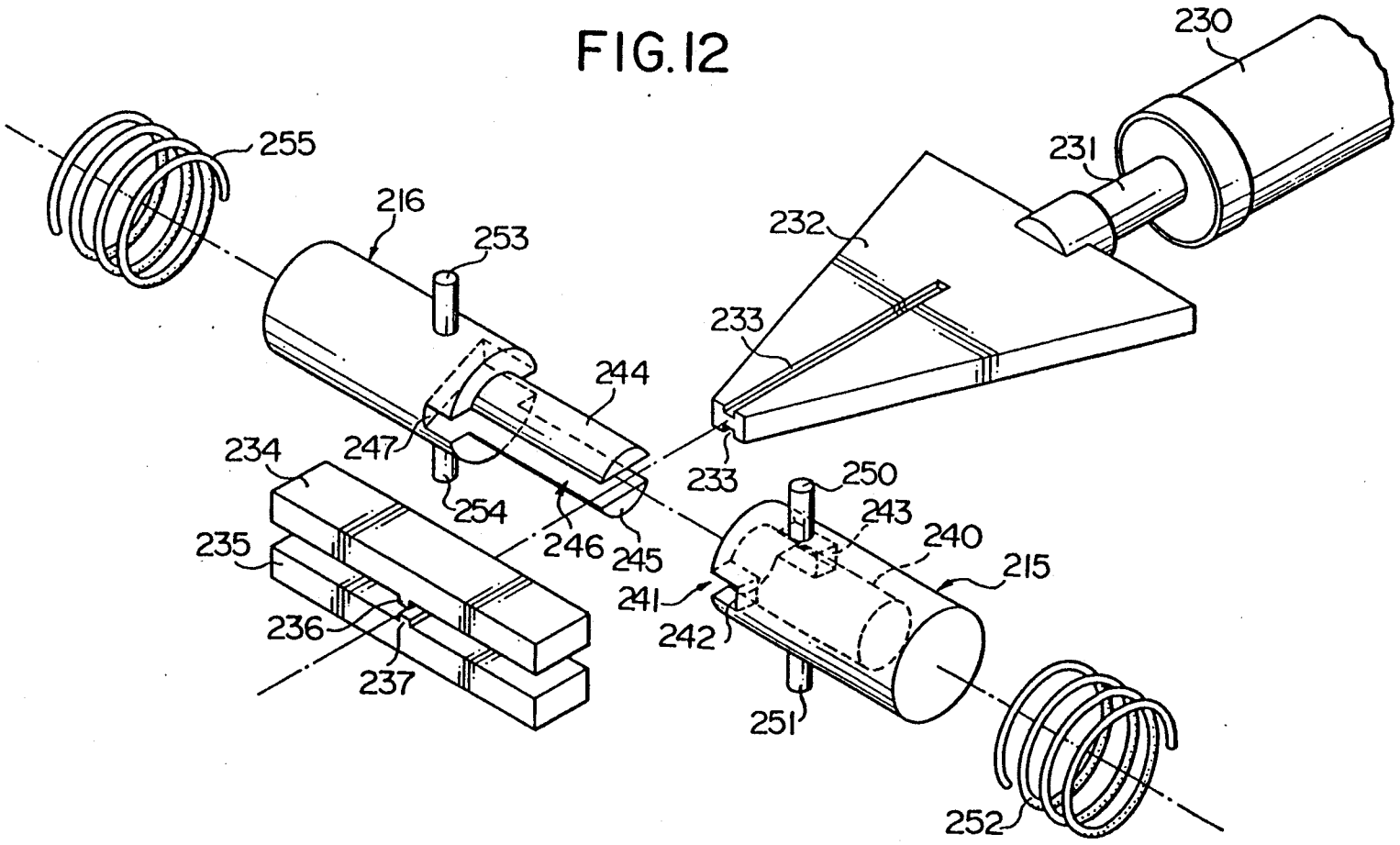
FIG. 12 is an exploded perspective view of the components in FIG. 11.

First Modification of Second Embodiment (FIGS. 11 and 12)

An accessory detachable mechanism according to a first modification of the second embodiment will be described with reference to FIGS. 11 to 12. Components same as those in the second embodiment are denoted by the same numerals and an explanation thereof is omitted.

The holding pin 215 has stop pins 250 and 251 vertically protruding therefrom and positioned inside the arm 205. A coil spring 252 is interposed between the stop pins 250 and 251 and the inner wall of the arm 205 and wound around the holding pin 215.

The holding pin 216 has stop pins 253 and 254 vertically protruding therefrom and positioned inside the arm 205. A coil spring 255 is interposed between the stop pins 250 and 251 and the inner wall of the arm 205 and wound around the holding pin 216.

The stop pins 250 and 251 are always biased by the coil springs 252 and 255 towards the center of the arm 205. Accordingly, when the hydraulic cylinder 230 is operated to push out the cylinder rod 231, the oblique sides of the operation plate 232 contact the operation surfaces 242, 243 and 247 so that the holding pins 215 and 216 protrude from the side openings of the arm 205 while the coil springs 252 and 253 are compressed.

However, if the cylinder rod 231 is contracted to thereby move the operation plate 232 rightward in FIG. 11, the holding pins 215 and 216 are drawn inside the arm 205 by resilient force of the coil springs 252 and 255.

The holding pins 215 and 216 can be moved in or moved out from the side openings of the arm 205 by operating the hydraulic cylinder 230. Accordingly, when the bucket 217 is attached to the tip end of the arm 205, the hydraulic cylinder 230 is operated to telescopically move the cylinder rod 231 so that the holding pins 215 and 216 can be inserted into or released from the pin holes 220 and 221.

Figure 13:
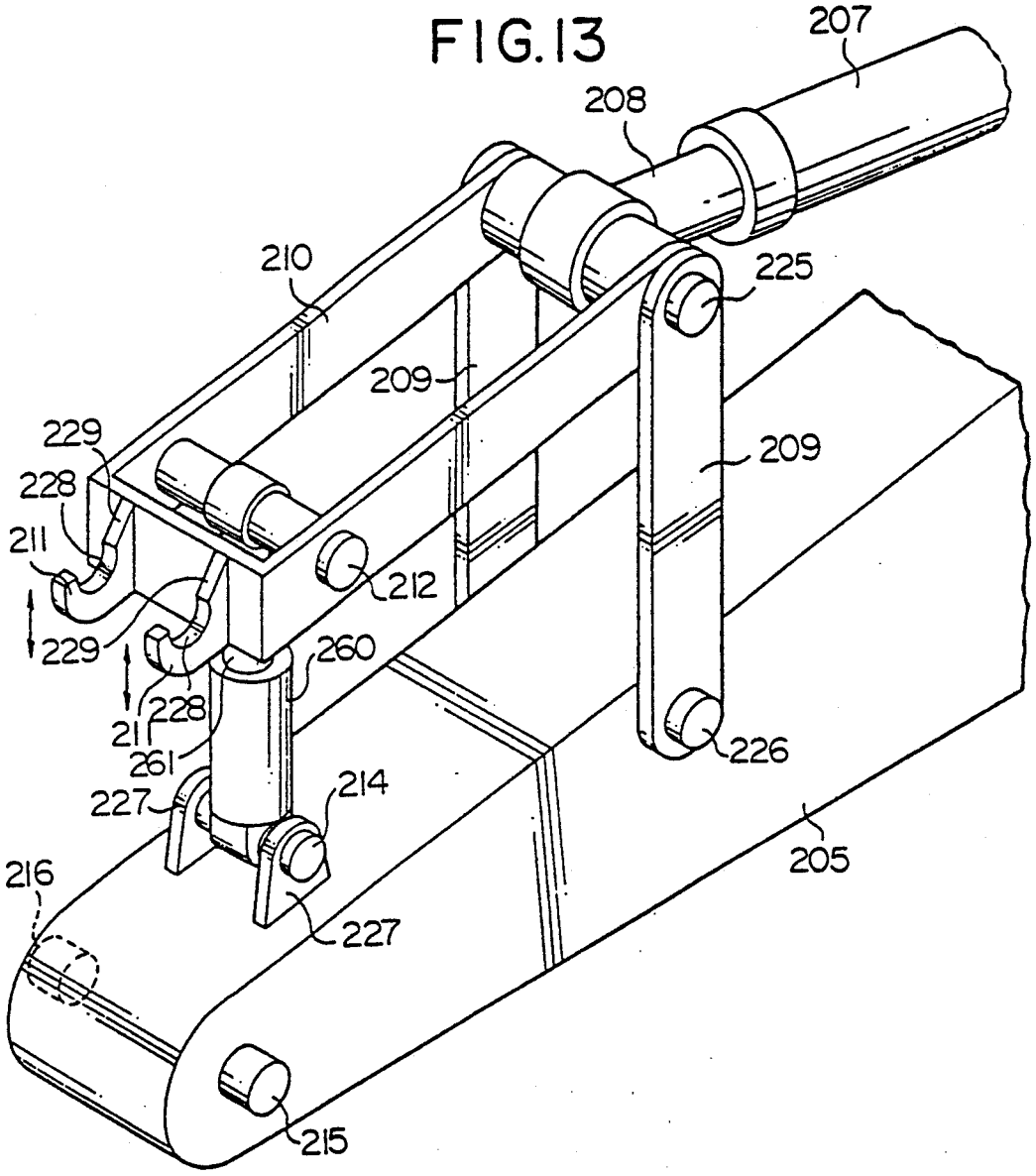
FIG. 13 is an enlarged perspective view of a portion adjacent to the tip end of the arm according to the second modification of the second embodiment.
Figure 14:
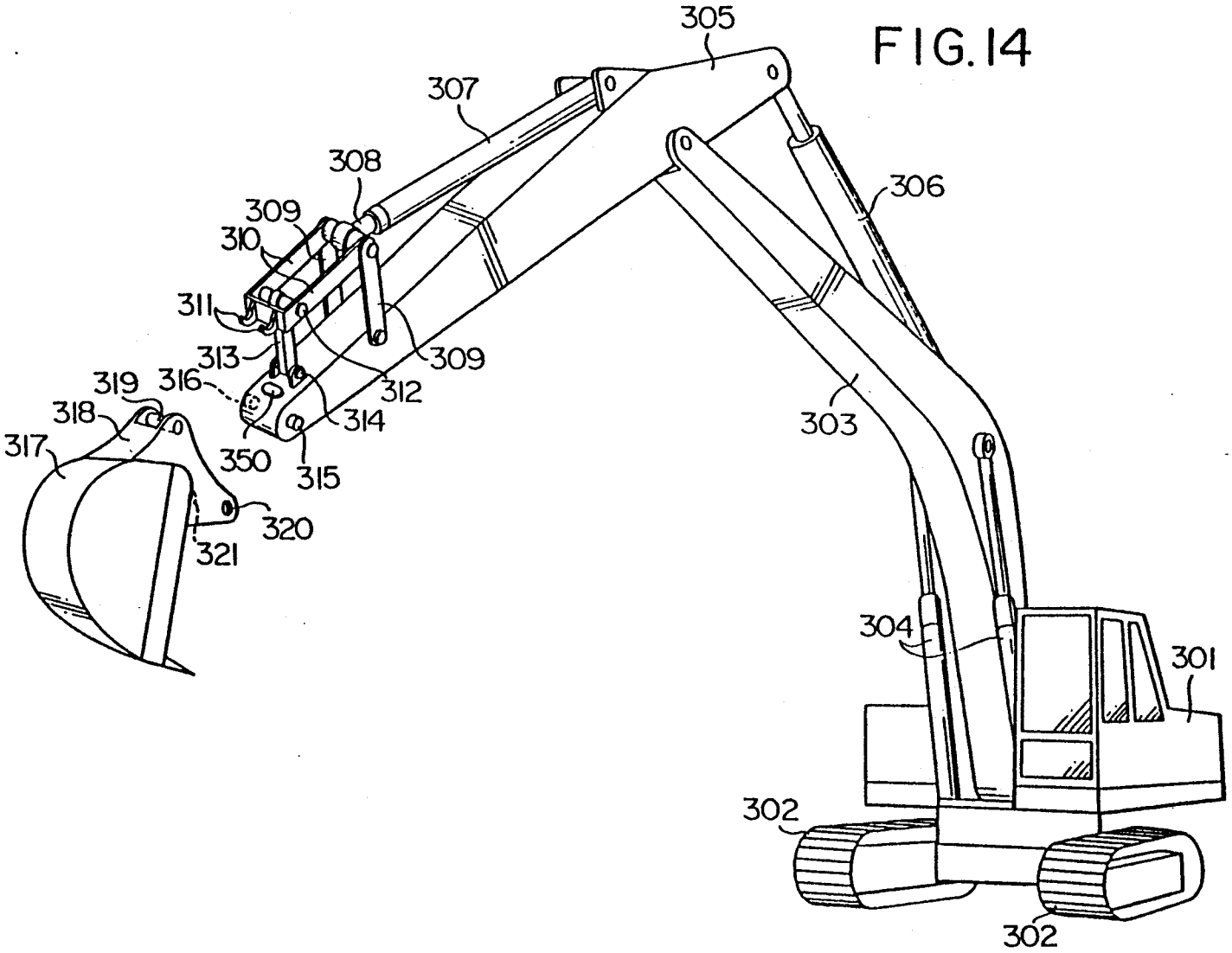
FIG. 14 is a perspective view of an excavator employing the accessory detachable mechanism according to a third embodiment of the present invention.

Second Modification of Second Embodiment (FIG. 13)

An accessory detachable mechanism according to a second modification of the second embodiment will be described with reference to FIG. 13. Components the same as those in the second embodiment are denoted at the same numerals and an explanation thereof is omitted.

A hydraulic cylinder 260 has a base inserted between the pair of holding plates 227 which are attached to the upper surface of the tip end of the arm 205 while the base of the hydraulic cylinder 260 is pivotally connected to the pair of holding plates 227 by the pin 214. A cylinder rod 261 of the hydraulic cylinder 260 is directed upward and connected to the pin 212 at the upper end thereof.

When the hydraulic cylinder 260 is operated, the cylinder rod 261 is telescopically moved. As a result, one side of a link of the parallelogram formed by the rising links 209 and pawl holder 210 is telescopically moved so that the position of the hooks 211 can be vertically varied relative to the holding pins 215 and 216.

When an interval between the holding pin 219 of the attached body 218 provided at the bucket 217 and the pin holes 220 and 221 is different, the hydraulic cylinder 260 is operated to thereby vary the interval between the hooks 211 and the holding pins 215–216 for adjusting them to the interval between the holding pin 219 and the pin holes 220–221. Accordingly, even if the bucket or other accessories have a different spacing between the holding pin 219 and the pin holes 220–221, the holding pins 215 and 216 can be inserted into the pin holes 220 and 221 with assurance.

With the simple arrangement of the detachable mechanisms according to the second embodiment and the modifications thereof, various accessories can be connected to the tip end of the conventional excavator. If the holding pin and the pin holes are provided on the accessories, the holding pin 215–216 of the arm can be freely inserted into the pin holes.

Inasmuch as the accessory can be connected to the tip end of the arm by the holding pins, the force of connection between the accessory and the arm is strong. Furthermore, the accessory can be turned so that the construction machine having the accessory connected thereto can be operated in the same manner as the conventional excavator. Still furthermore, the accessory can be connected to the arm while the operator sits on the driver's seat so that ground operators are not necessitated and the time involved in the attaching work can be reduced.

Third Embodiment (FIGS. 14 to 19)

A detachable mechanism according to a third embodiment of the present invention will be described with reference to FIGS. 14 to 19. The same numerals, increased by 100, are used to designate corresponding parts of the second embodiment.

This arrangement of the detachable mechanism is substantially the same as that of the second embodiment. The detachable mechanism includes a pair of rising links 309 pivotally attached to both sides of the tip end of a cylinder rod 308 of a bucket cylinder 307. The rising links 309 at lower ends thereof are pivotally connected to both sides of a portion adjacent to the tip end of an arm 305.

A pair of substantially pawl holder 310 are pivotally connected to the tip end of the cylinder rod 308 and have hooks 311 at the tip ends thereof. The hooks 311 have the configuration of pawls which are directed upward. A supporting link 313 has an upper end connected between pawl holders 310 at the front portion thereof and has a lower end connected to an upper surface of the tip end of the arm 305 by way of pins 314. The rising links 309, pawl holders 310, supporting links 313 and the arm 305 form a substantially parallelogram linkage. Holding pins 315 and 316 are provided at the tip end of the arm 305 and telescopically movable at both sides of the tip end of the arm 305.

Figure 15:
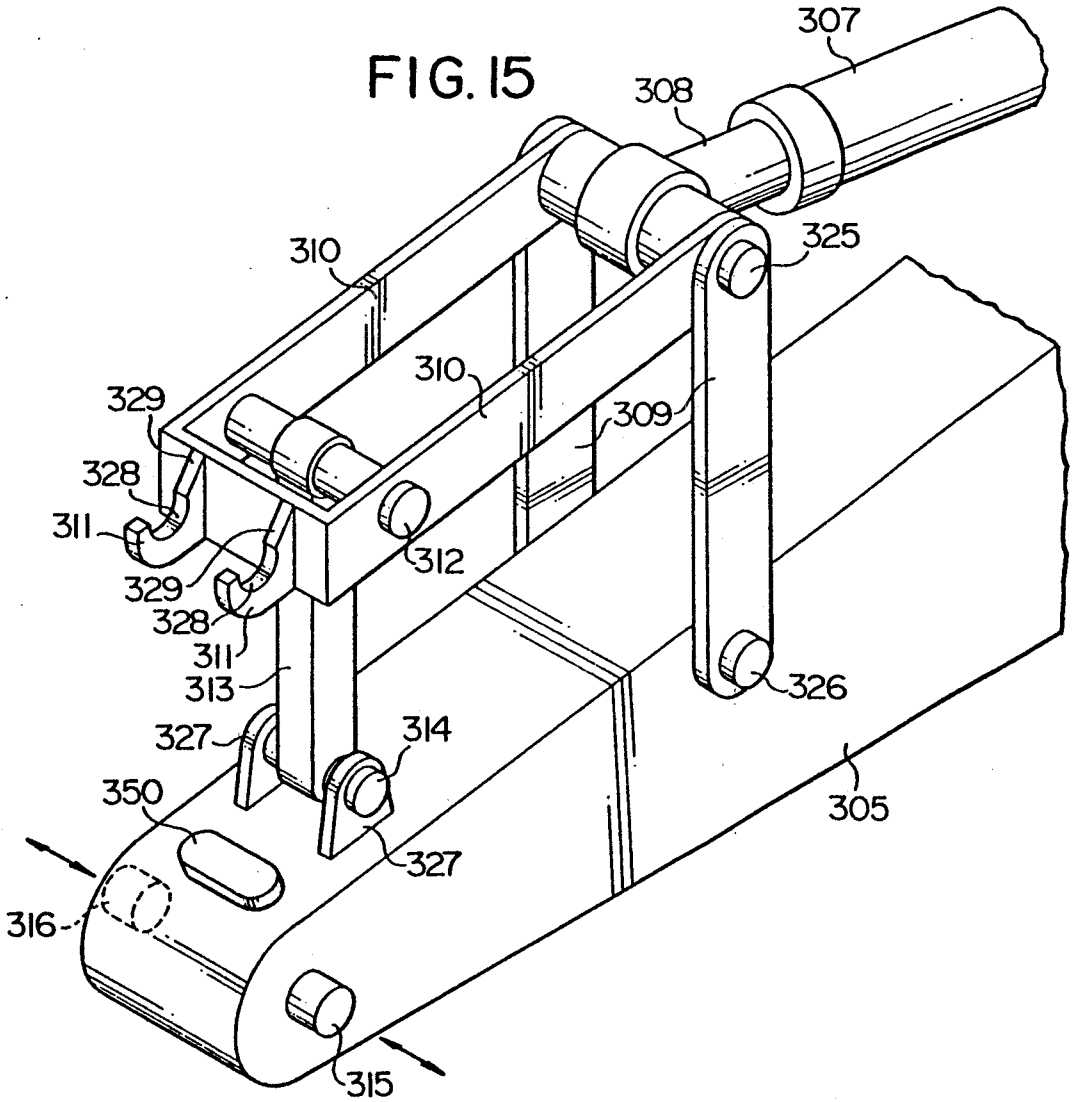
FIG. 15 is an enlarged view of the accessory detachable mechanism in FIG. 14.

The accessory detachable mechanism will be described more in detail with reference to FIG. 15.

A pin 325 penetrates the tip end of the cylinder rod 308 and has both sides into which both ends of the pawl holders 310 are inserted. Upper ends of the rising links 309 are connected to right and left outer sides of the pawl holders 310. The rising links 309 are connected to both sides of the arm 305 at lower ends thereof by pins 226 so as to be turnable.

The pawl holders 310 are integrally formed in U-shape by bending a steel plate and comprises a front closed piece and two pieces extending from the front closed piece. A pin 312 is disposed and pivotally supported by the two pieces of the pawl holder 310 at the portion adjacent to the front closed piece. The upper end of the supporting link 313 is connected to the center of the pin 312. A pair of supporting pieces 327 protrudes from the upper surface adjacent to the tip end of the arm 305. The lower end of the supporting link 313 is inserted between the pair of supporting pieces 327 and connected thereto by the pin 314.

The pair of hooks 311 are fixed to the front of the pawl holder 310 by welding or the like and formed by cutting out a steel plate. A recessed hook surface 328 of semi-circular shape is directed upward at the central portion of each hook 311. The hooks 311 have aslant guide surfaces 329 extending from the hook surfaces 328 and terminating in the front closed piece of the pawl holder 310. An inspection cover 350 is provided at the upper surface of the tip end of the arm 305 for regularly inspecting and maintaining the holding pins 315 and 316.

Figure 16:
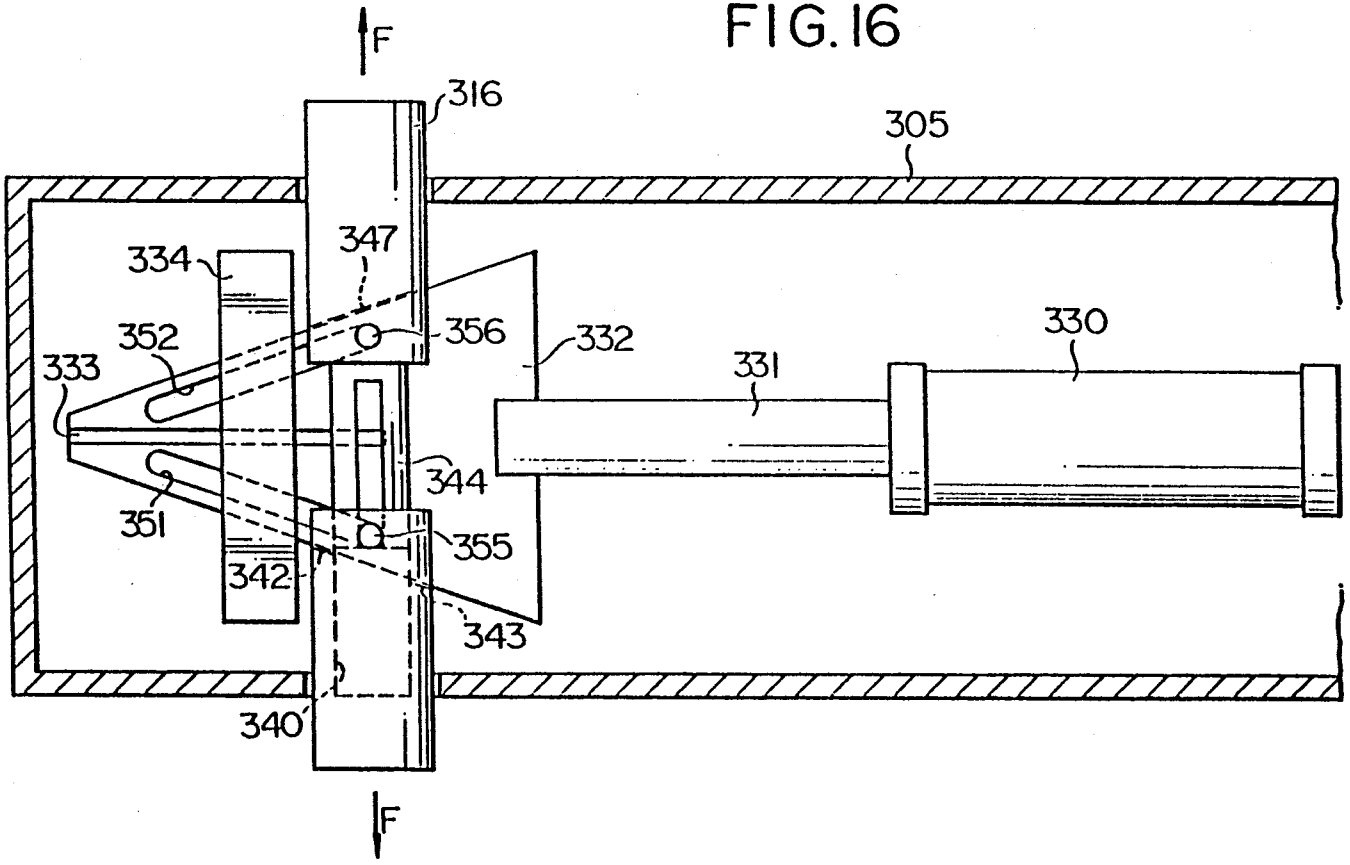
FIG. 16 is a cross sectional view of an arm having a mechanism to telescopically move pins, constituents of the detachable mechanism of the third embodiment.

A mechanism for controlling sliding of pins 315 and 316 will be described with reference to FIGS. 16 and 17. The arm 305 has a hydraulic cylinder 330 accommodated therein in parallel with a longitudinal direction thereof. A cylinder rod 331 of the hydraulic cylinder 330 is directed forward of the arm 305. A tip end of the cylinder rod 331 is connected to a triangular operation plate 332 at a central bottom thereof. Two oblique sides of the operation plate 332 have a given angle relative to side surfaces of the arm 305. A guide groove 333 is defined at upper and lower surfaces of the operation plate 332 extending from the tip end of the operation plate 332 toward the cylinder rod 331. Guide slits 351 and 352 are defined at the portion adjacent to the oblique sides of the operation plate 332 in parallel with the oblique sides thereof by penetrating the operation plate 332.

Block-shaped guide bodies 334 and 335 are vertically fixed to the tip end of the arm 305 in parallel with each other. An interval between a lower surface of the guide body 334 and an upper surface of the guide body 335 is set to be slightly greater than the thickness of the operation plate 232. Both the guide bodies 334 and 335 have guide projections 336 and 337 protruding from the central portions thereof. The guide projections 336 and 337 engage in guide grooves 333. The operation plate 332 is operated by the cylinder rod 331 when the guide projections 336 and 337 engage in the guide grooves 333 and the upper and lower surfaces of the operation plate 332 contact the inner surfaces of the guide bodies 334 and 335. The operation plate 332 operates solely in the longitudinal direction of the cylinder rod 331.

The holding pins 315 and 316 are cylindrical and have outer diameters less than inner diameters of pin holes 320 and 321 on the bucket. The holding pin 315 has a slide hole 340 defined inside and coaxially therewith. An insertion groove 341 having a rectangular shape in cross section is defined at one end of the holding pin 315 and at the open end of the slide hole 340 so as to cross at a right angle relative to an axis of the slide hole 340. Aslant operation surfaces 342 and 343 define inner bottom surfaces of the insertion groove 341. Inclined angles of the operation surfaces 342 and 343 conform to angles of inclination of the oblique sides of plate 332. A pin hole 353 is defined at the peripheral upper surface of the slide hole 340 of the holding pin 315. A pin 355 passed through the slit 351 is fixed in the pin hole 353.

The holding pin 316 has an integral portion having an outer diameter which is slightly less than inner diameter of the pin hole 321. The holding pin 316 has insertion portions 344 and 345 having small outer diameter at the inner side of the arm 305 and is capable of inserting into the slide hole 340. A central portion of the insertion portions 344 and 345 have an insertion groove 346 formed by cutting thereof so as to cross at right angle with an axial line of the holding pin 316. The insertion groove 346 has an aslant operation surface 347 at a bottom surface thereof. Angles of inclination of the operation surface 347 conform to the angles of inclination of the oblique sides of the operation plate 332. A pin hole 354 is formed in an upper surface of the holding pin 316 at a peripheral central portion thereof and an operation pin 356 passed through the guide slit 352 is fixed to the pin hole 354.

The holding pins 315 and 316 and the operation plate 332 are assembled in the following sequence. In assembling the holding pins 315 and 316 and the operation plate 332, the inspecting cover 350 is removed from the arm 305 so that an inspecting hole 360 is open.

Figure 17:
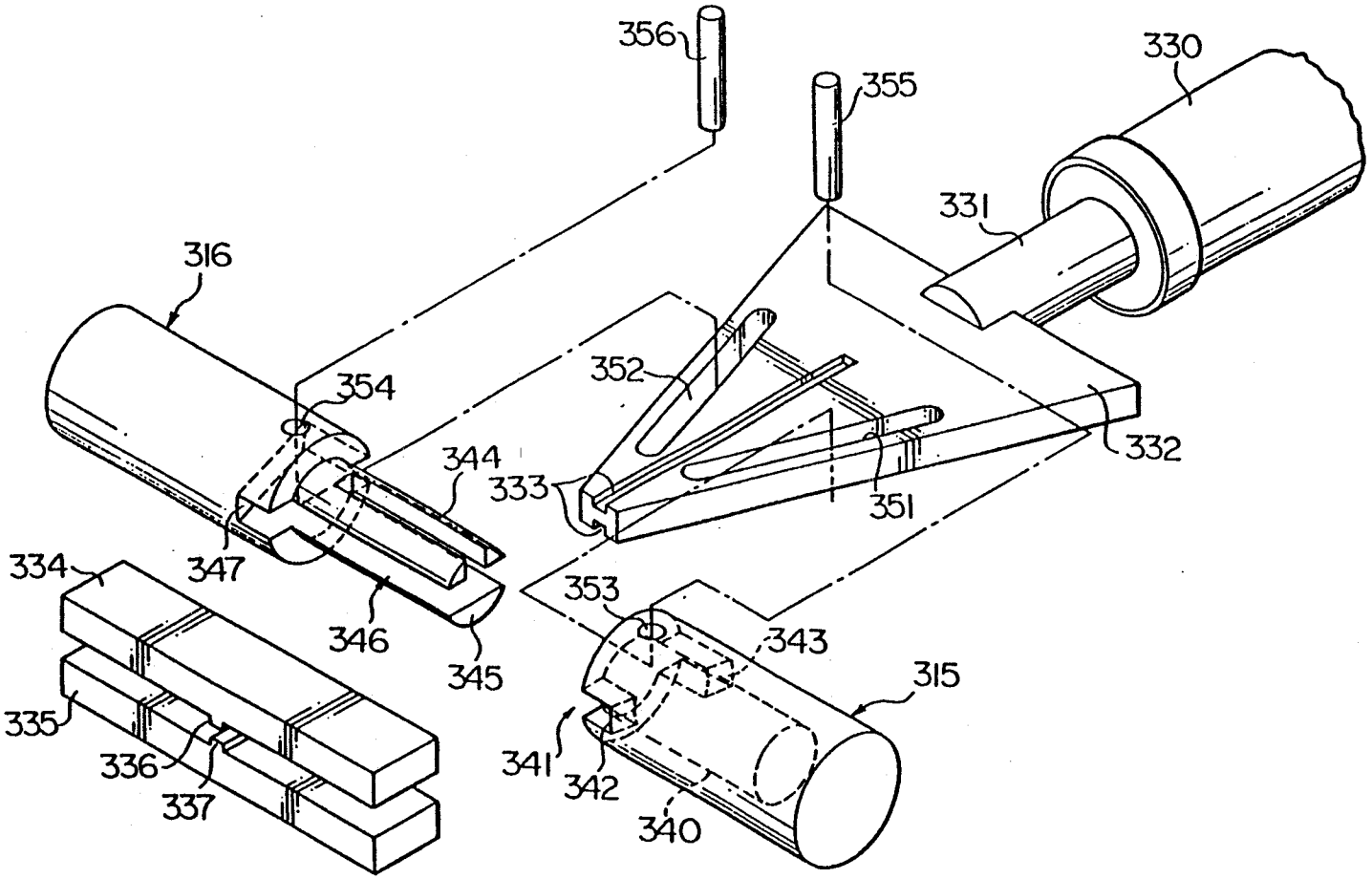
FIG. 17 is an exploded perspective view of the components in FIG. 16.
Figure 18:
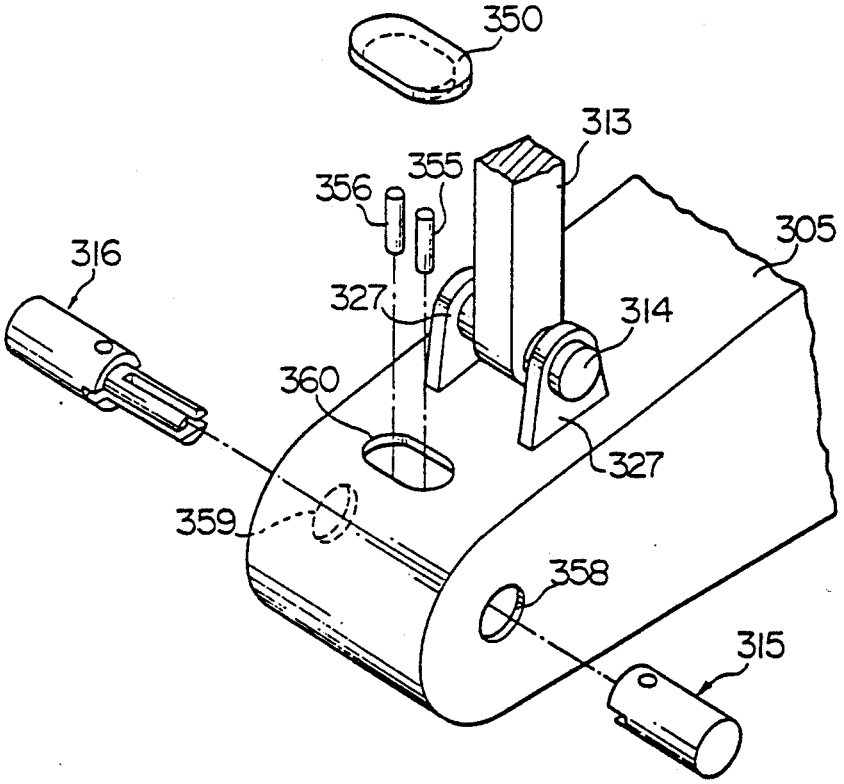
FIG. 18 shows a sequence for assembly of the holding pins.

The cylinder rod 331 is first drawn inside of the hydraulic cylinder 330 so that the operation plate 332 is stopped at the position away from the guide bodies 334 and 335 as illustrated in FIG. 17. The holding pins 315 and 316 are respectively inserted into side openings of the arm 305 while the insertion portions 344 and 345 of the holding pin 316 are respectively inserted into the slide hole 340 of the holding pin 315. At this time, the insertion grooves 341 and 346 are positioned to be respectively flush with each other. When the insertion portions 344 and 345 are inserted into an innermost portion of the slide hole 340, both ends of the holding pins 315 and 316 do not protrude from the side openings of the arm 305 and the side surface of the arm 305 is flush with each head of the holding pins 315 and 316.

After the completion of disposition of the holding pins 315 and 316 inside the arm 305, the hydraulic cylinder 330 is operated to push the cylinder rod 331 so that the operation plate 332 passes the insertion grooves 341 and 346 and is inserted into a gap defined between the guide bodies 334 and 335. At this time, the guide projections 336 and 337 engage in the guide grooves 333 to restrain the operation plate 332 from swinging laterally when the operation plate 332 slides. The tip end of the operation plate 332 is inserted into the gap defined between the guide bodies 334 and 335. When both oblique surfaces of the operation plate contact the operation surfaces 342, 343 and 347, the operation of the hydraulic cylinder 330 is temporarily stopped. Thereafter, the operation pins 355 and 356 are inserted from the inspection hole 360. The operation pin 355 is passed through the pin hole 353 and then passed through the guide slit 351 while the operation pin 356 is passed through the pin hole 354 and then passed through the guide slit 352. Accordingly, both the holding pins 315 and 316 and the operation plate 332 are connected to each other by the operation pins 355 and 356. After the completion of the assembly of these components, the inspection hole 360 is covered by the inspection cover 350.

An operation of the detachable mechanism according to the third embodiment of the present invention will be described with reference to FIGS. 19(A) to 19(C).

When the bucket 317 is connected to the arm 305, the cylinder 331 is drawn into the hydraulic cylinder 330 so that the guide slits 351 and 352 draw the operation pins 355 and 356 toward the center of the arm 305 while the heads of the holding pins 315 and 316 are pushed inside the arm 305 from the side openings thereof. Inasmuch as the holding pins 315 and 316 are respectively connected with each other by inserting the insertion portions 344 and 345 into the slide hole 340, both of the holding pins 315 and 316 are pushed into the inner side while guided. For replacing the accessory with another accessory (the bucket in this case), it is necessary to carry out the operation mentioned just above for connecting the bucket 317 to the arm 305. FIG. 19(A) shows a state where no accessory (the bucket in this case) is attached to the tip end of the arm 305.

Figure 19A:
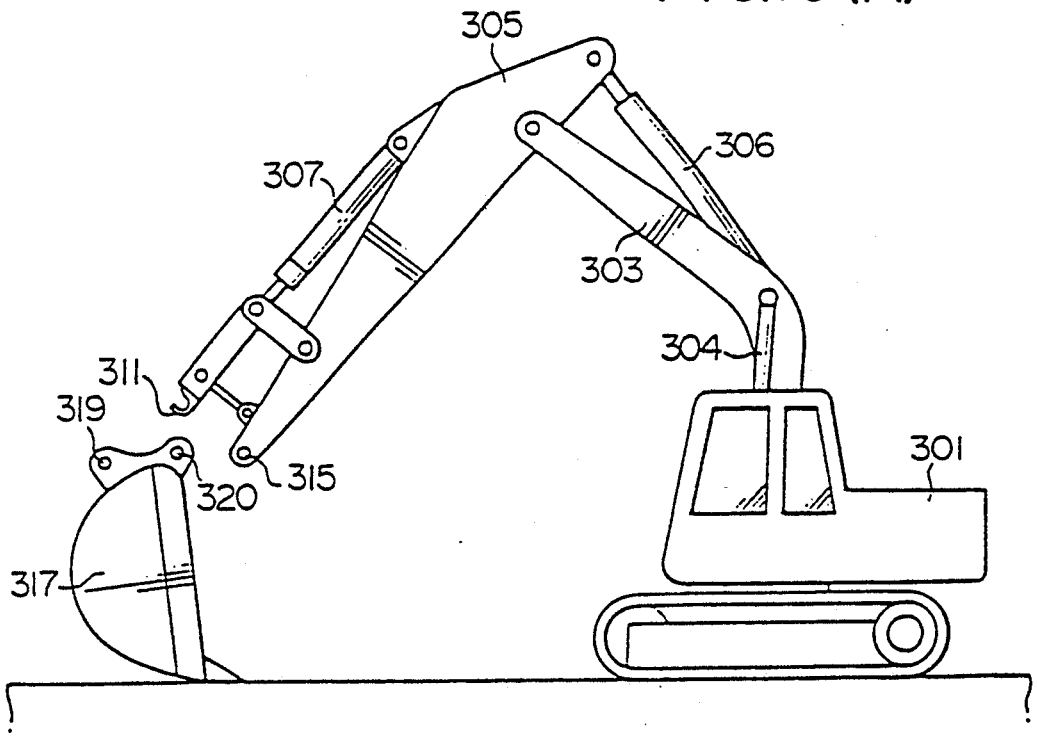
FIG. 19(A) to 19(C) are views showing operations of the accessory detachable mechanism according to the third embodiment.

The operation to connect the bucket 317 to the arm 305 starts from the state illustrated in FIG. 19(A). Initially the length of the bucket cylinder 307 is maximized and the hooks 311 are directed forward as much as possible. In this state, the hydraulic cylinder 304 and 306 are operated to swing the boom 303 and the arm 305 vertically for permitting the hooks 311 to approach the holding pin 319 of the bucket 317. The holding pin 319 is guided to the hook surfaces 328 by contacting the guide surfaces 329 of the hooks 311 and is caught by the hooks 311 with ease.

Figure 19B:
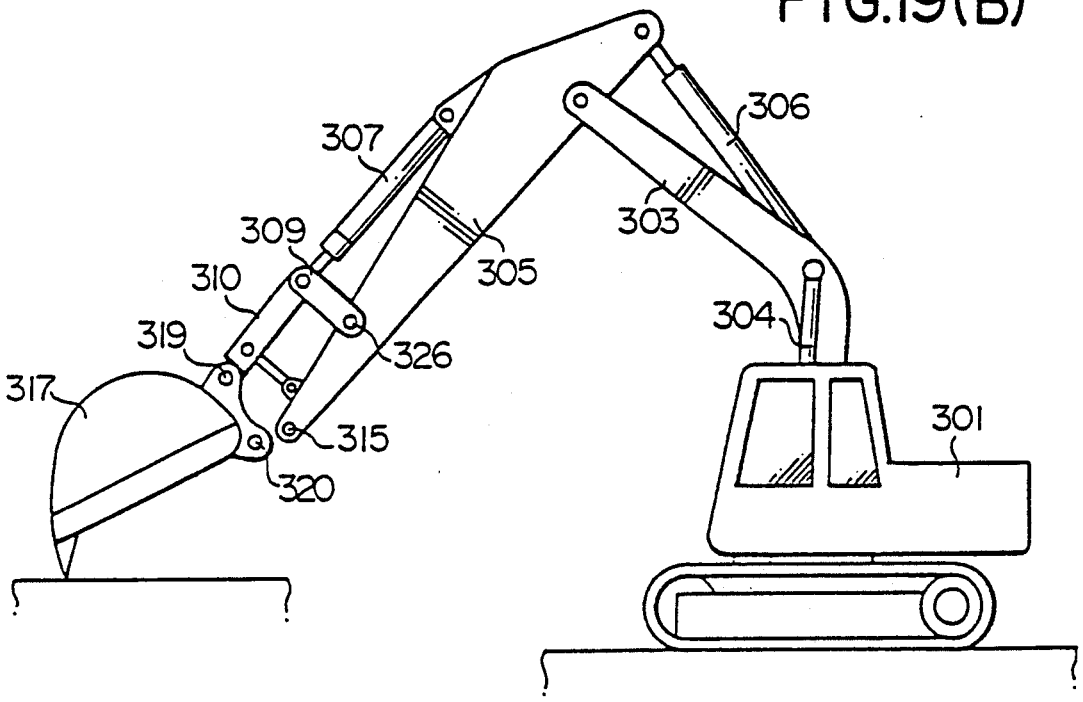

When the periphery of the holding pin 319 contacts the hook surfaces 328 of the hooks 311, the hydraulic cylinders 304 and 306 are operated to slightly incline the arm 305 as illustrated in FIG. 19(B).

As illustrated in FIG. 19(B), the holding pin 319 is caught by the hooks 311 and the bucket 317 is hooked. The bucket cylinder 307 is contracted at the state where the bucket 317 is hooked by the hooks 311. The rising links 309 turned clockwise in FIG. 19(B) about the pin 326 so that the pawl holder 310 is pulled rightward. Accordingly, the hooks 311 and the bucket 317 are also pulled rightward so that the attached portion 318 of the bucket 317 is forced to approach toward the tip end of the arm 305. As a result, the tip end of the arm 305 is inserted into the attached portion 318 so that it is moved to a position where the central axes of the holding pins 315 and 316 align with the axes of the pin holes 320 and 321. Consequently, the operation plate 332 is pushed out by the cylinder rod 331 and is moved toward guide bodies 334 and 335. Since the operation pins 355 and 356 pass through both the guide slits 351 and 352 defined in the operation plate, the aslant guide slits 351 and 352 push the operation pins 355 and 356, thereby pushing the holding pins 315 and 316 leftward and rightward. Accordingly, the holding pins 315 and 316 slide so as to protrude from the openings outward as illustrated by arrows F in FIG. 16. As a result, the holding pin 315 is inserted into the pin hole 320 while the holding pin 316 is inserted into the pin hole 321, whereby the bucket 317 is connected to the arm 305 so as to be turned as illustrated in FIG. 19(C). The construction machine can then operate in the same way as the ordinary excavator.

When the bucket 317 is removed from the tip end of the arm 305, the bucket 317 is placed on the ground and the hydraulic cylinder 330 is reversely operated so that the cylinder rod 331 is drawn into the hydraulic cylinder 330. Since the operation plate is moved by the cylinder rod 331 to thereby reduce the interval between the guide slits 351 and 352, both the operation pins 355 and 356 are drawn toward the center of the arm 305. As a result, both the holding pins 315 and 316 are accommodated inside the side openings 358 and 359 of the arm 305 to thereby disconnect the holding pins 315 and 316 from the pin holes 310 and 321.

Figure 19C:
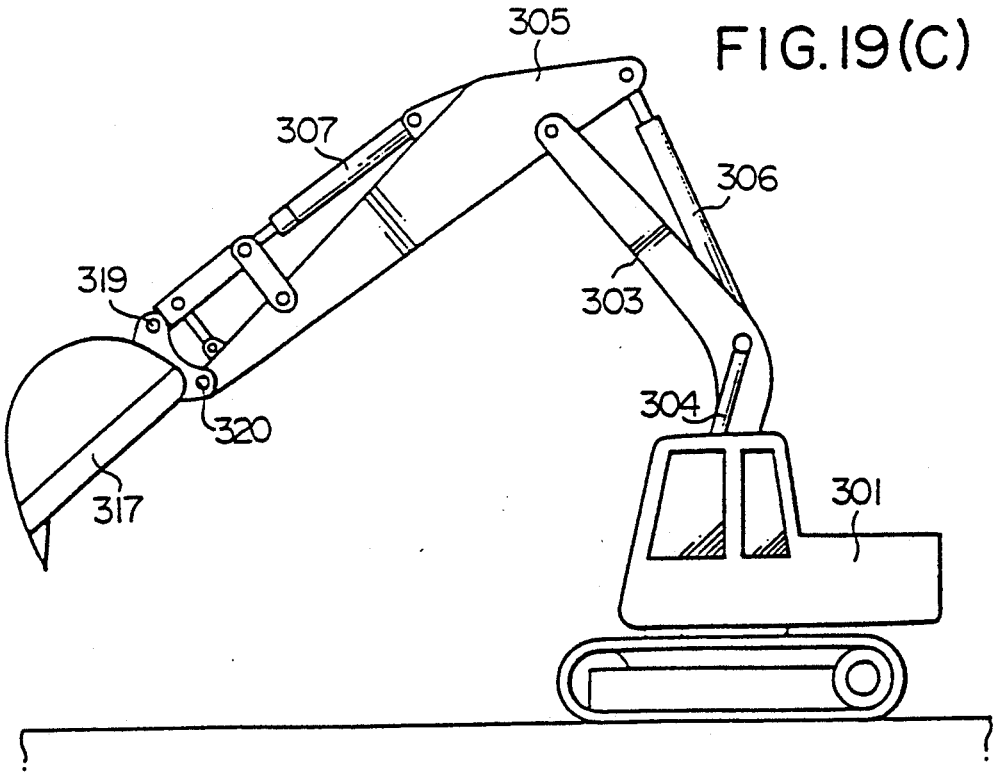

The succeeding operations are carried out in the sequence as illustrated in FIGS. 19(C), 19(B) and 19(A).

The operator sitting on the driver's seat can operate to push out each of the holding pins 315 and 316. Accordingly, when various accessories are held by the arm 305, the operator sitting on the driver's seat can selectively attach such accessories to the arm 305.

Figure 20:
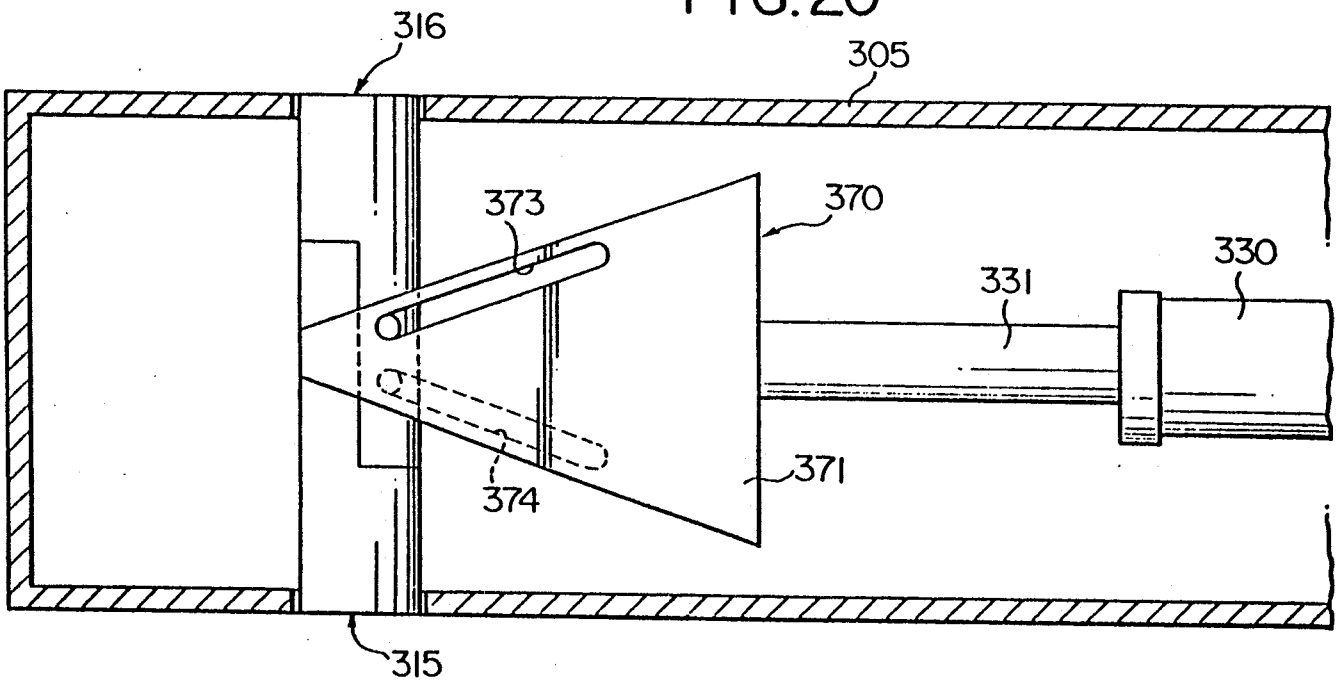
FIG. 20 is a cross sectional view of an arm having a mechanism to telescopically move pins, constituents of the detachable mechanism according to a modification of the third embodiment.
Figure 21:
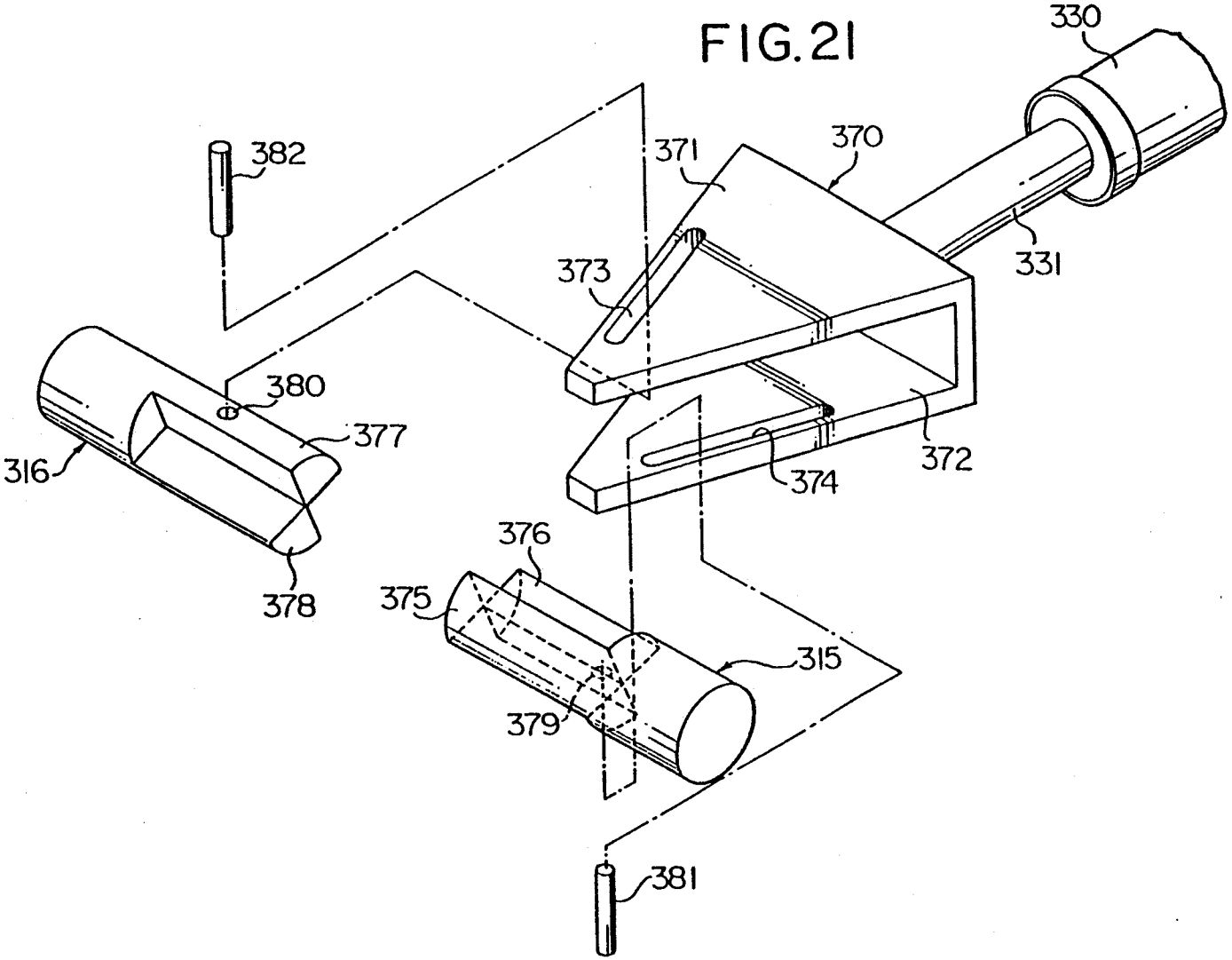
FIG. 21 is an exploded perspective view of the main components in FIG. 20.
Figure 22:
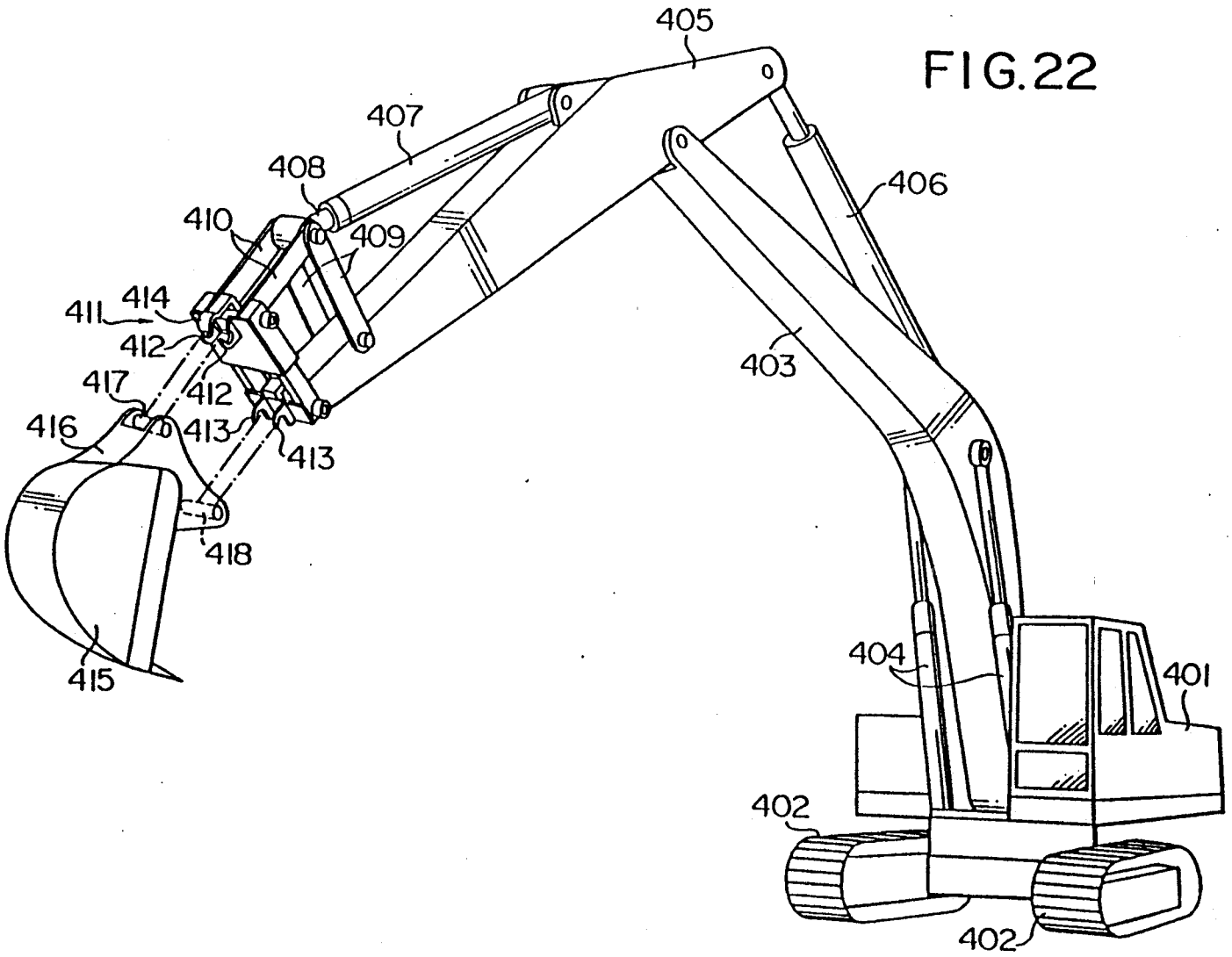
FIG. 22 is a perspective view of an excavator employing an accessory detachable mechanism according to a fourth embodiment of the present invention.
Figure 23:
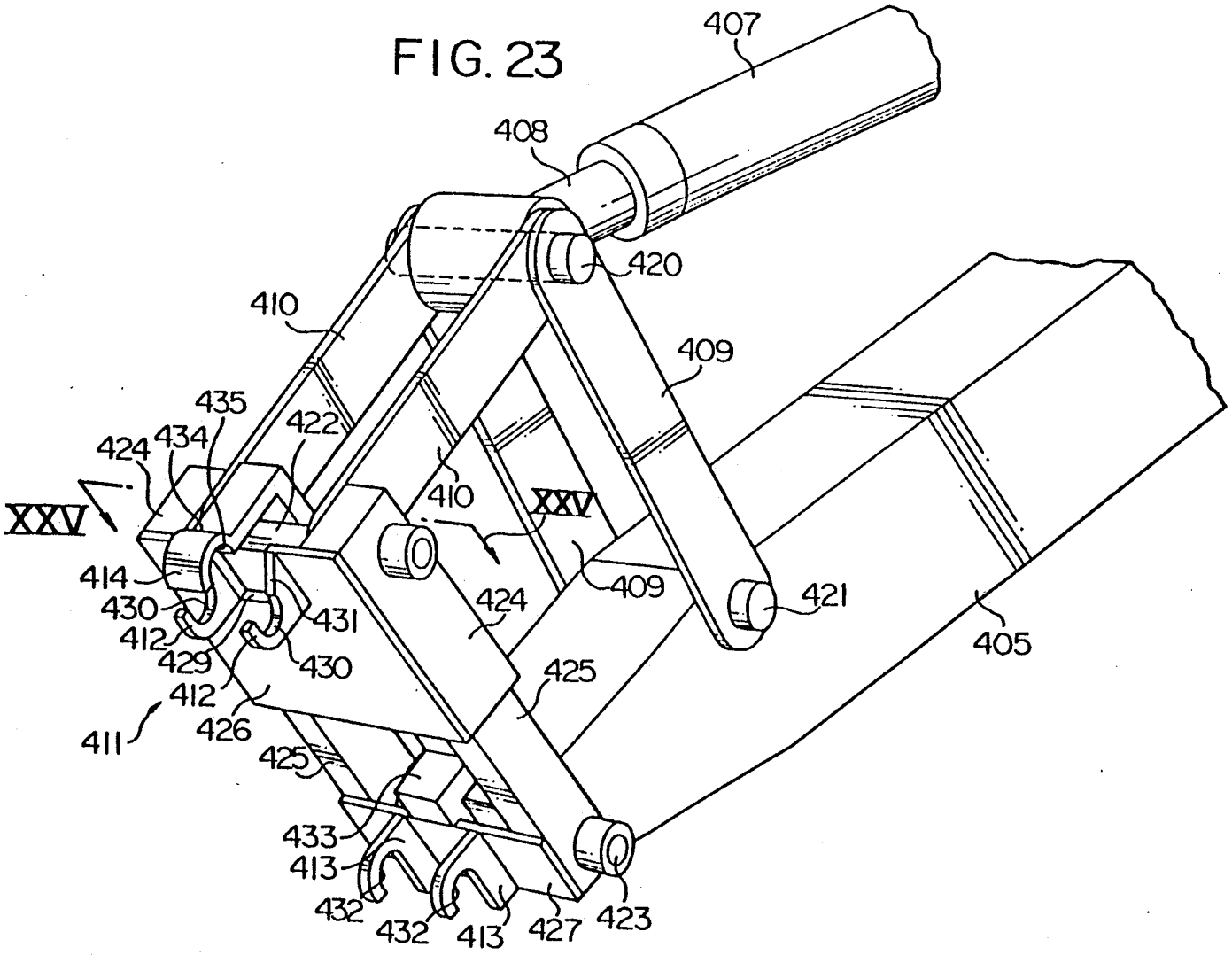
FIG. 23 is an enlarged view of the accessory detachable mechanism attached to a tip end of the arm of the excavator in FIG. 22.

Modification of Third Embodiment (FIGS. 20 and 21).

A detachable mechanism according to a modification of the third embodiment of the present invention will be described with reference to FIGS. 20 and 21.

A substantially U-shaped operation body 370, as viewed from a side elevation, is connected to the tip end of the cylinder rod 331 at the central portion thereof and opened in the forward direction thereof. The operation body 370 has triangular upper and lower side portions 371 and 372. The upper side portion 371 has a guide slit 373 at the portion adjacent to the oblique side thereof while the lower side portion 372 has a guide slit 374 at the portion adjacent to the oblique side thereof. The holding pins 315 and 316 are respectively separated along the axial lines thereof for the angular interval of 90° and cut out at the two portions in symmetrical shapes thereof. Accordingly, half parts of the holding pins 315 and 316 have circular-arced portions 375, 376, 377 and 378. Since the circular-arced portions 375 and 376 are staggered with the circular-arced portions 377 and 378 for the angular interval of 90° in the circumferential direction thereof so that both holding pins 315 and 316 can be slid relative to each other.

A pin hole 379 is defined at a lower surface of the circular arc portion 376 and a pin hole 380 is defined at an upper surface of the circular arc portion 377. An operation pin 381 passed through the guide slit 374 can be inserted into the pin hole 379 while an operation pin 382 passed through the guide slit 373 can be inserted into the pin hole 380. The operation body 370 and the holding pins 315 and 316 can be assembled.

An operation of the modification of the third embodiment will be described hereafter.

Although the holding pins 315 and 316 have respectively notched portions at half parts thereof for the angular interval of 90° and the circular arc portions 375, 376, 377 and 378 respectively extending in the longitudinal directions thereof are remained thereon, the holding pins 315 and 316 can be freely slid in the longitudinal direction thereof since the circular arc portions 375, 376, 377 and 378 of the holding pins 315 and 316 are staggered with each other. When the cylinder rod 331 of the hydraulic cylinder 330 is telescopically moved, the operation body 370 connected to the cylinder rod 331 is simultaneously moved in the longitudinal direction thereof. Components of forces are generated and applied to the operation pins 381 and 382 passed through the guide slits 373 and 374 since the guide slits 373 and 374 are inclined so that the force to be pushed right and left directions is applied to the operation pins 381 and 382. Consequently, the operation force is applied to the holding pins 315 and 316 respectively fixing the operation pins 381 and 382 so that the holding pins 315 and 316 are respectively moved in or moved away from the side openings of the arm 305.

Inasmuch as both the holding pins 315 and 316 are assembled so as to contact each other at the circular arc portions 375, 376, 377 and 378, the holding pins 315 and 316 can strongly bear a bending stress. The holding pins 315 and 316 can be manufactured and assembled with ease since the manufacturing process comprises the step of subjecting them to a radial cutting process on every other quarter side.

With the simple arrangement of the third embodiment of the present invention, the various accessories can be connected to the tip end of the conventional excavator. If the detachable mechanism is provided with holding pins and pin holes, it is possible to connect the accessory to the arm by inserting the holding pins of the arm into the pin holes of the accessory.

Furthermore, the hydraulic cylinder applies force to the holding pin every time they are moved forward or rearward so that the accessory can be attached to or detached from the arm with assurance.

Fourth Embodiment (FIGS. 22 to 26)

A detachable mechanism according to a fourth embodiment of the present invention will be described with reference to FIGS. 22 to 26.

The arrangement of the detachable mechanism of the fourth embodiment is substantially the same as that of the first embodiment, and corresponding components thereof are designated by the same reference numerals modified to have an initial number "4".

A telescopic body 411 comprises a slide mechanism composed of a pair of upper covers 424 disposed right and left with symmetrical arrangement, a pair of lower covers 425 disposed right and left with symmetrical arrangement, an apron 426 for covering the pair of upper covers 424 and a connection plate 427 for covering the pair of lower covers 425. Both the apron 426 and the connection plate 427 are respectively flat shaped and employed for increasing rigidity of the telescopic body 411.

The pair of lower covers 425 are slidably inserted into the pair of upper covers 424 while the pair of upper covers 424 are connected to tip ends of connection links 410 by a pin 422 so as to turn about the pin 422. The lower covers 425 are connected to the tip end of an arm 405 at the right and left sides thereof by a pin 423 so as to turn about the pin 423. These upper and lower covers 424 and 425 are respectively rectangular in cross section thereof and are freely slidable in the longitudinal direction thereof and the interval between the pins 422 and 423 can be varied.

The substantially rectangular flat apron 426 is fixed to fronts of the pair of upper covers 424 and has a substantially U-shaped recess 429 at the upper central portion thereof. A pair of upper hooks 412 are fixed adjacent the right and left sides of the recess 429 with a symmetrical arrangement. The upper hooks 412 have semi-circular arc hook surfaces 430 opening upward at the upper portions thereof. Aslant guide surfaces 431 are defined at the side of pin 422 and extend from the hook surfaces 430.

The long connection plate 427 is fixed to bridge the pair of lower covers 425 at the front and lower portions thereof. A pair of lower hooks 413 are fixed to the right and left slightly remote from the central portion of the connection plate 427 in symmetrical arrangement. The lower hooks 413 have semi-circular arc hook surfaces 432 opening downward at the lower surfaces thereof.

An interlock body 433 bent substantially in U-shape has a lower leg fixed to a central rear surface of the connection plate 427 at the lower portion thereof. Inasmuch as the interlock body 433 is formed by bending, e.g. a long and slim steel plate, a central portion of the interlock body 433 does not contact the apron 426 and extends upward in parallel with the apron 426 while the central portion of the interlock body 433 is spaced from the apron 426. The interlock body 433 has a top portion or leg 434 formed by bending at right angle with a surface of the apron 426 while the top portion 434 is positioned above the recess 429. A presser hook 414 is defined at the tip end of the top portion 434.

The presser hook 414 is semi-circular and has a semi-circular arc presser surface 435 at the inner peripheral lower surface thereof. Accordingly, the top portion 434 of interlock body 433 is positioned at the rear portion of the apron 426 at the middle thereof while positioned at a right angle with the apron 426 in the space of the recess 429 whereby the presser hook 414 is not prevented from vertically moving in the space of the recess 429.

Figure 24:
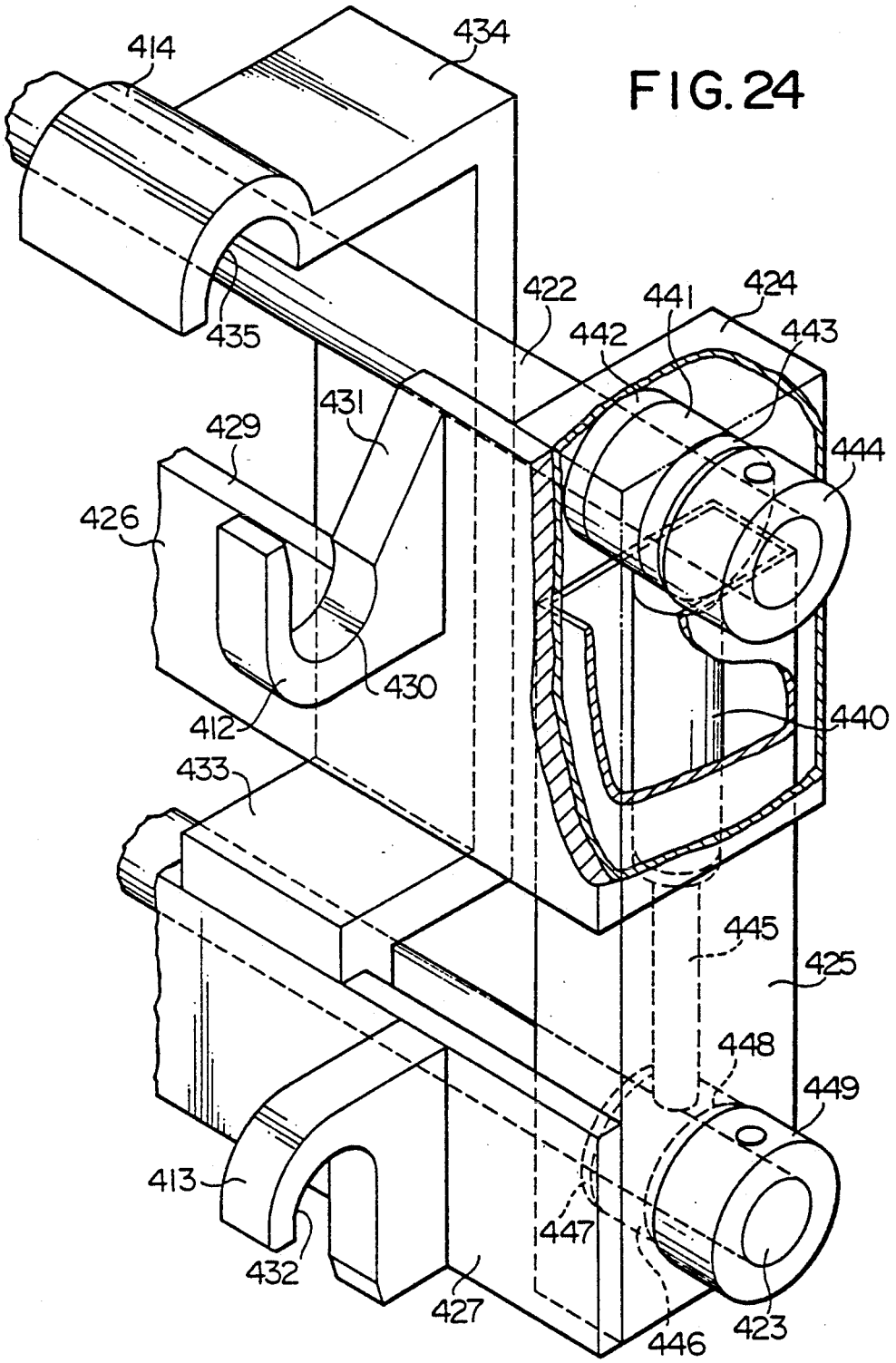
FIG. 24 is an enlarged partly cut away perspective view of a stretchable mechanism, a main constituent of the accessory detachable mechanism of FIG. 22.
Figure 25:
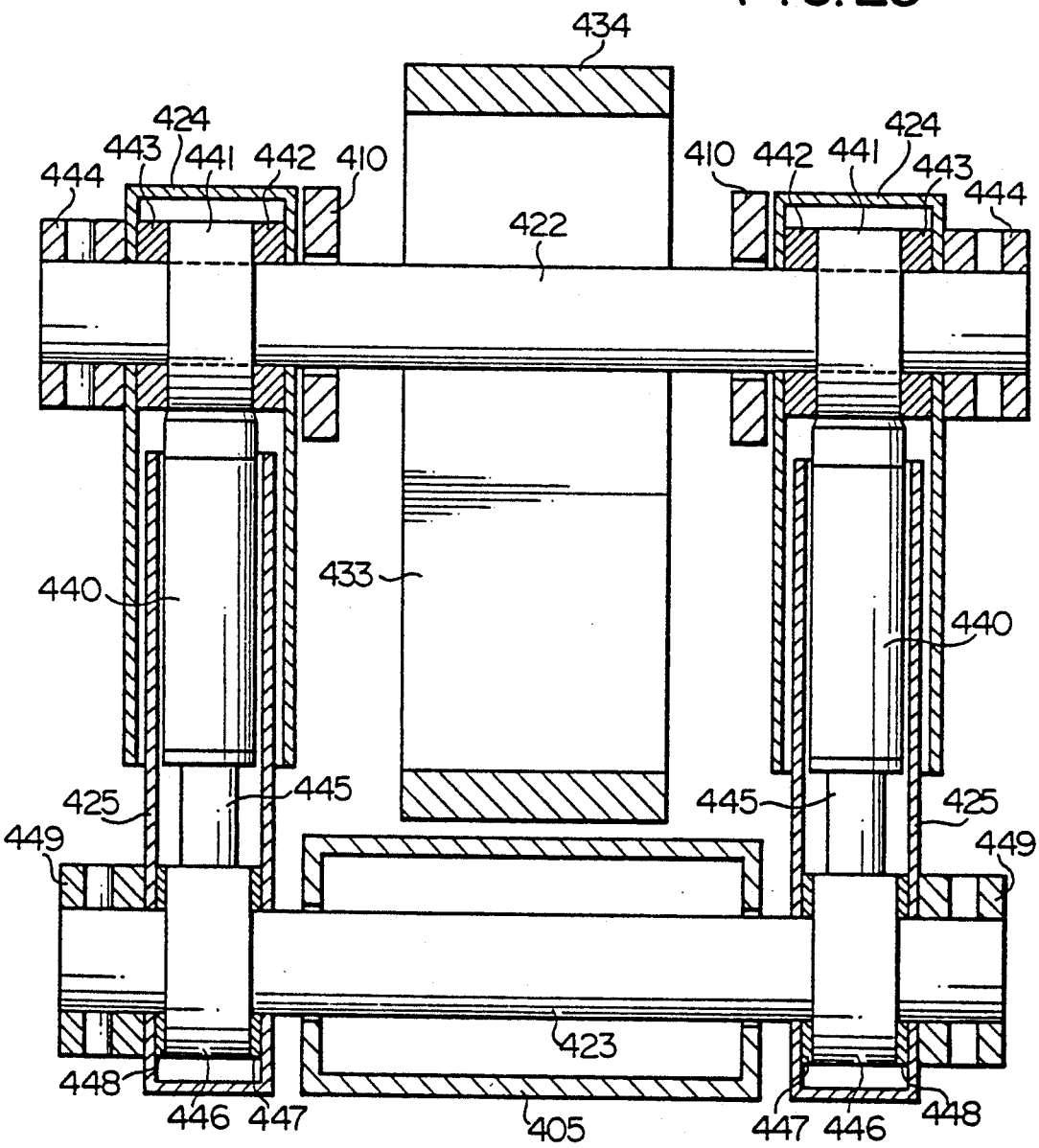
FIG. 25 is a cross sectional view taken along arrows XXV—XXV in FIG. 23.

An internal structure of the telescopic body 411 will be described more in detail with reference to FIGS. 24 and 25.

Both the upper covers 424 and the lower covers 425 are respectively hollow at the insides thereof in which a hydraulic cylinder 440 is accommodated. The hydraulic cylinders 440 have first connected portions 441 defined at rear ends thereof and each having a large diameter. The connected portions 441 are positioned at the upper portion of the upper covers 424 and brought into contact with inner walls of the upper covers 424 by way of collars 442 and 443. The pin 422 penetrates the connected portions 441 and the collars 442 and 443. Stop rings 444 are inserted onto both ends of the pin 422 and fixed thereto by keys or the like.

The tip ends of the cylinder rods 445 are telescopically moved by the hydraulic cylinders 440 and have respectively second large diameter portions 446. The right and left sides of the large diameter portions 446 are brought into contact with inner walls of the lower covers 424 by way of collars 447 and 448. A pin 423 penetrates into the lower covers 425, the collars 447 and 448 and the large diameter portions 446. Holding rings 449 are inserted onto both ends of the pin 423 and fixed thereto by keys or the like.

The telescopic body 411 is connected, instead of the bucket 415, between the tip end of the boom of the known excavator and the tip end of the connection links 410.

An operation of the accessory detachable mechanism according to the fourth embodiment will be described with reference to FIGS. 26(A), 26(B) and 26(C).

Figure 26A:
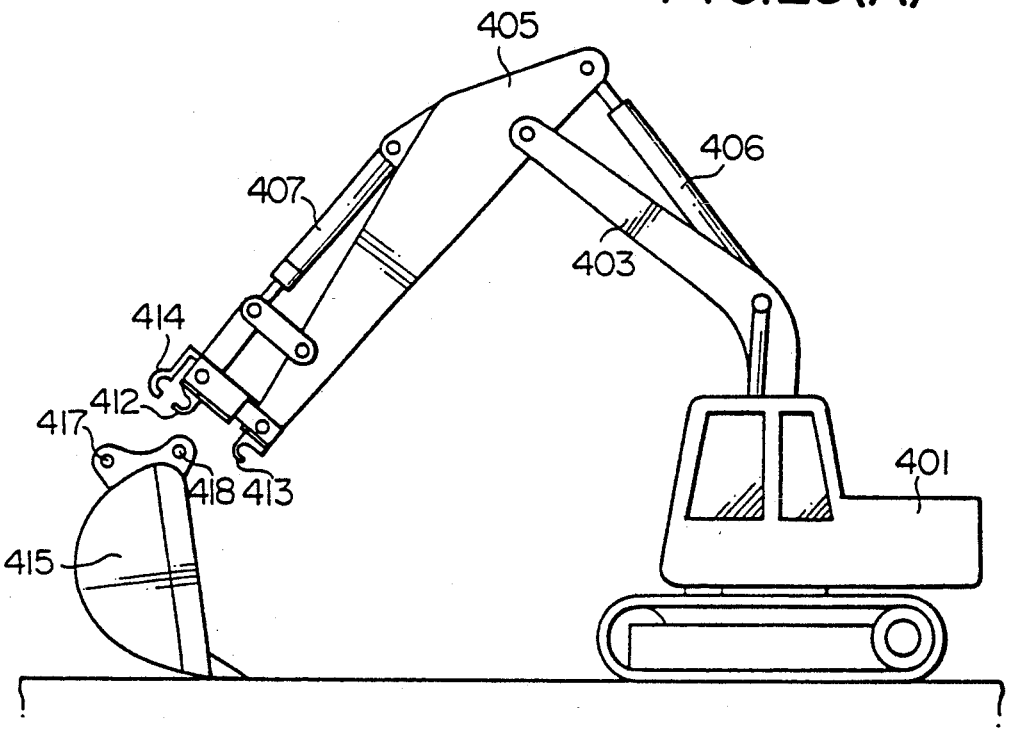
FIGS. 26(A) to 26(C) are views showing operations of the accessory detachable mechanism according to the fourth embodiment.

FIG. 26(A) shows a state where the boom 405 has no accessory at the tip end thereof. From this state, the bucket 415 as the accessory is ready to be attached to the tip end of the boom. The bucket cylinder 407 is stretched to its maximum length while the hydraulic cylinder 440 in the telescopic body 411 is contracted to a maximum, whereby the interval between the upper hooks 412 and the lower hooks 413 is at a minimum. Since the interlock body 433 is fixed to the connection plate 421, the interval between the upper hook 412 and the presser hook 414 is expanded to a maximum, thereby increasing the space between the upper and presser hooks 412 and 414.

At this stage, the arm 403 and the boom 405 are vertically swung by the operation of the hydraulic cylinders 404 and 406 to thereby move the upper hooks 412 toward the holding pin 417 of the bucket 415. Inasmuch as the bucket cylinder 407 is stretched at a maximum, the upper hooks 412 are positioned at the lead end of the accessory detachable mechanism while the lower hooks 413 are positioned more rearwardly toward the mobile chassis 401 so that the lower hooks 413 do not contact the holding pin 417. Inasmuch as the presser hook 414 is positioned over the upper hooks 412, the interval between the upper hooks 412 and the presser hooks 414 is expanded so that the holding pin 417 can be freely movable in the space between the upper and presser hooks 412 and 414.

Figure 26B:
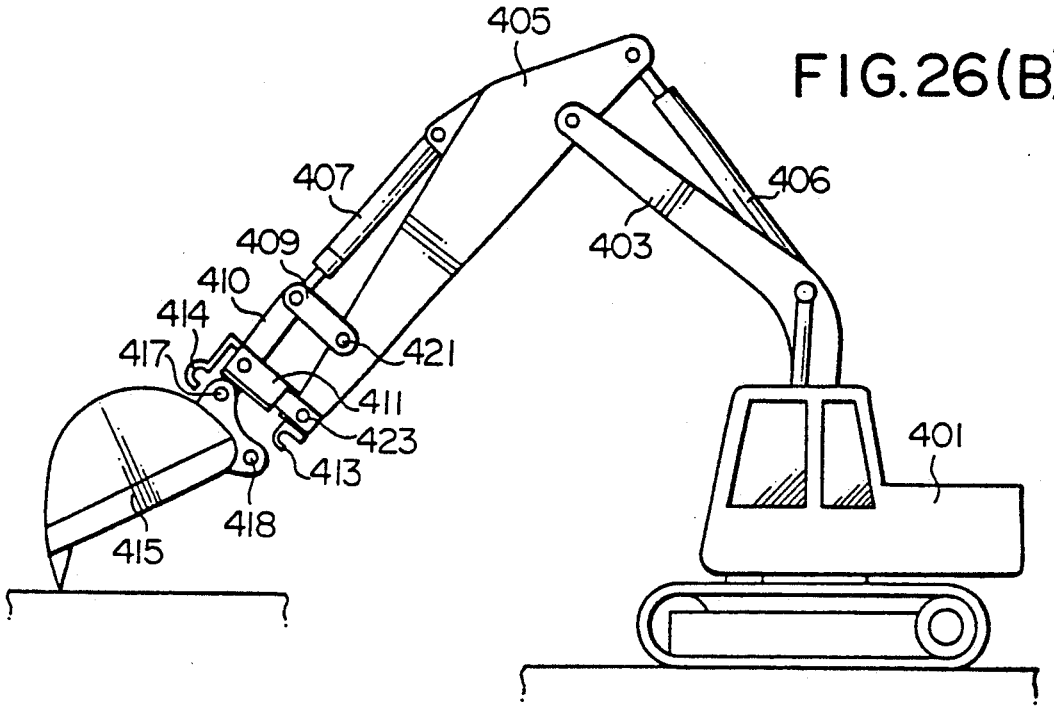

FIG. 26(B) shows a state where the boom 405 is slightly inclined at a given angle by operating the hydraulic cylinders 404 and 406 after the periphery of the holding pin 417 is allowed to contact the hook surface 430 of the upper hooks 412.

The pin 417 is hooked by the upper hooks 412 while the bucket 415 is suspended. Then, the bucket cylinder 407 is contracted when the bucket 415 is suspended by the upper hooks 412. At this stage, the rising links 409 are turned clockwise about the pin 421, thereby pulling the connecting links 410 rightward. As a result, the telescopic body 411 is also pulled rightward as a whole and turned clockwise about the pin 423 so that the bucket 415 is pulled toward the tip end of the boom 405. Consequently, the lower holding pin 418 is allowed to move relatively toward the lower hooks 413. Successively, the lower hooks 413 slip into the space defined between the holding pins 417 and 418.

When the lower hooks 413 pass above the upper portion of the holding pin 418 and are positioned in the space between the holding pins 417 and 418, the hydraulic cylinders 440 are stretched. The cylinder rods 445 are pushed by the operation of the hydraulic cylinder 440, thereby enlarging the interval between the pins 422 and 423. Consequently, the apron 426 fixed to the upper covers 424 moves in the opposite direction relative to the connection plate 427 fixed to the lower covers 425 so that the interval between the upper hooks 412 and the lower hooks 413 is enlarged whereby the lower hooks 413 are moved relatively toward the upper surface of the holding pin 418. When the hook surfaces 432 of the lower hooks 413 contact the holding pin 418 the two holding pins 417 and 418 are urged away from one another and clamped by the pair of upper hooks 412 and the pair of lower hooks 413. At the same time, as the connection plate 427 is moved downward, the interlock body 433 fixed to the connection plate 427 is also moved downward whereby the presser hook 414 also moves downward and the hook surface 435 contacts the upper surface of the holding pin 417. Accordingly, the holding pin 417 is forced to contact the upper hooks 412 at the lower surface thereof while forced to contact the hook 414 at the upper surface thereof, so that the holding pin 417 is clamped between the upper hooks 412 and the presser hook 414. As a result, the bucket 415 is connected to the tip end of the boom 405.

When oil under pressure in the hydraulic cylinder 440 is kept constant, the hook surfaces 430 of the upper hooks 412 and the hook surfaces 432 of the lower hooks 413 are always biased by and contact the holding pins 417 and 418 while at the same time the presser surface 435 of the presser hook 414 contacts the upper surface of the holding pins 417. As mentioned above, since the two holding pins are urged vertically away from one another and are also engaged from the upper side, the bucket 415 is securely held on the tip end of the boom 405.

Figure 26C:
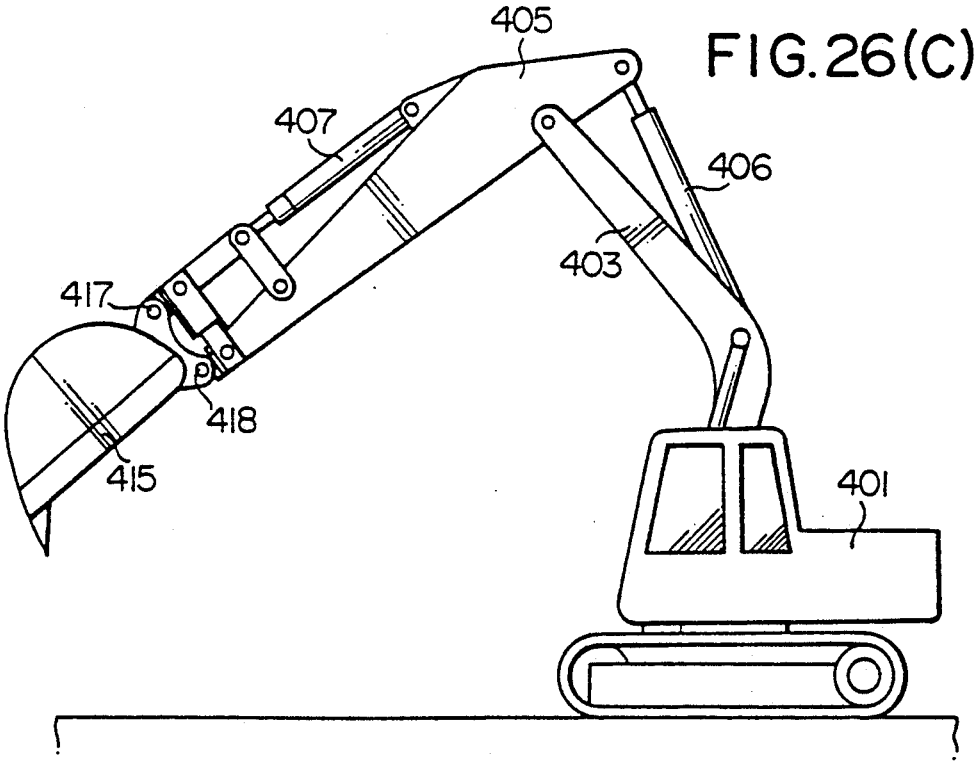
Figure 27:
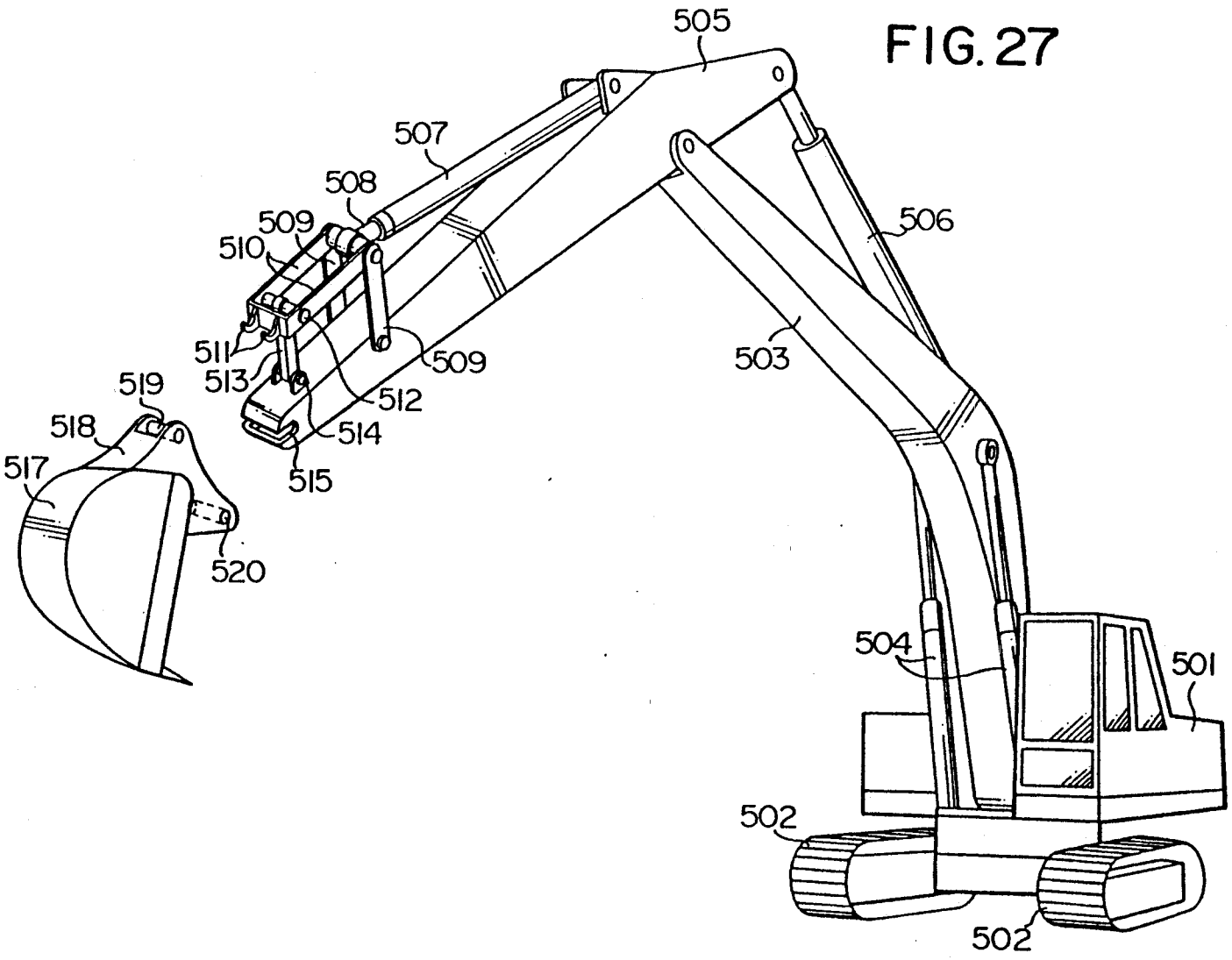
FIG. 27 is a perspective view of an excavator employing the accessory detachable mechanism according to a fifth embodiment of the present invention.
Figure 28:
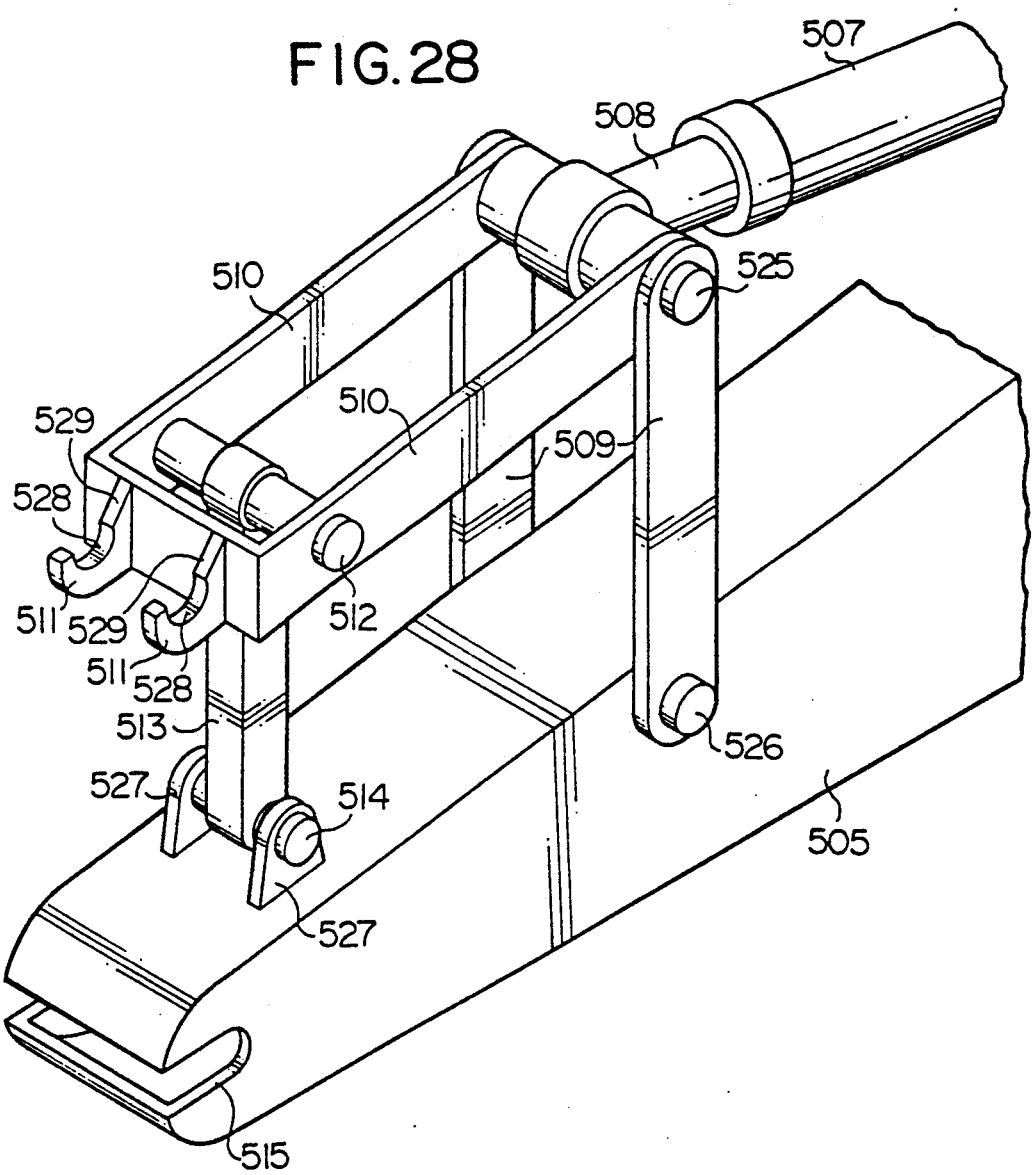
FIG. 28 is an enlarged view of the accessory detachable mechanism shown in FIG. 27.
Figure 29:
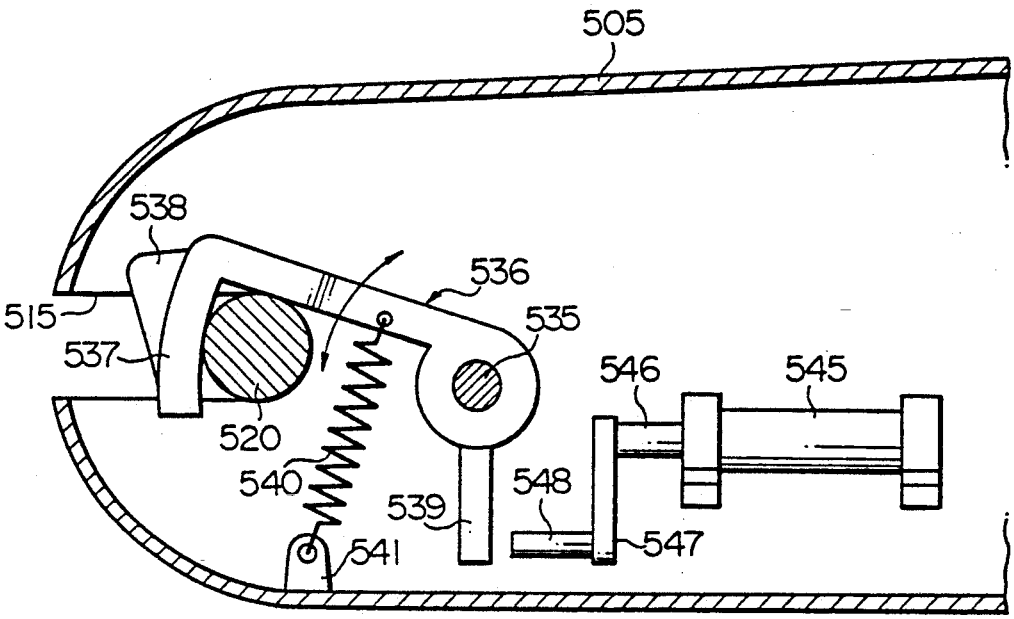
FIG. 29 is a cross sectional view of a tip end of an arm having a mechanism to hold holding pins, constituents of the detachable mechanism of the fifth embodiment.
Figure 30:
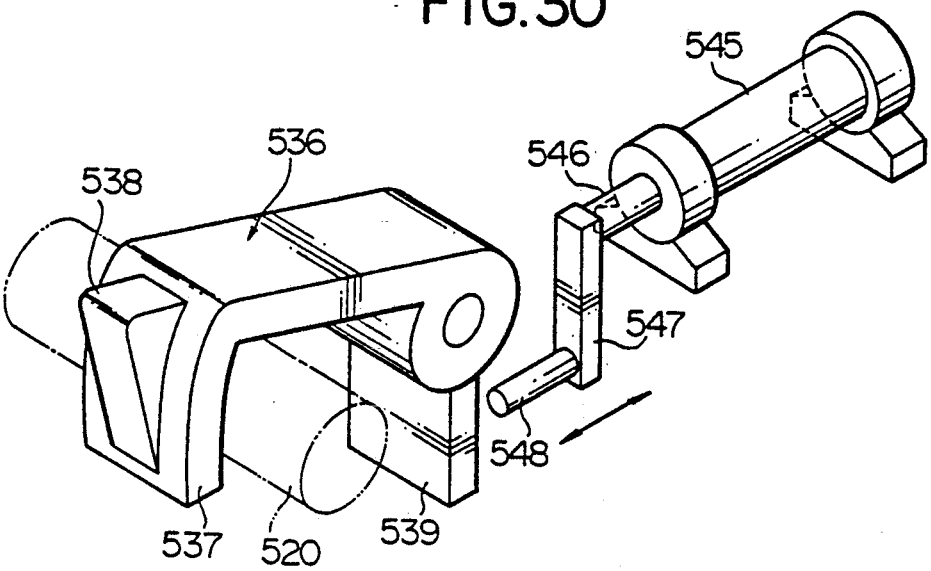
FIG. 30 is an exploded perspective view of the main portion of an operation portion in FIG. 29.

When the bucket 415 is removed from the tip end of the boom 405, contrary to the previous attaching operation, the operations according to the steps of FIGS. 26(C), 26(B), and 26(A) are sequentially carried out.

Fifth Embodiment (FIGS. 27 to 31)

A detachable mechanism according to a fifth embodiment of the present invention will be described with reference to FIGS. 27 to 31.

This arrangement of the detachable mechanism of the fifth embodiment is substantially the same as that of the second embodiment, and corresponding parts thereof are designated by the same numerals modified to have an initial number "5".

A holding groove 515 is opened in the tip end of an arm 505. The holding groove 515 is of a slit shape in the lateral direction thereof and has a length conforming to the longitudinal direction of the arm 505. A support shaft 535 is positioned inside the arm 505 and fixed to a portion adjacent to an innermost end of the holding groove 515. The support shaft 535 has a sickle-shaped holding body 536 swingably supported thereto. The holding body 536 extends in the direction of the holding groove 515 and has a tip end bent in a substantial L-shape for forming a holding portion 537. The holding portion 537 is slightly remote from the innermost position of the holding groove 515 so that the holding portion 537 contacts a holding pin 520 provided on bucket 517 at the side of the opening of the holding groove 515 when it is positioned at the innermost part of the holding groove 515.

A push body 538 having a substantially triangular shape in cross section is fixed to a front surface of the holding portion 537. A release lever 539 protrudes downward from the holding body 536 at the portion adjacent to the support shaft 535. The holding body 536 has a spring 540 which has one end held thereby at the central portion of body 536 and another end held by a spring seat 541 protruding from the inner wall of the arm 505. Accordingly, the holding body 536 is always biased counterclockwise by the spring 540 about the support shaft 535. A hydraulic cylinder 545 is positioned inside the arm 505 for a release operation and has a cylinder rod 546 directed in the direction of the support shaft 535. The cylinder rod 546 has a tip end to which an extension plate 547 is connected and directed downward. The extension plate 547 has a rod 548 at the lower end thereof so as to be in parallel with the cylinder rod 546. The rod 548 is directed toward the side surface of the release lever 539 at the tip end thereof.

An operation of the detachable mechanism according to the fifth embodiment will be described with reference to FIGS. 31(A) to 31(C).

Figure 31A:
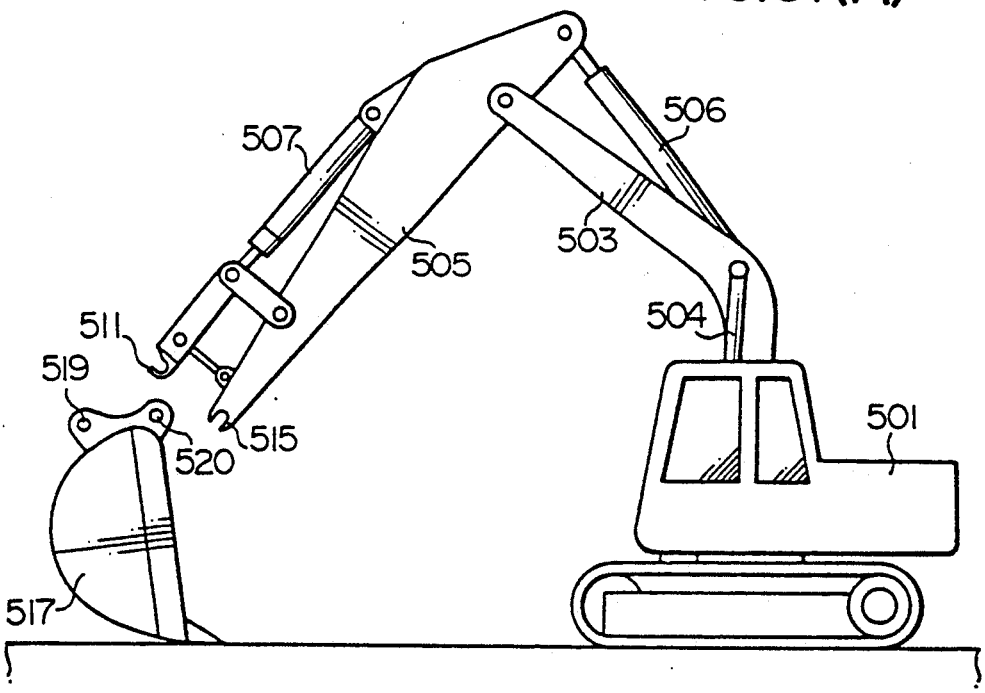
FIG. 31(A) to 31(C) are views showing operations of the accessory detachable mechanism according to the fifth embodiment.

A state where the attaching operation of the accessory (the bucket 517 in this case) starts is illustrated in FIG. 31(A) which is the same as the state illustrated in FIG. 10(A). Hence, the explanation thereof is omitted.

The pin 519 is hooked by the upper hooks 511 to connect the bucket 517 to the arm. Then, the bucket cylinder 507 is contracted when the bucket 517 is suspended by the upper hooks 511. At this stage, the rising links 509 are turned clockwise about the pin 526, thereby pulling pawl holders 510 rightward. Accordingly, both the upper hooks 511 and the bucket 517 are pulled rightward so that the holding pin 520 of the bucket 517 is relatively moved toward the tip end of the arm 505.

Inasmuch as the holding groove 515 is defined at the tip end of the arm 505, the holding pin 520 is inserted into the slot 515. As the holding pin 520 contacts the rear surface of the push body 538, the holding body 536 is forced to turn about the support shaft 536 against the resilience force of the spring 540 since the rear surface of the push body 538 is inclined so that the holding pin 520 is inserted into the innermost end of the holding groove 515. When the holding pin 520 is positioned at the innermost end of the holding groove 515, the holding body 536 is rotated counterclockwise by the spring 540 so that the holding portion 537 moves to close the opening of the holding groove 515. As a result, the holding pin 520 is prevented from being drawn out of the holding groove 515 whereby the holding pin 520 is connected to the tip end of the arm 505 as illustrated FIG. 29.

Figure 31B:
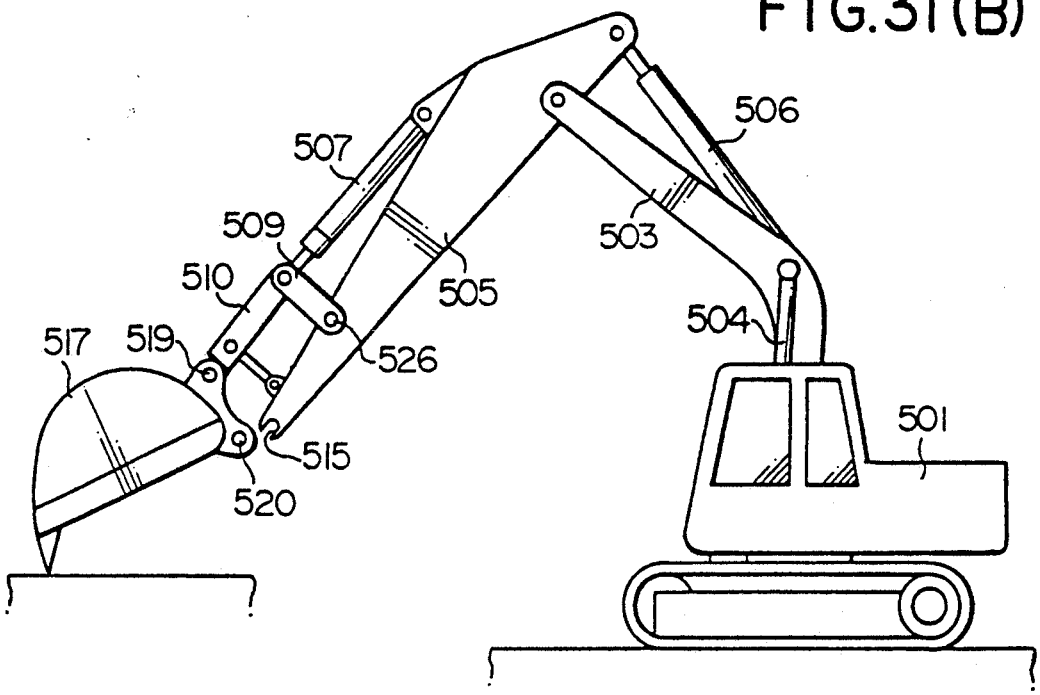
Figure 31C:
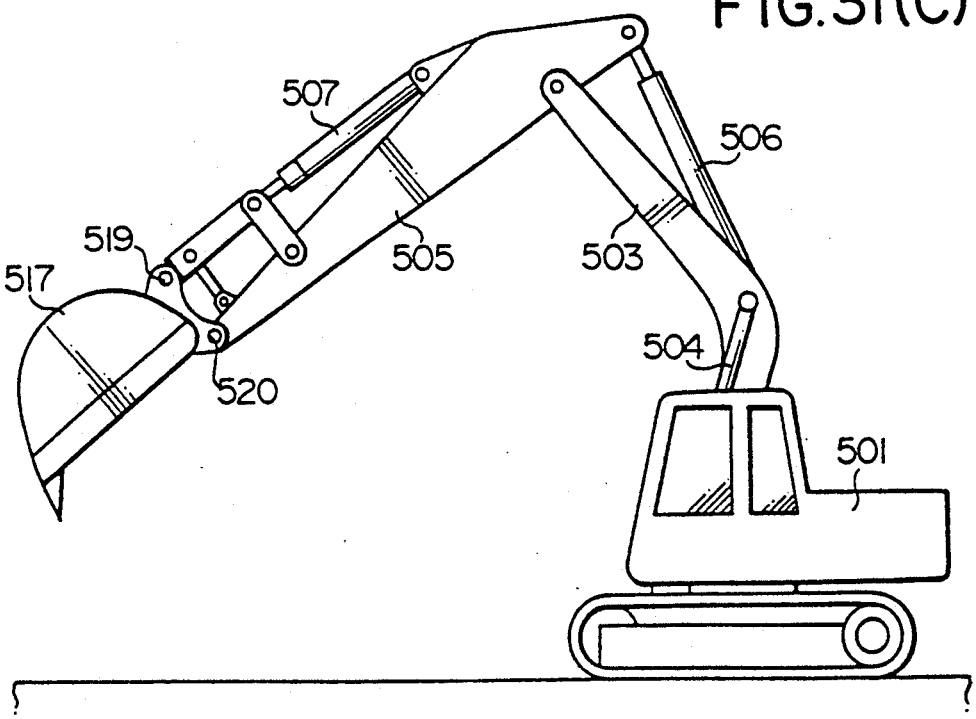
Figure 32:
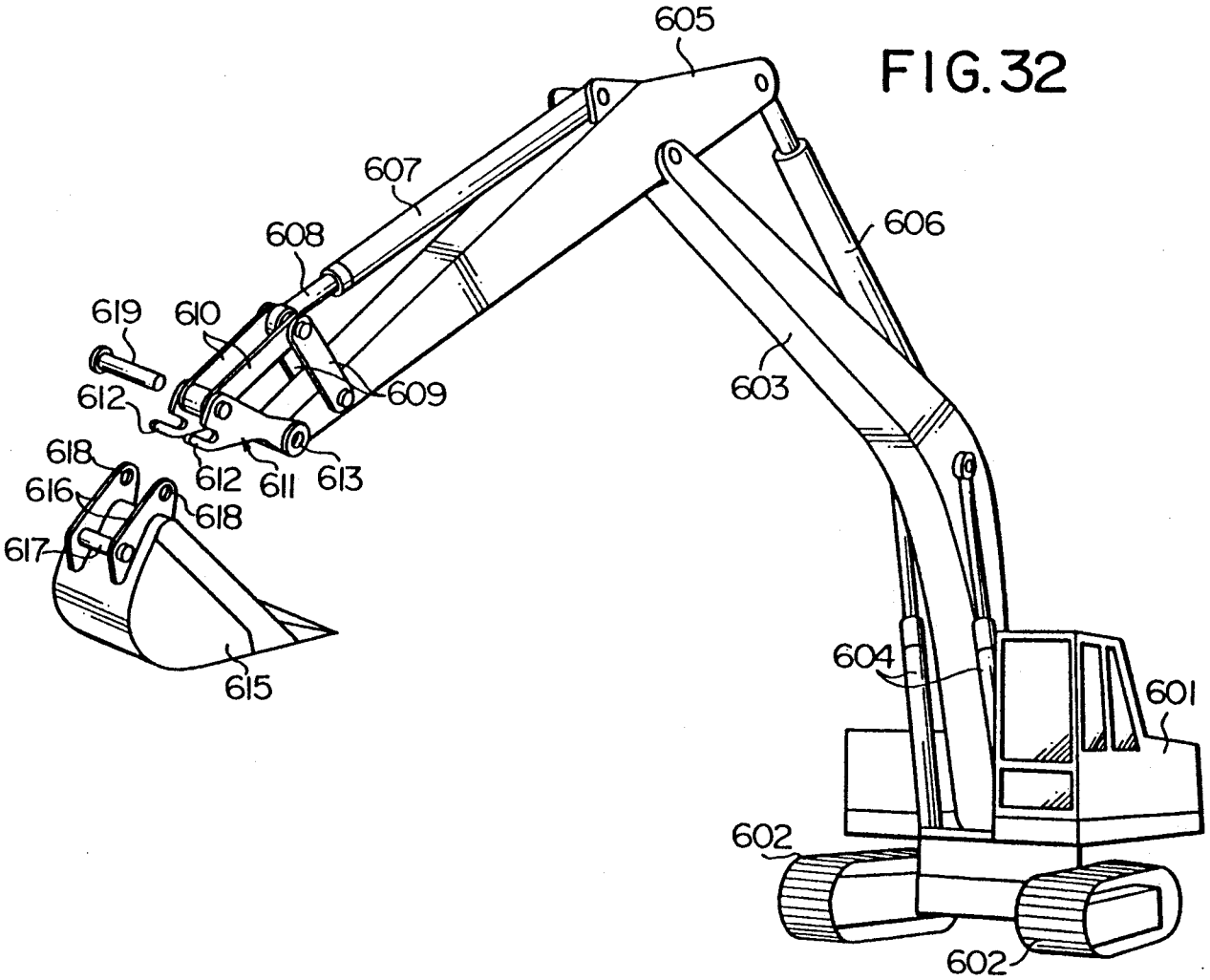
FIG. 32 is a perspective view of an excavator employing an accessory detachable mechanism according to a sixth embodiment of the present invention.
Figure 33:
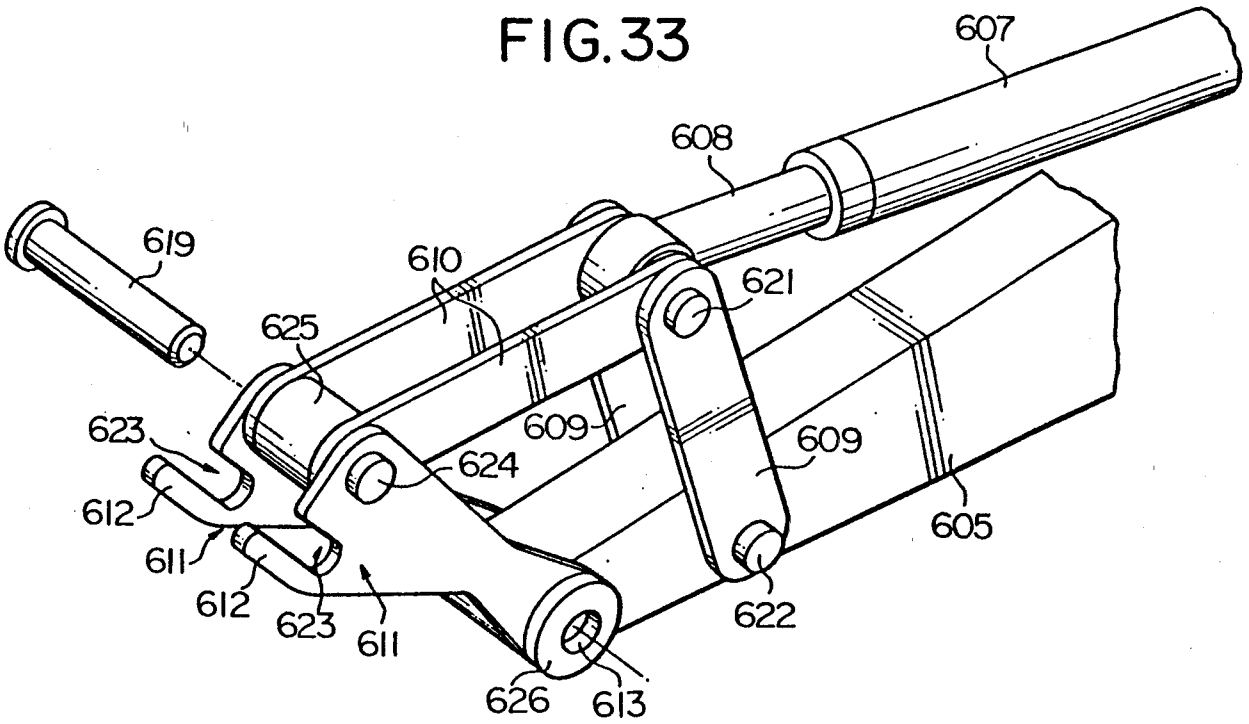
FIG. 33 is an enlarged perspective view of the accessory detachable mechanism attached to a tip end of the arm of the excavator in FIG. 32.

As illustrated in FIG. 31(C), the holding pin 519 is hooked by the upper hooks 511 while the holding pin 520 is fixed inside the holding groove 515 so that the bucket 517 is securely connected to the arm 505. Since 10 the holding groove 515 is closed by the holding portion 537, the holding pin 520 can be turned at the tip end of the arm 505. Accordingly, the bucket 517 can be turned about the holding pin 520 by the operation of the hydraulic cylinder 507 so that the construction machine having the detachable mechanism can operate in the same way as the conventional excavator.

An operation of the removal of the bucket 517 from the tip end of the arm 505 will be described hereinafter.

The tip end of the bucket 517 is forced to contact the ground and the hydraulic cylinder 545 is operated to push the cylinder rod 546. Since the rod 548 moves toward the tip end of the arm 505 and the tip end of the rod 548 pushes the release lever 539, the holding body 536 turns clockwise about the support shaft 535 against the resilience force of the spring 540. As a result, the holding portion 537 closing the holding groove 515 moves upward, whereby the holding pin 520 slides in the holding groove 515 and is pulled out of the tip end of the arm 505.

These operations can be carried in sequence as illustrated in FIGS. 31(C), 31(B) and 31(A).

Sixth Embodiment (FIGS. 32 to 39).

A detachable mechanism according to a sixth embodiment of the present invention will be described with reference to FIGS. 32 to 39.

The arrangement of the detachable mechanism of the sixth embodiment is substantially the same as that of the second embodiment, and corresponding parts thereof are designated by the same numerals modified to have an initial number "6".

A pair of connecting links 610 are connected to the tip end of a cylinder rod 608 of a bucket cylinder 607. A pair of holding links 611 are spaced in parallel with each other between the tip end of the connecting links 610 and the tip end of the arm 605 and the holding links 611 are swingably connected to the tip ends of the connecting links 610 and to the tip end of the arm 605. A turnable four-bar link mechanism is formed by the arm 605, rising links 609, the connecting links 610 and the holding links 611. A pin hole 613 penetrates both into the tip end of the arm 605 and the lower ends of the holding links 611.

The holding links 611 are respectively disposed at the tip end of the arm 605 at the right and left thereof in parallel with each other. Distances between the rising links 609 and the holding links 611 at the upper ends thereof are greater than those at the lower ends thereof. Holding hooks or pawls 612 protrudes upward from the front upper portion of the holding links 611. The holding links 611 define holding grooves 623 each having a U-shape cross section defined by the holding pawls 612. The holding links 611 are swingably connected to the tip ends of the connecting links 610 by a pin 624. A collar 625 is interposed between the connecting links 610 and around the pin 624. The holding links 611 are swingably connected to the tip ends of the arm 605 at the lower ends thereof by bearings 626. The bearings 626 have pin holes 613 penetrating thereinto. Distances between the bottoms of the holding grooves 623 and the pin holes 613 conform to those between a hook pin 617 provided on a bucket 615 and pin holes 618 provided also on the bucket 615.

Figure 34:
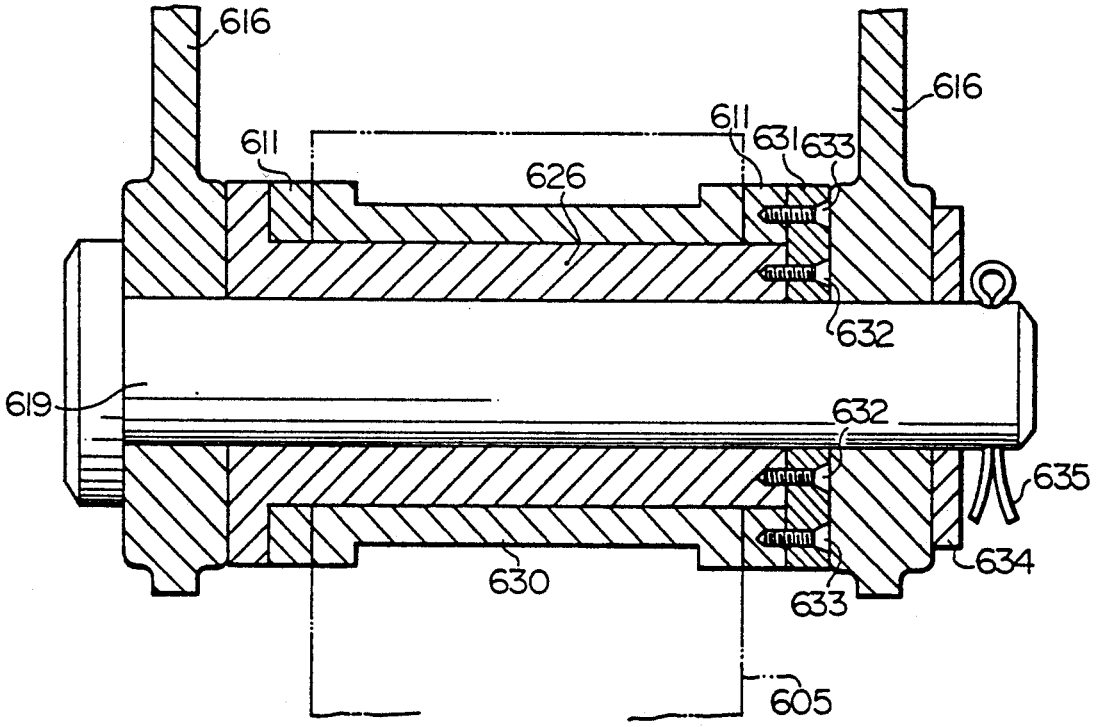
FIG. 34 is a cross sectional view showing a state where the bucket is attached to a tip end of an arm.

FIG. 34 shows a cross sectional view of a portion adjacent to the tip end of the arm 605 in which connecting pin 619 is inserted into the pin holes 613 and 618 when the bucket 615 is connected to the tip end of the arm 605.

A shaft support sleeve 630 having a flange at both ends thereof and a hollow inside portion is fixed to the tip end of the arm 605. Lower ends of the holding links 611 contact both side surfaces of the shaft supporter 630. The bearing 626 having a flange at one side thereof is inserted between the holding links 611 and the shaft supporter 630 and contacts a ring-shaped part 631 at the other end thereof. The part 631 and the bearing 626 are connected to each other by screws 632 while the part 631 and the holding links 611 are connected to each other by screws 633. Since the part 631 is fixed to one of the holding links 611, both of the holding links 611 can be freely turned relative to the arm 605 and held so as to not be dropped off the arm 605. The hole penetrating the bearing 626 corresponds to the pin hole 613. An inner surface of an attached body 616 of the bucket 615 is forced to contact a side surface of the bearing 626 and a side surface of the part 631 while a connecting pin 619 is inserted into the pin hole 618 of the attached body 616 and the pin hole 613 whereby the attached body 616 of the bucket 615 can be connected to the tip end of the arm 605 so as to be turned freely. It is possible to prevent the connecting pin 619 from being dropped out from the arm 605 by inserting a washer 634 into the tip end of the connecting pin 619 and thereafter inserting a split pin 635 into the connecting pin 619.

An operation of the detachable mechanism according to the sixth embodiment will be described with reference to FIGS. 35 to 37.

Figure 35:
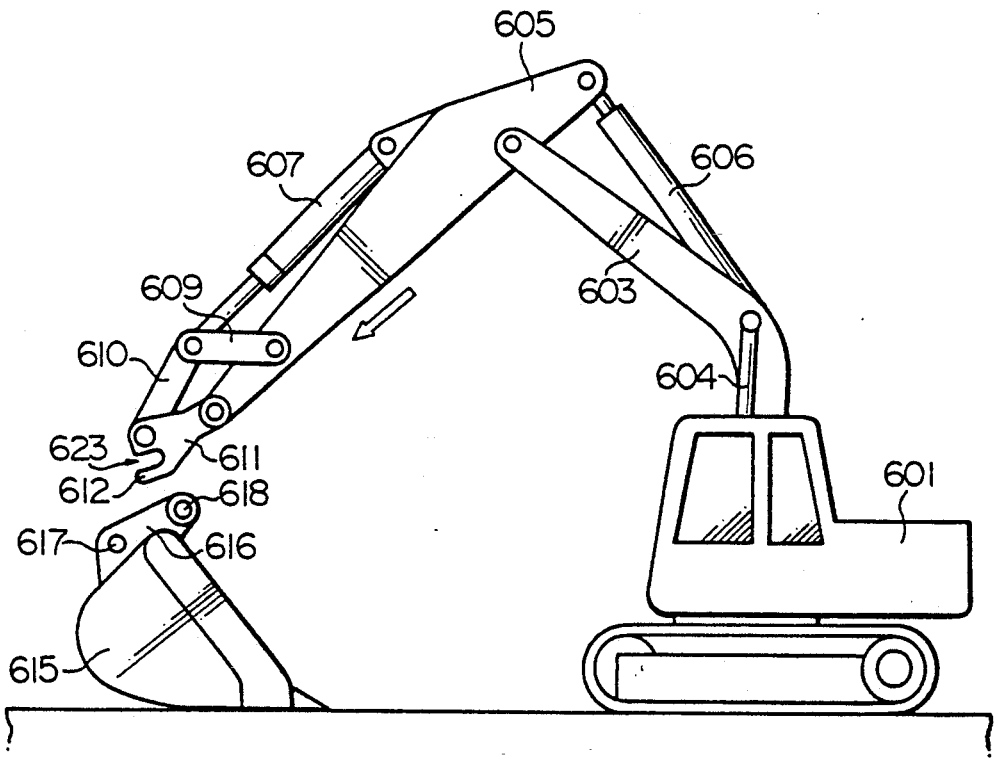
FIG. 35 is a view showing a state just before the bucket is attached to the tip end of the arm.

FIG. 35 shows a state where the hook pin 617 is inserted into the holding groove 623. Hydraulic cylinders 604 and 606 are cooperatively operated to slightly raise the arm 605 upward while a bucket cylinder 607 is contracted to turn the rising links 609 clockwise. The connecting links 610 are pulled by the turning of the rising links 609 so that the holding links 611 turn about the bearing 626 to thereby slide the hook pin 617 into the innermost end of the holding groove 623. Accordingly, the bucket 615 is hooked by the holding groove 623 so that the bucket 615 is held by the arm 605 by way of the holding links 611.

Figure 36:
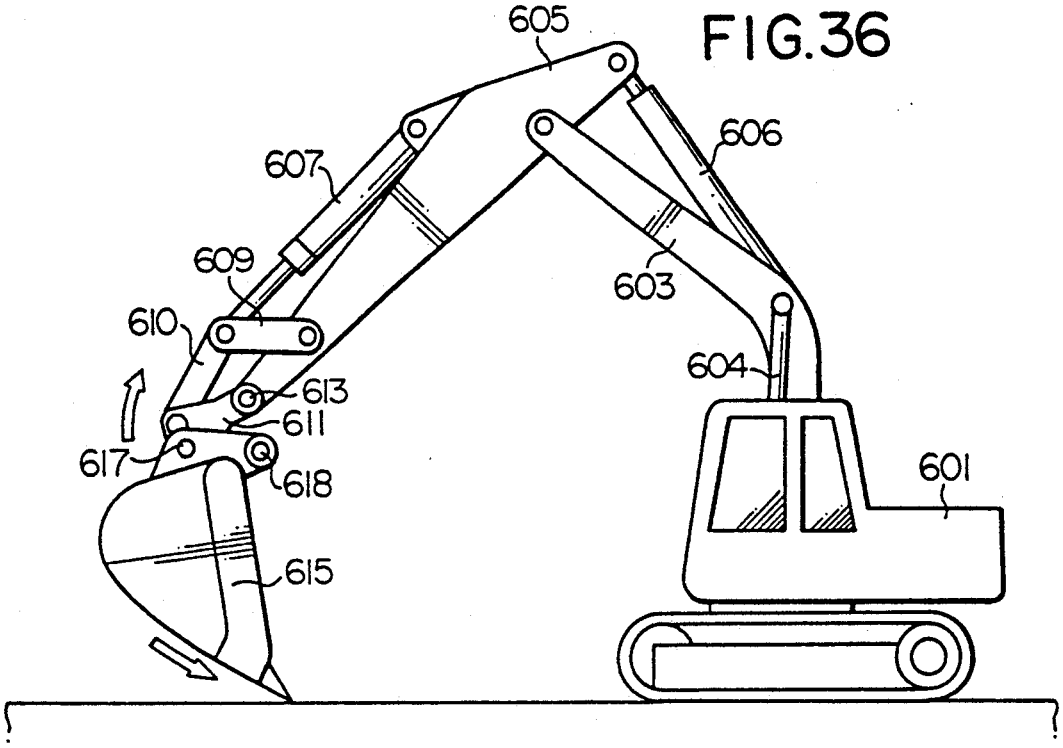
FIG. 36 is a view showing a state where the bucket is hooked by the tip end of the arm.
Figure 37:
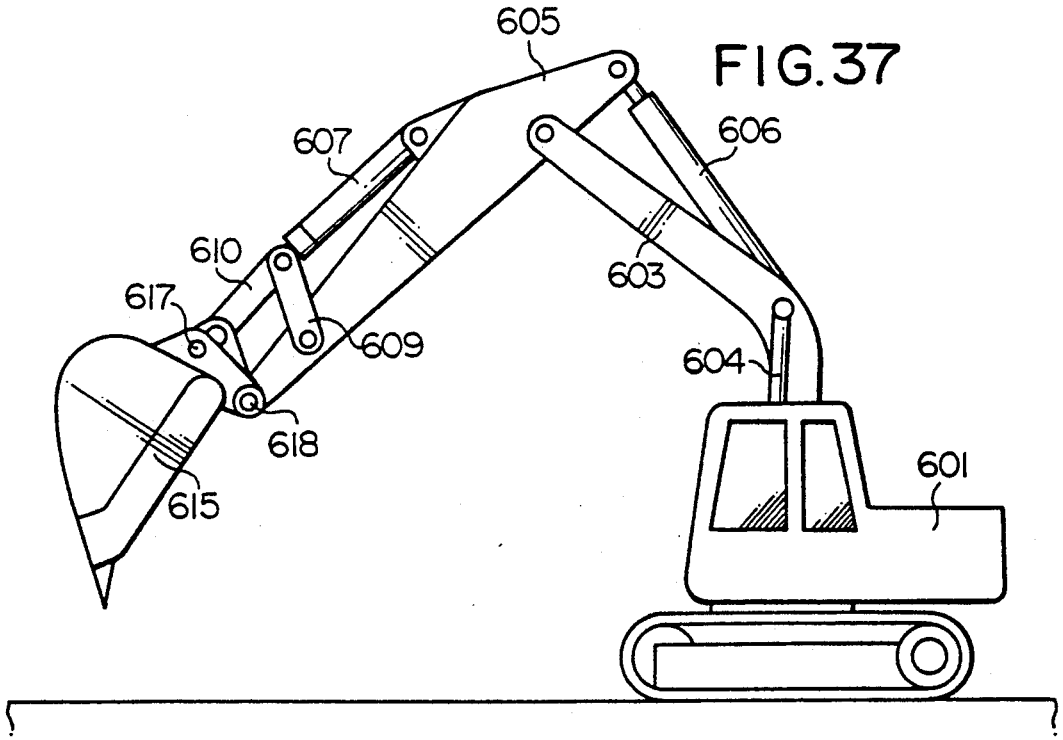
FIG. 37 is a view showing a state where the bucket is connected to the arm by way of holding pins.

As illustrated in FIG. 36 where the bucket cylinder 607 is further contracted while the hook pin 617 is hooked in the holding groove 623, the bucket 615 is turned counterclockwise by its own weight so that the pin hole 618 is coaxially positioned with the pin hole 613. When the bucket cylinder 607 is contracted and the holding links 611 is forced to rise, the hook pin 617 slides into the innermost of the holding groove 623. At this state, since the distance between the holding groove 623 and the pin hole 613 is equal to the distance between the hook pin 617 and the pin holes 618, an axial line of the pin hole 613 is always positioned at the same location as that of the pin holes 618. In the state, as illustrated in FIG. 36, the operator of the excavator gets off the mobile chassis 601 and inserts the connecting pin 619 into the pin holes 618. As a result, the bucket 615 is connected to the tip end of the arm 605 by the connecting pin 619. Thereafter, the washer 634 is inserted onto the tip end of the connecting pin 619 and successively the split pin is also inserted into the tip end of the connecting pin 619 whereby the connecting pin 619 is prevented from dropping off the arm 605.

Figure 38:
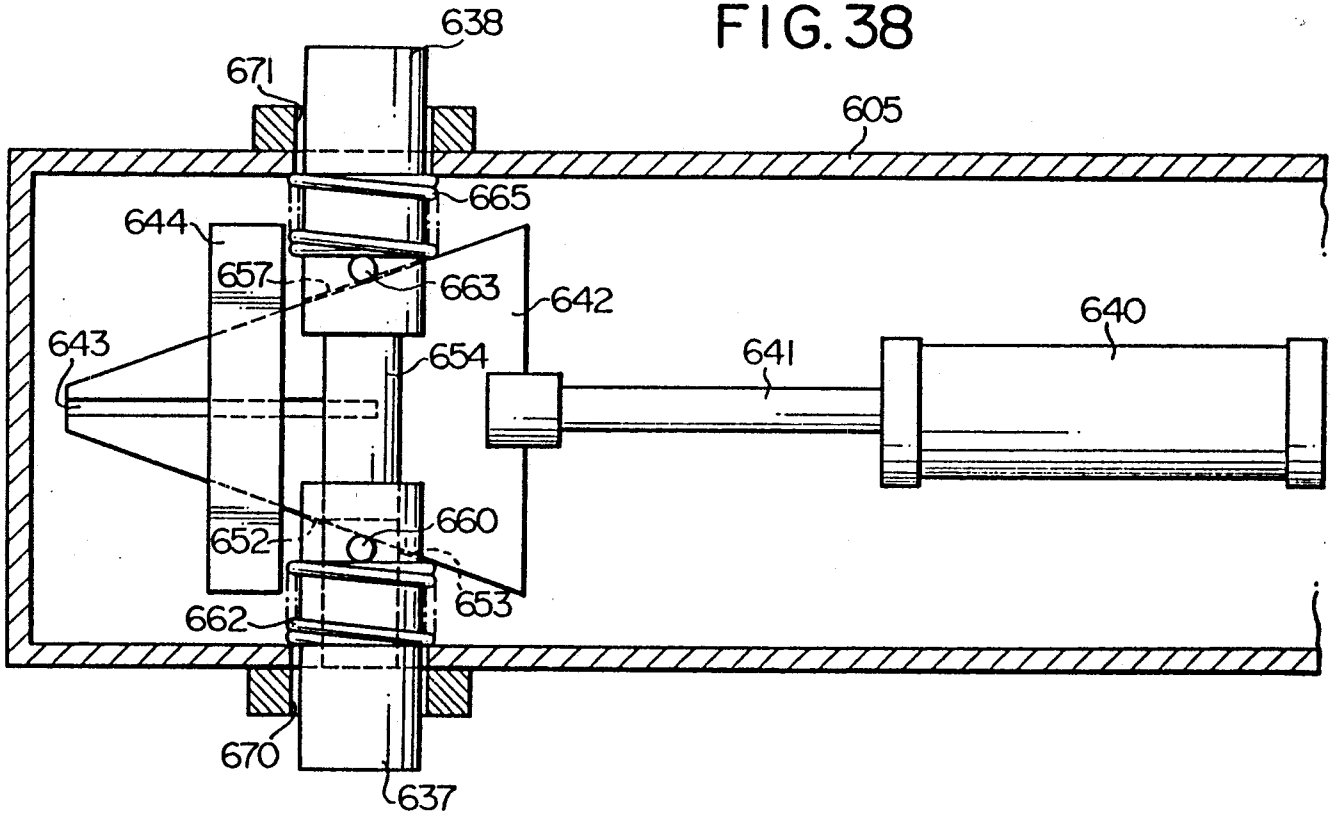
FIG. 38 is a cross sectional view of an inside of the arm according to a modification of the sixth embodiment.
Figure 39:
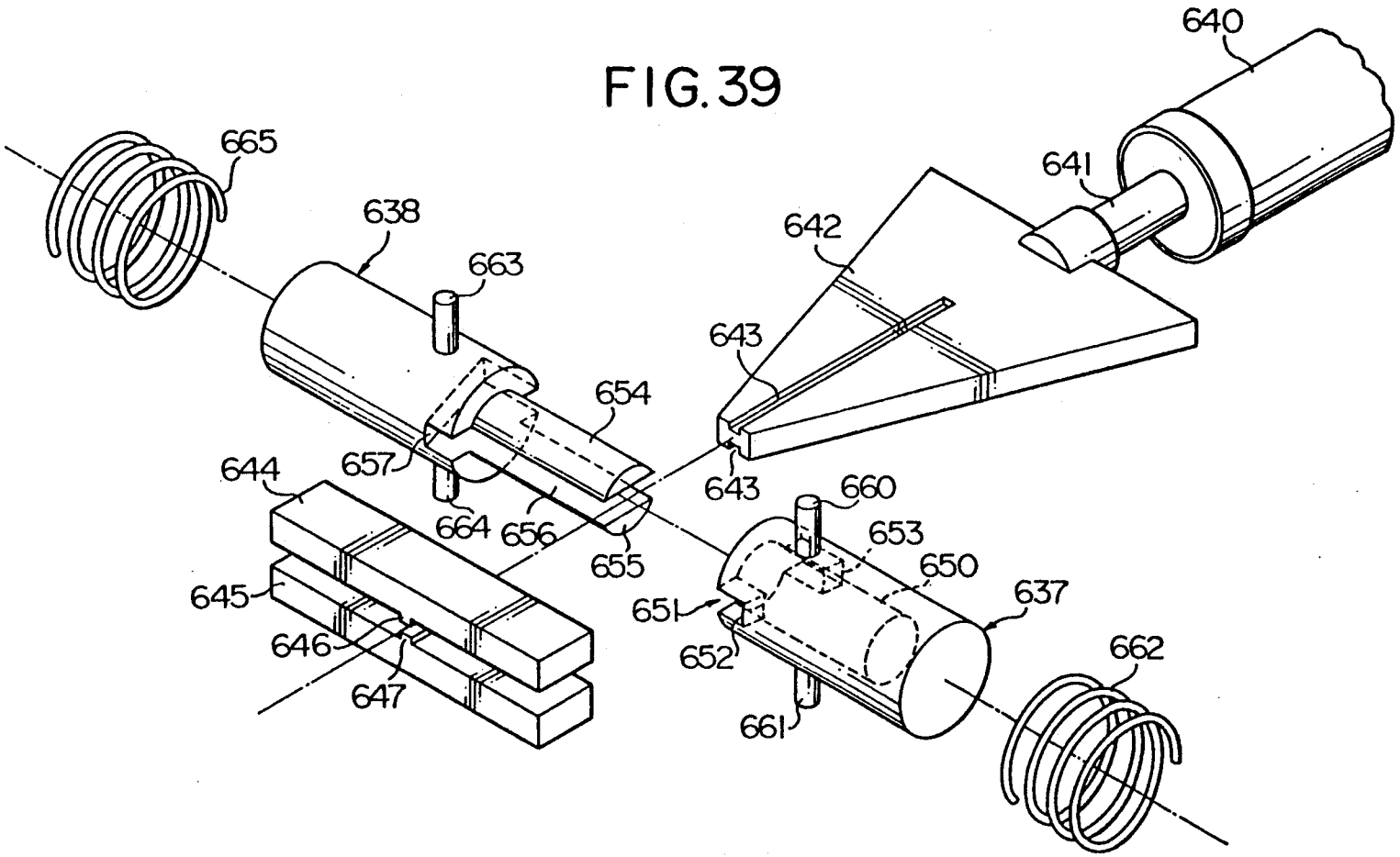
FIG. 39 is an exploded perspective view showing a mechanism for driving the holding pins in FIG. 38.
Figure 40:
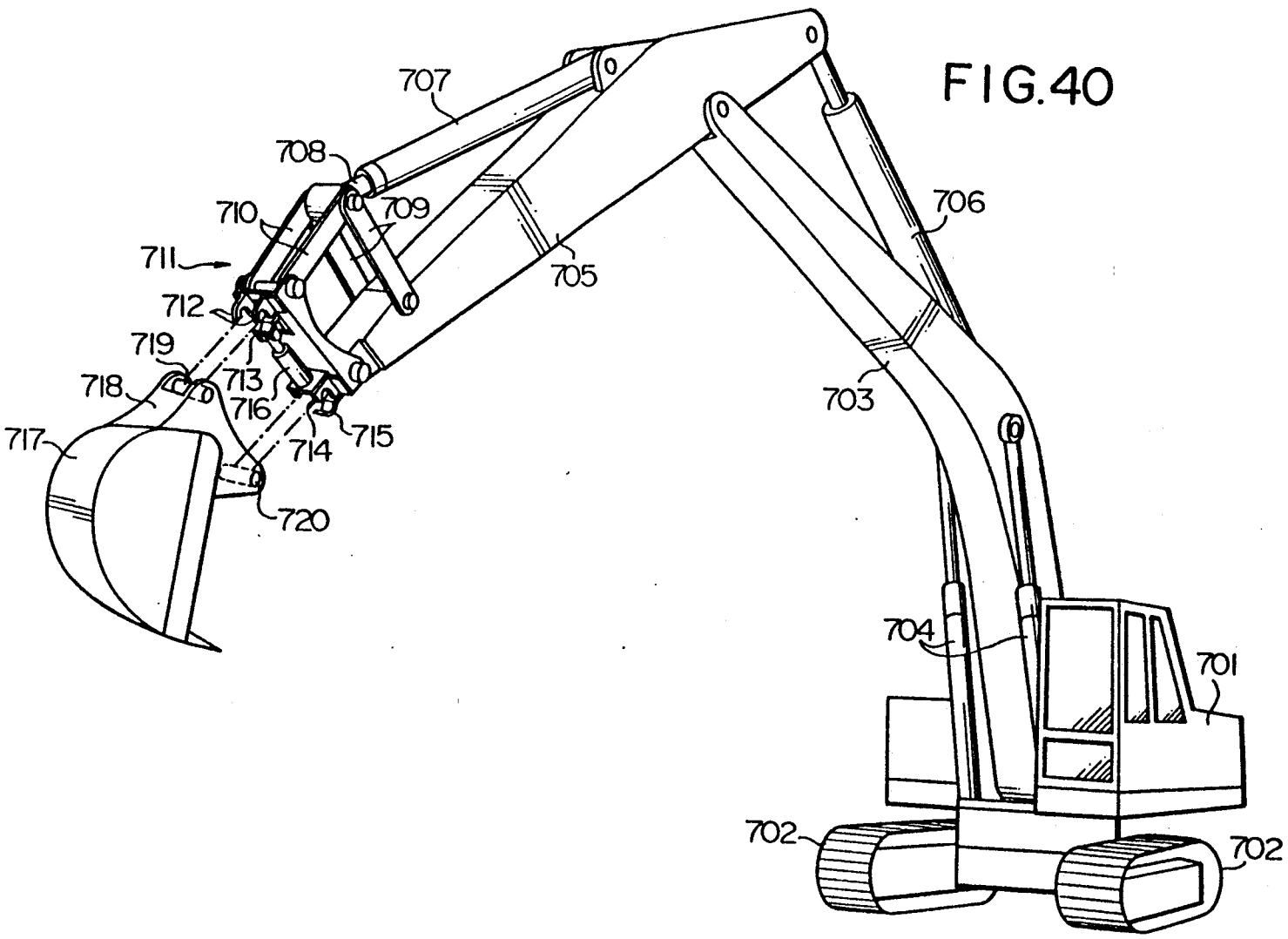
FIG. 40 is a perspective view of an excavator employing the accessory detachable mechanism according to a seventh embodiment of the present invention.
Figure 41:
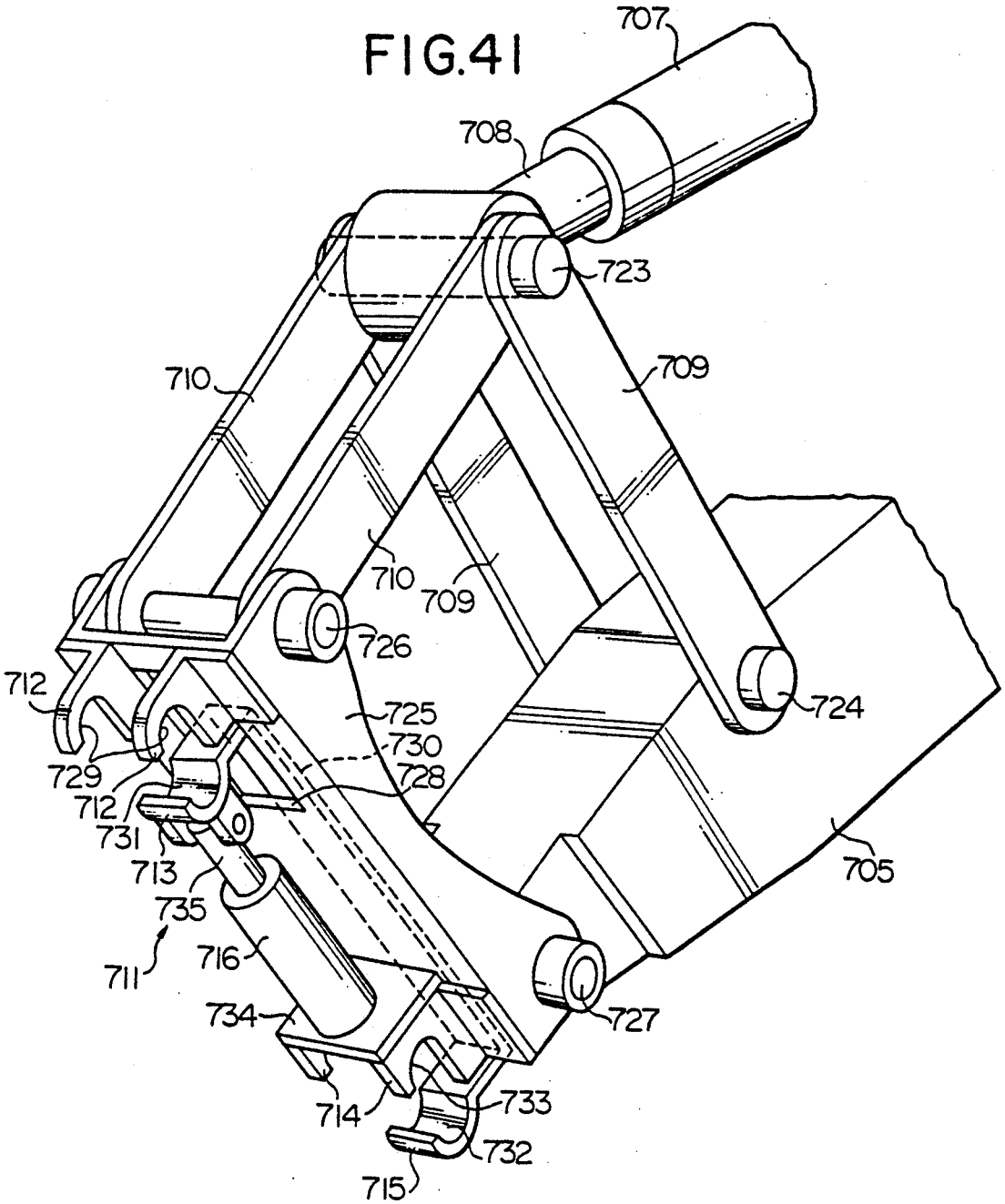
FIG. 41 is an enlarged perspective view of a main portion of the accessory detachable mechanism in FIG. 40.

Modification of Sixth Embodiment (FIGS. 38 and 39)

A detachable mechanism according to a modification of the sixth embodiment of the present invention will be described with reference to FIGS. 38 and 39.

The connecting pin 619 is manually inserted into the pin holes 613 and 618 according to the sixth embodiment. However, connecting pins 637 and 638 can be telescopically moved in or moved out from the side openings 670 and 671 of the arm 605 by oil under pressure so that the accessory can be automatically attached to and detached from the tip end of the arm 605.

The arm 605 has a hydraulic cylinder 640 accommodated therein in parallel with a longitudinal direction thereof. A cylinder rod 641 of the hydraulic cylinder 640 is directed forward the arm 605. A tip end of the cylinder rod 641 is connected to a triangular operation plate 642 at a central bottom thereof. Two oblique sides of the operation plate 642 are determined to have a given angle relative to side surfaces of the arm 605. A guide groove 643 is defined at upper and lower surfaces of the operation plate 642 extending from the tip end of the operation plate 642 toward the cylinder rod 641.

Block-shaped guide bodies 644 and 645 are vertically fixed to the tip end of the arm 605 in parallel with each other. An interval between a lower surface of the guide body 644 and upper surface of the guide body 645 is set to be slightly greater than the thickness of the operation plate 642. Both the guide bodies 644 and 645 have guide projections 646 and 647 protruding from the central portions thereof. The guide projections 646 and 647 engage in the guide groove 643. The operation plate 642 is operated by the cylinder rod 641 when the guide projections 646 and 647 engage in the guide groove 643 and the upper and lower surfaces of the operation plate 642 contact the inner surfaces of the guide bodies 644 and 645. The operation plate 642 is slid by the force applied thereto by the cylinder rod 641 and held to be movable in the straight line.

Shapes of the holding pins 637 and 638 are described hereafter.

The holding pins 637 and 638 are cylindrical and have outer diameters less than inner diameters of pin holes 670 and 671. The holding pin 637 has a slide hole 650 defined inside thereof and coaxially therewith. An insertion groove 651 having a rectangular shape in cross section is defined at the open end of the slide hole 650 so as to cross at a right angle relative to an axial line of the slide hole 650. Aslant operation surfaces 652 and 653 are defined at an inner bottom surface of the insertion groove 651, which inclined angles of the operation surfaces 652 and 653 conform to angles of inclination of the oblique sides of the operation plate 642.

The holding pin 638 has a portion having an outer diameter which is slightly less than inner diameter of the hole 671. The holding pin 638 has insertion portions 654 and 655 having small outer diameter at the inner side of the arm 605 and capable of being inserted into the slide hole 650. The insertion portion has an insertion groove 656 formed by cutting it at the central portion thereof for forming an upper portion 654 and a lower portion 655. The groove crosses at a right angle with an axial line of the holding pin 637. The insertion groove 656 has an aslant operation surface 657 at a bottom surface thereof. Angles of inclination of the operation surface 657 conform to the angles of inclination of the oblique sides of the operation plate 642.

The holding pins 637 and 638 are automatically moved in and moved out from side openings 670 and 671 of the arm 605. Upper and lower stop pins 660 and 661 protrude from the holding pin 637 and are positioned inside the arm 605. A coil spring 662 is provided around the periphery of the holding pin 637 and interposed between the upper and lower stop pins 660 and 661 and the inner wall of the arm 605. Upper and lower stop pins 663 and 664 protrude from the holding pin 638 and are positioned inside the arm 605. A coil spring 665 is provided around the periphery of the holding pin 638 and interposed between the upper and lower stop pins 663 and 664 and the inner wall of the arm 605.

The holding pins 637 and 638 are biased inwardly toward the central portion of the arm 605 by the coil springs 662 and 665. Accordingly, when the hydraulic cylinder 640 is operated to push the cylinder rod 641, the oblique sides of the operation plate 642 contact the operation surfaces 652, 653, 657 to thereby move the holding pins 637 and 638 outwardly through the side openings 670 and 671 while the coil springs 662 and 665 are compressed between the stop pins 660, 661 and 663, 664 and the inner wall of the arm 605.

However, when the cylinder rod 641 is contracted and the operation plate 642 is moved rightward in FIG. 38, the holding pins 637 and 638 are respectively drawn inside the arm 605 by the coil springs 662 and 665.

In such a manner, the hydraulic cylinder 640 is operated to telescopically move the holding pins 637 and 638 into or out of the side openings 670 and 671. Accordingly, when the bucket 615 is attached to the tip end of the arm 605, the hook pin 617 is hooked by the holding pawls 612 as shown in FIG. 37 while the bucket 615 is held by the holding links 611, and thereafter the hydraulic cylinder 640 is extended. As a result, the cylinder rod 641 is extended so that the holding pins 637 and 638 are automatically moved out from the side opening 670 and 671. Consequently, the holding pins 637 and 638 are automatically inserted into the pin holes 618. With the arrangement of the modification of the sixth embodiment, the operator can operate the operation elements sitting on his seat of the excavator to move the holding pins 637 and 638 into or out of the side openings 670 and 671. Accordingly, it is not necessary that the operator gets off the excavator to carry out the attachment and detachment operations made in the sixth embodiment whereby the attachment and detachment operations of the bucket 615 can be expedited.

As described above, according to the sixth embodiment, various accessories can be detachably attached to the tip end of the conventional excavator with such a simple arrangement. It is not necessary to remodel the arm to the large extent since the links having the holding pawls are merely connected to the arm of the conventional excavator. Accordingly, it is possible to utilize the conventional excavator. Furthermore, the arrangement of the accessory such as a bucket for use in construction and earth work are interchangeable with other accessories.

Seventh Embodiment

A detachable mechanism according the a seventh embodiment will be described with reference to FIGS. 40 to 48. Again, corresponding parts of earlier embodiments are defined by the same numbers modified to have an initial "7".

A detachable body 711 has upper fixed pawls or hooks 712 directed downward at right and left sides of the upper portion thereof and a lower fixed pawls or hooks 714 directed downward at right and left sides of the lower portion thereof. An upper movable pawl or hook 713 directed upward is slidably interposed between the upper fixed pawls 712 and lower fixed pawls 714, while a lower movable pawl or hook 715 directed upward is slidably provided under the fixed pawls 714. Both the pawls 713 and 715 can be simultaneously vertically moved. A hydraulic cylinder 716 is interposed between the lower fixed pawls 714 and the upper movable pawl 713 for attachment and detachment operations.

Rising links 709 and connecting links 710 are respectively connected to right and left sides of the tip end of a cylinder rod 708 by a pin 723 so as to be 10 turned. Lower ends of the rising links 709 are respectively rotatably connected to right and left sides of the portion adjacent to the tip end of the arm 705 by a pin 724. An assembly 725 forming a base of the detachable body 711 has a U-shape cross section viewed from the top and a C-shape viewed from both sides, and is formed by bending a steel plate. An inside of the U-shaped portion of the assembly 725 covers the tip ends of the connecting links 710 and the tip end of the arm 705, while the tip end of the connecting links 710 and the upper end of the assembly 725 are connected to each other by a pin 726 so as to be turned, and the tip end of the arm 705 and the lower portion of the assembly 725 are connected to each other by a pin 727 so as to be turned.

A rectangular window 728 is opened at the upper front flat portion of the assembly 725, while the pair of fixed pawls 712 bent in L-shape are fixed adjacent to right and left sides of the upper portion of the window. Hook surfaces 729 curved in C-shape and defined in the upper fixed pawls 712 are directed downward. A pair of lower fixed pawls 714 are fixed to a front lower portion of the assembly 725 while hook surfaces 733 curved in C-shape and defined in the lower fixed pawls 714 are directed downward. An interlock body 730 having a long length which is substantially the same as the length of the assembly 725 is slidably provided inside the assembly 725. An upper end or leg of the interlock body 730 is connected to the upper movable pawl 713 by passing through the window 728. A lower end or leg of the interlock body 730 protrudes at a right angle at the lower end of the assembly 725 and is connected to the lower movable pawl 715. A U-shaped structure is formed by the interlock body 730, the upper movable pawl 713 and the lower movable pawl 715 which can be simultaneously vertically moved. A hook surface 731 curved in a C-shape and defined in the upper movable pawl 713 is directed upward to confront the hook surfaces 729 of the upper fixed pawls 712. The hook surface 732 formed at the lower movable pawl 715 and curved in a C-shape is directed upward to confront the hook surfaces 733 of the lower fixed pawls 714.

A flat support plate 734 is fixed between the pair of lower fixed pawls 714 at the tip ends thereof, while a base of a hydraulic cylinder 716 is fixed to the upper surfaces of the support plate 734. The hydraulic cylinder 716 has the tip end of a telescopic cylinder rod 735 connected to the upper movable pawl 713. With the arrangement, the cylinder rod 735 moves telescopically by the operation of the hydraulic cylinder 716 whereby the upper movable pawl 713, the interlock body 730 and the lower movable pawl 715 are simultaneously vertically moved.

The distance between hook surfaces 729 and 733 at the innermost ends thereof conforms to the distance between holding pins 719 and 720 fixed to an attached body 718 of a bucket 717. The distance between the hook surfaces 731 and 732 at the innermost end thereof also conforms to the distance between the holding pins 719 and 720.

Figure 43:
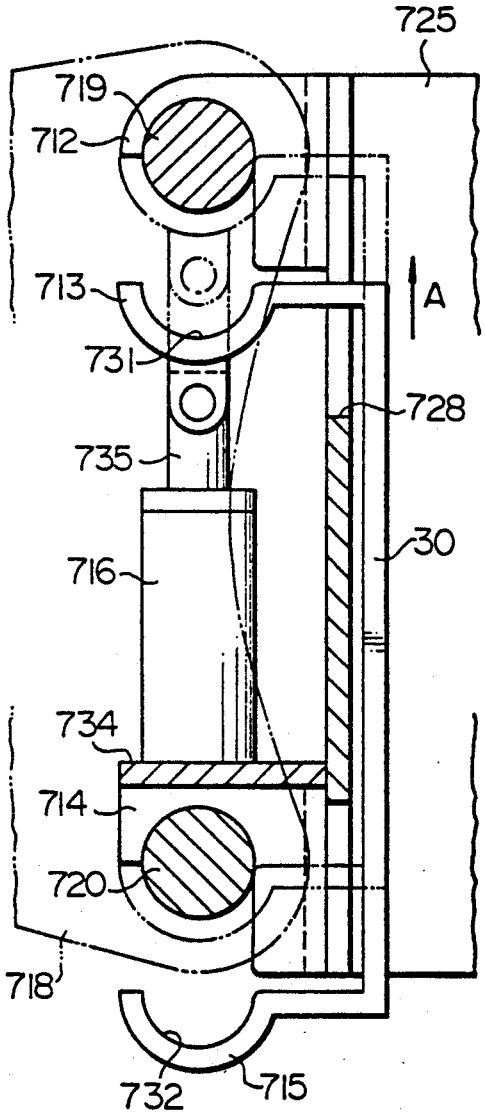
FIG. 43 is a cross sectional view showing a state where the detachable mechanism is engaged with the bucket.

An operation of the detachable mechanism according to the seventh embodiment will be described with reference to FIGS. 43 to 45.

Figure 42:
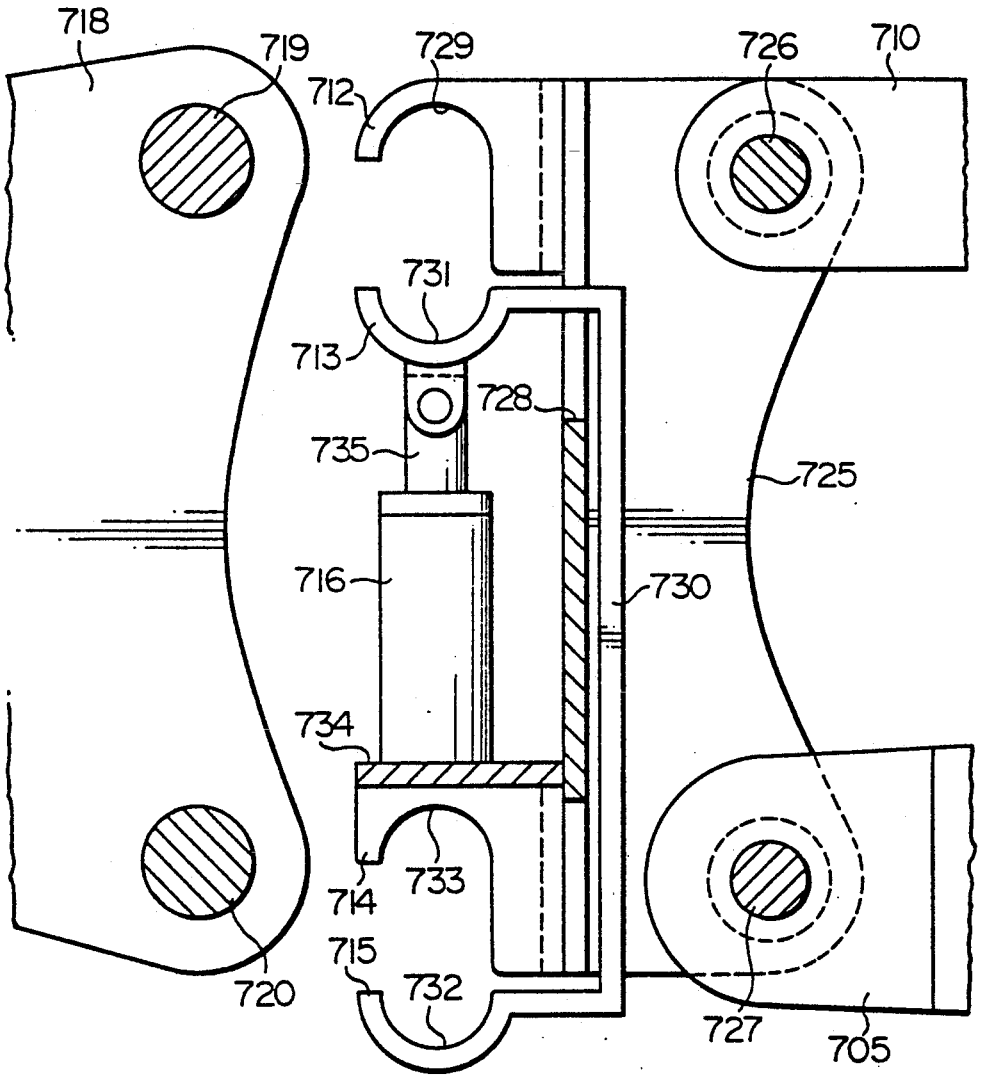
FIG. 42 is a side cross sectional view showing a structure of a bucket and a structure of the detachable mechanism in FIG. 41.
Figure 44:
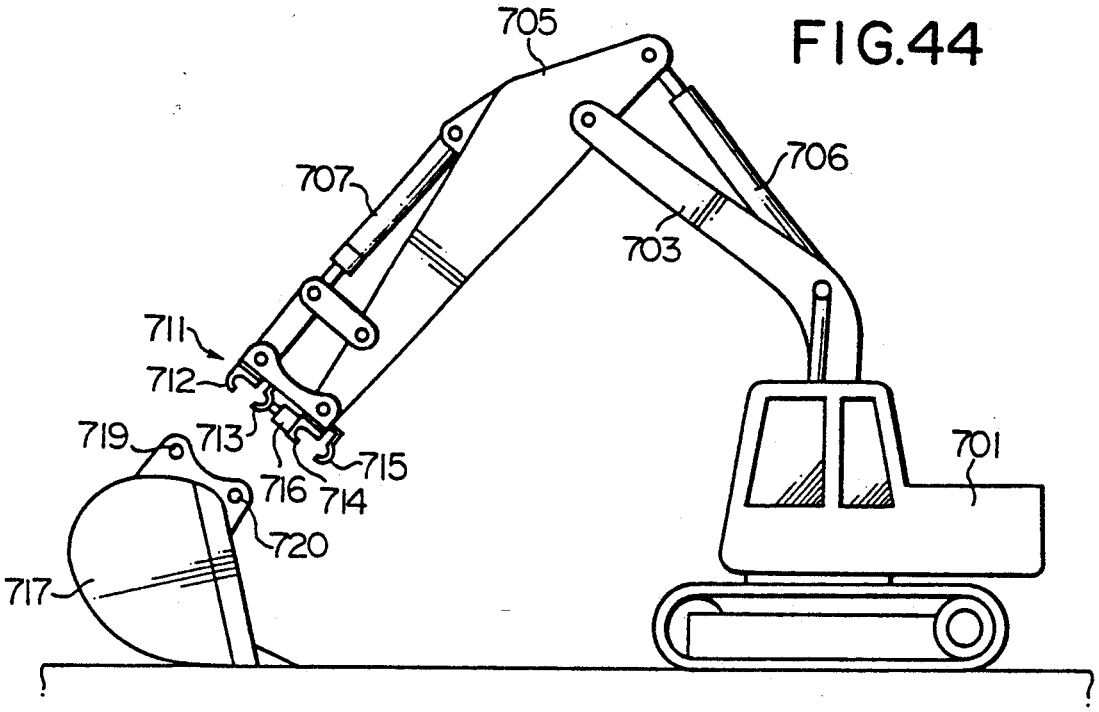
FIG. 44 is a view showing a state just before the bucket is attached to the tip end of the arm.

In FIG. 44, the accessory such as the bucket 717 is not attached to the tip end of the arm 715. The cylinder rod 735 is moved in the hydraulic cylinder 716 whereby the upper movable pawl 713, the interlock body 730 and the lower movable pawl 715 are respectively lowered downward as illustrated in FIG. 42. In FIG. 42, a space between the hook surfaces 729 and 731, and a space between the hook surfaces 732 and 733, are respectively enlarged while the spacing between the upper fixed pawls 712 and the tip end of the upper movable pawl 713, and the lower fixed pawls 714 and the tip end of the lower movable pawl 715, are respectively increased.

At this state, hydraulic cylinders 704 and 706 are cooperated with each other to swing the boom 703 and the arm 705, thereby approaching the detachable body 711 of the bucket 717 as illustrated in FIG. 44. FIG. 43 is an enlarged view showing the state where the upper fixed pawls 712 and lower fixed pawls 714 contact the holding pins 719 and 720 of the bucket 717. When the detachable body 711 is approached to the bucket 717, the holding pin 719 passes into the space defined by the upper fixed pawls 712 and the upper movable pawl 713, and thereafter moves into the elliptic space defined between the hook surfaces 729 and 731. The holding pin 720 passes into the space defined by the lower fixed pawls 714 and the lower movable pawl 715, and thereafter moves into the elliptic space defined between the hook surfaces 732 and 733. Successively, the hydraulic cylinders 704 and 706 are operated so that the upper surface of the holding pin 719 contacts inner peripheries of the hook surfaces 729 while the upper surface of the holding pin 720 contacts inner peripheries of the hook surfaces 733.

The hydraulic cylinder 716 is then operated to move the cylinder rod 735. As a result, the upper movable pawl 713, the interlock body 730 and the lower movable pawl 715 are simultaneously moved in the direction as denoted at A in FIG. 43 so that the lower surface of the holding pin 719 moves into contact with the hook surface 731 of the upper movable pawl 713. Since at the same time the lower movable pawl 715 is moved by the interlock body 730, the lower surface of the holding pin 720 moves into contact with the hook surface 732 of the lower movable pawl 715. In such a manner, an entire periphery of the holding pin 719 is gripped by the hook surfaces of the pawls 712 and 713, while an entire periphery of the holding pin 720 is gripped by the hook surfaces of the pawls 714 and 715. When the entire peripheries of both the holding pins 719 and 720 are gripped, the bucket 717 is connected to the tip end of the arm 705 as illustrated in one dotted lines in FIG. 43.

When the bucket 717 is connected to the arm 705, both the bucket 717 and the arm 705 can be operated together. When the arm 705 is raised, the bucket 717 can be also raised. The hydraulic cylinders 704, 706 and 707 are cooperatively operated to thereby swing the boom 703 and the arm 705 vertically so that the bucket. 717 can operate on the earth or the construction work such as excavating or trenching work in the same manner as the ordinary excavator.

Figure 45:
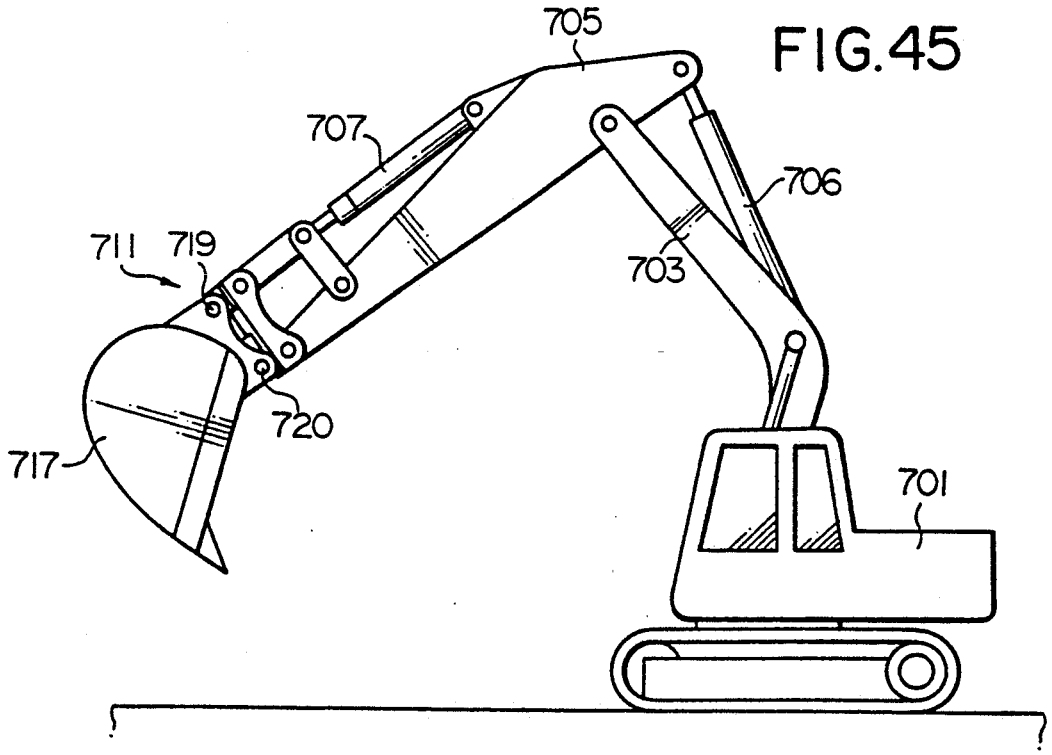
FIG. 45 is a view showing a state where the bucket is attached to the tip end of the arm is raised.

When the bucket 717 is removed from the tip end of the arm, the bucket 717 is lowered to the ground from the state as illustrated in FIG. 45, and thereafter the hydraulic cylinder 716 is operated to move the cylinder rod therein so that the upper movable pawl 713 and the lower movable pawl 715 are respectively moved away from the peripheries of the holding pins 719 and 720. Consequently, as illustrated in a solid line of FIG. 43, the interval between the upper fixed pawls 712 and the tip end of the upper movable pawl 713, and the interval between the lower fixed pawls 714 and the tip end of the lower movable pawl 715, are respectively enlarged. Successively the hydraulic cylinders 704 and 706 are respectively controlled to swing the arm 705, thereby drawing the holding pin 719 from the space defined by the upper fixed pawls 712 and the upper movable pawl 713 and drawing the holding pin 720 from the space defined by the lower fixed pawls 714 and the lower movable pawl 715 so that the bucket 717 is detached from the arm 705. In the sequence of the operations, the bucket 717 can be detached from the tip end of the arm 705 with ease.

Figure 46:
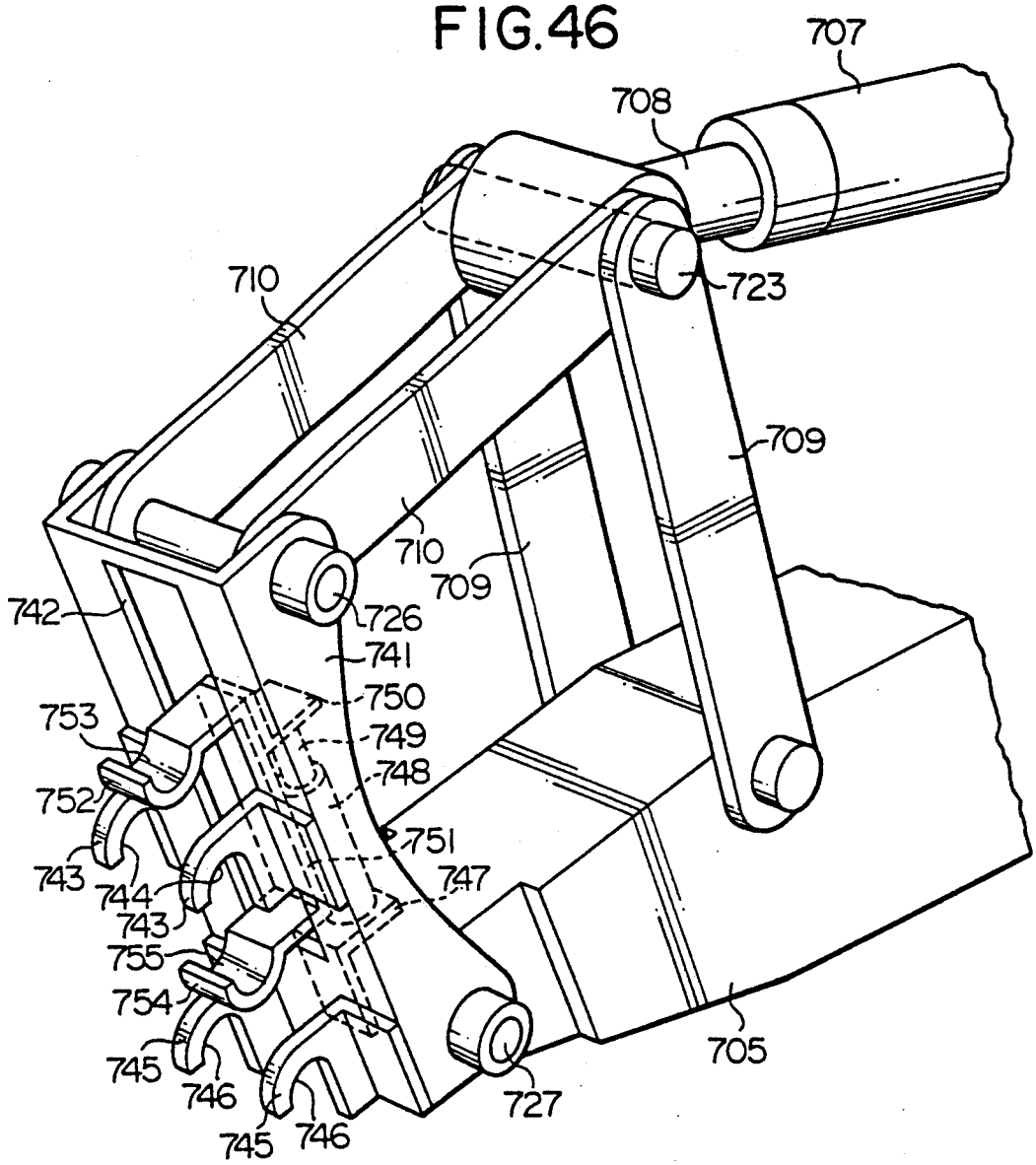
FIG. 46 is an exploded perspective view of a main portion of a detachable mechanism attached to the tip end of the arm according to a modification of the seventh embodiment.
Figure 47:
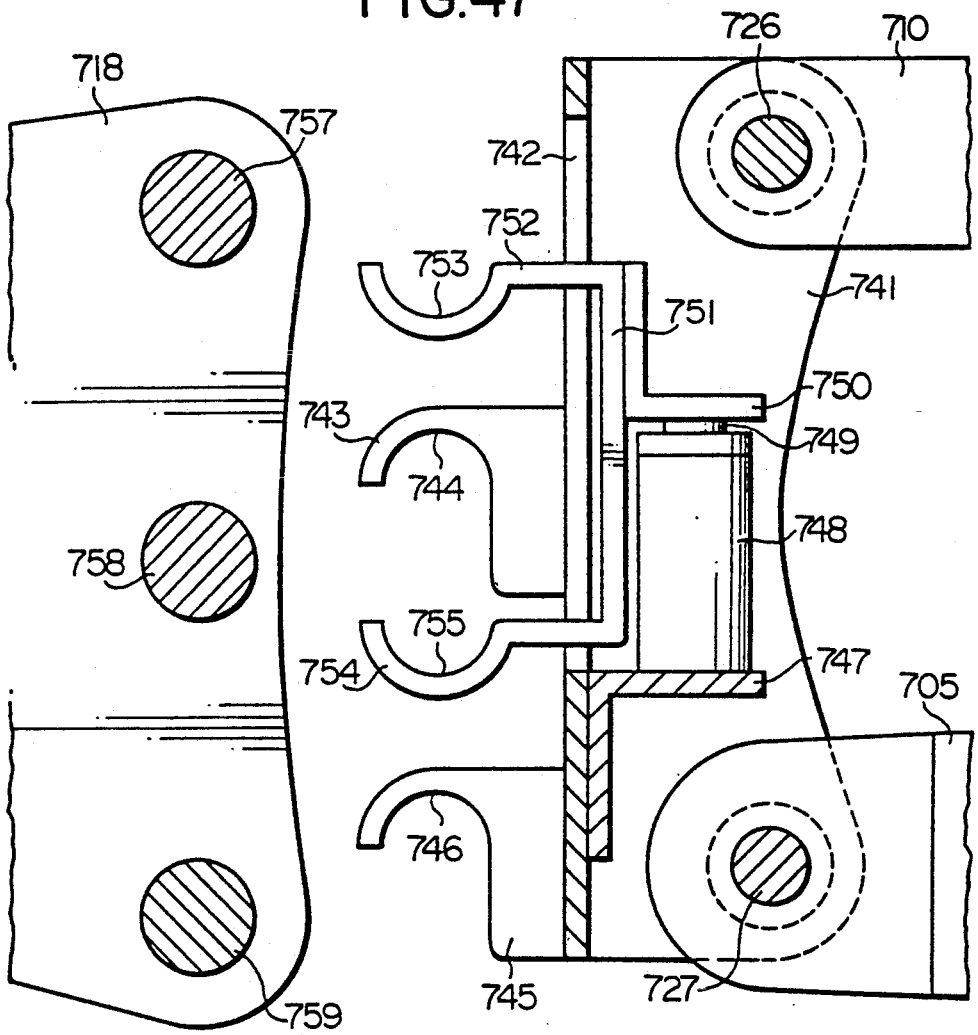
FIG. 47 is a side cross sectional view showing a relation between a bucket and the detachable mechanism according to the modification of the seventh embodiment.
Figure 48:
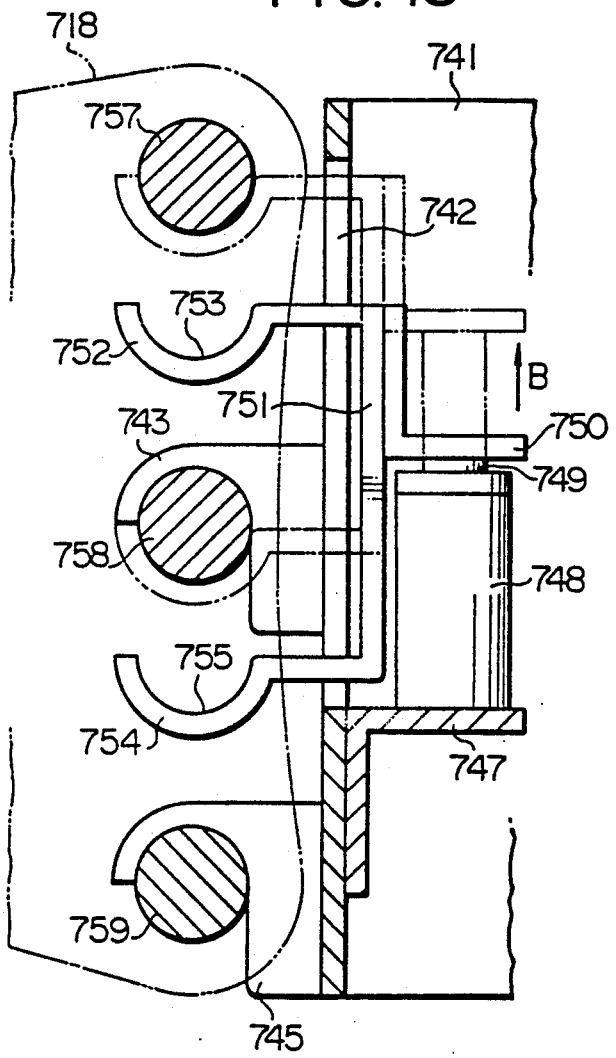
FIG. 48 is a cross sectional view showing a state where the bucket is engaged with the detachable mechanism according to the modification of the seventh embodiment.

Modification of the Seventh Embodiment (FIGS. 46 to 48)

A modification of the seventh embodiment will be described with reference to FIGS. 46 to 48.

An assembly 741 interposed between the connecting links 710 and the tip end of the arm 705 has a U-shape viewed from the top and a C-shape viewed from both sides thereof and is formed by bending a steel plate. The U-shaped assembly 741 covers the tip ends of the connecting links 710 and the tip end of the arm 705, and the tip end of the connecting links 710 and the upper end of the assembly 741 are connected to each other by the pin 726 so as to be turned, and the tip end of the arm 705 and the lower portion of the assembly 741 are connected to each other by a pin 727 so as to be turned. The flat front portion of the assembly 741 is directed forward.

A rectangular window 742 is opened at the upper front flat portion of the assembly 741 while a pair of fixed pawls 743 bent in L-shape are fixed adjacent to right and left sides of the upper portion of the window 742. Hook surfaces 744 curved in C-shape and defined in the upper fixed pawls 743 are directed downward. A pair of lower fixed pawls 745 are fixed to right and left sides of a front lower portion of the assembly 741 while hook surfaces 746 curved in C-shape and defined in the lower fixed pawls 745 are directed downward.

An L-shaped angle 747 is fixed to the inner lower portion of the assembly 741 and a base of a hydraulic cylinder 748 is fixed to the angle 747. The hydraulic cylinder 748 is operated by oil under pressure while a cylinder rod 749 operated by the hydraulic cylinder 748 is directed upward and fixed to an angle 750 at the upper end thereof. Angle 750 is fixed to an interlock body 751 which can vertically move inside the assembly 741. An upper movable pawl 752 is fixed to the upper end of the interlock body 751 at a right angle therewith so as to pass through the window 742. A U-shaped hook surface of the upper movable pawl 752 is directed upward. A lower movable pawl 754 is fixed to a lower end of the interlock body 751 at a right angle therewith so as to pass through the window 742 and a C-shaped hook surface 755 of the lower movable pawl 754 is directed upward. The positional relation between the upper fixed pawls 743, the lower fixed pawl 745, the upper movable pawl 752 and the lower movable pawl 754 is illustrated in FIG. 47 in which the upper fixed pawls 743 are fixed substantially to the central portion of the assembly 741 while the lower fixed pawls 745 are fixed to the lower portion of the assembly 741. The upper movable pawl 752 is positioned above the upper fixed pawls 743, while the lower movable pawl 754 is positioned between the upper fixed pawls 743 and the lower fixed pawls 745.

Holding pins 757, 758 and 759 respectively fixed to the attached body 718 of the bucket 717 are respectively disposed in parallel with each other as illustrated in FIG. 48. Intervals between the holding pins 757, 758 and 759 and the positional relation between the upper fixed pawls 743, the lower fixed pawls 745, the upper movable pawl 752 and the lower movable pawl 754 are respectively illustrated in FIGS. 47 and 48. That is, the interval between the holding pins 758 and 759 conforms to the interval between the hook surfaces 744 of the upper fixed pawls 743 and the hook surfaces 746 of the lower fixed pawls 745, while the interval between the holding pins 757 and 758 conforms to the interval between the innermost of the hook surfaces 753 and 755 of the upper and lower movable pawls 752 and 754. When the hydraulic cylinder 748 is operated to move the cylinder rod 749 therein, both the upper and lower movable pawls 752 and 754 are simultaneously moved downward as illustrated in FIG. 47 so that the interval between the upper fixed pawls 743 and the tip end of the lower movable pawl 754 is enlarged. At this time, the intervals between the tip ends of the lower fixed pawls 745 and the tip ends of the upper movable pawls 752 are less than the interval between the lower end of the holding pin 757 and the upper end of the holding pin 759 while the interval between the upper fixed pawl 743 and the lower movable pawl 754 is greater than the outer diameter of the holding pin 758. Accordingly, when the assembly 741 is moved leftward as a whole in the state of FIG. 47, the upper movable pawl 752 and the upper fixed pawls 743 are guided into a space defined between the holding pins 757 and 758 while the lower movable pawl 754 and the lower fixed pawls 745 are guided into a space defined between the holding pins 758 and 759. The holding pin 758 is inserted into an elliptical space defined between the upper fixed pawls 743 and the lower movable pawls 754.

An operation according to the modification of the seventh embodiment will be described hereinafter.

When the hydraulic cylinder 748 is operated to move the cylinder rod 749 thereinto, this enlarges the interval between the upper fixed pawls 743 and the tip end of the lower movable pawl 754 into which interval the holding pin 758 is guided, whereby the holding pin 758 is inserted into an elliptical space defined between the hook surfaces 744 and the hook surface 755. At the same time, the upper movable pawl 752 is guided into a space between the holding pins 757 and 758 while the lower fixed pawls 745 are guided into a space between the holding pins 758 and 759. Thereafter, the arm 705 is swung to thereby slightly lower the assembly 741 in FIG. 47 so that the hook surfaces 44 are brought into contact with the holding pin 758 while the hook surfaces 746 are brought into contact with an upper periphery of the holding pin 759 which is illustrated in solid lines 10 in FIG. 48. In FIG. 48, the holding pin 758 is held by the upper fixed pawls 743 while the holding pin 759 is held by the lower fixed pawls 745. Successively, when the oil under pressure is supplied to the hydraulic cylinder 748 at the same state to move the cylinder rod 749 out of the hydraulic cylinder 748, this moves the angle 750 and the interlock body 751 in the direction as denoted at B in FIG. 48. As a result, the upper movable pawl 752 connected to the interlock body 751 and the lower movable pawl 754 are moved upward so that the hook surface 753 of the upper movable pawl 752 is brought into contact with the lower periphery of the holding pin 757. The hook surface 755 of the lower movable pawl 754 is brought into contact with the lower periphery of the holding pin 758. Accordingly, when the cylinder rod 749 moves in the direction denoted at B of FIG. 48, the entire periphery of the holding pin 758 is gripped by the hook surfaces 744 and 755 while the lower periphery of the holding pin 757 is held by the hook surface 753 and the upper periphery of the holding pin 759 is held by the hook surfaces 746. As is explained above, when the hydraulic cylinder 748 is operated, the holding pins 757, 758 and 759 are firmly gripped by the upper fixed pawls 743, the lower fixed pawls 745, the upper movable pawl 752 and the lower movable pawl 754 whereby the bucket 717 is firmly connected to the tip end of the arm 705.

With the arrangement of the seventh embodiment of the present invention, it is possible to detachably attach the various accessories to the tip end of the arm in a short time. Inasmuch as the detachable mechanism has a plurality of pawls, the pins of the accessories can be firmly held by the pawls of the detachable mechanism.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a construction machine comprising a mobile chassis, a boom mounted on the mobile chassis and capable of swinging vertically, an arm pivotally connected to the boom, an accessory detachable mechanism connected to a tip end of the arm provided with a hydraulic cylinder having a cylinder rod connected to said accessory detachable mechanism, and an accessory to be held by the detachable mechanism, characterized in that the accessory detachable mechanism comprises:

rising links pivotally connected at upper ends thereof to the tip end of the cylinder rod and at lower ends thereof to a portion adjacent to the tip end of the arm;

connecting links pivotally connected to the tip end of the cylinder rod at one ends thereof;

a telescopic body composed of two symmetrical telescopic mechanisms each having upper covers and lower covers for forming outer frames thereof, the lower covers being slidably inserted into the upper covers and the upper covers being connected to other ends of the connecting links by a pin while the lower covers being connected to the tip end of the arm;

a pair of upper hooks attached to the upper covers; a pair of lower hooks attached to the lower covers; and pressure cylinders accommodated inside the upper and lower covers, the pressure cylinders having opposite ends which are respectively engaged with the respective upper and lower covers.

2. A mechanism according to claim 1, wherein the upper hooks have hook surfaces of substantially semi-circular shapes and guide surfaces defined aslant at the side of the pin and extending from the hook surfaces, and wherein the lower hooks have hook surfaces of substantially semi-circular shapes.

3. A mechanism according to claim 1, including:

an apron for covering the upper covers and having a U-shaped recess at the upper central portion thereof;

the pair of upper hooks being attached to the apron;

a connection plate for covering the lower covers;

the pair of lower hooks being attached to the connection plate; and an interlock body connected to the connection plane and having a central portion disposed behind the apron and a top portion having a presser hook disposed above the upper hooks.

* * * * *